US012590726B2

(12) United States Patent
Murayama et al.

(10) Patent No.: US 12,590,726 B2
(45) Date of Patent: Mar. 31, 2026

(54) AIR CONDITIONING LOAD LEARNING APPARATUS AND AIR CONDITIONING LOAD PREDICTION APPARATUS

(71) Applicant: DAIKIN INDUSTRIES, LTD., Osaka (JP)

(72) Inventors: Hiroyuki Murayama, Osaka (JP); Yoshiyuki Shimoda, Suita (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 504 days.

(21) Appl. No.: 18/023,599

(22) PCT Filed: Sep. 7, 2021

(86) PCT No.: PCT/JP2021/032779

§ 371 (c)(1),
(2) Date: Feb. 27, 2023

(87) PCT Pub. No.: WO2022/050420

PCT Pub. Date: Mar. 10, 2022

(65) Prior Publication Data

US 2023/0304691 A1 Sep. 28, 2023

(30) Foreign Application Priority Data

Sep. 7, 2020 (JP) ..... 2020-149959
Jul. 28, 2021 (JP) ..... 2021-123224

(51) Int. Cl.
*F24F 11/64* (2018.01)
*F24F 110/10* (2018.01)
(Continued)

(52) U.S. Cl.
CPC ..... *F24F 11/64* (2018.01); *F24F 2110/10* (2018.01); *F24F 2110/12* (2018.01);
(Continued)

(58) Field of Classification Search
CPC .... F24F 11/64; F24F 2140/50; F24F 2140/60; F24F 2110/10; F24F 2120/10;
(Continued)

(56) References Cited

U.S. PATENT DOCUMENTS 11,371,739 B2 * 6/2022 Wenzel ..... G06N 3/045
11,675,322 B2 * 6/2023 Du ..... G06N 3/08 700/278

(Continued)

FOREIGN PATENT DOCUMENTS

CN 110598923 A 12/2019
JP 2006-78009 A 3/2006
JP 5943255 B2 6/2016

OTHER PUBLICATIONS

International Search Report of corresponding PCT Application No. PCT/JP2021/032779 dated Dec. 14, 2021.

(Continued)

*Primary Examiner* — Darrin D Dunn
(74) *Attorney, Agent, or Firm* — Spencer Fane LLP

(57) ABSTRACT

An air conditioning load learning apparatus includes an actual load acquisition unit, a first information acquisition unit, and a learning unit. The actual load acquisition unit acquires an actual air conditioning load in a target space inside a target building. The first information acquisition unit acquires first information about an operation of the target building. The learning unit generates a learning model using at least the first information as an explanatory variable and a value regarding the actual air conditioning load as an objective variable. An air conditioning load prediction apparatus includes the air conditioning load learning apparatus.

23 Claims, 30 Drawing Sheets

(51) Int. Cl.

| | |
|---|---|
| *F24F 110/12* | (2018.01) |
| *F24F 110/20* | (2018.01) |
| *F24F 110/22* | (2018.01) |
| *F24F 140/50* | (2018.01) |

(52) U.S. Cl.
CPC ..... *F24F 2110/20* (2018.01); *F24F 2110/22* (2018.01); *F24F 2140/50* (2018.01)

(58) Field of Classification Search
CPC . F24F 11/62; G05B 2219/2614; G05B 15/02; G05B 19/042; G05B 13/0265; G05B 13/04; G05B 13/048; G05B 2219/2642; G06N 20/00; G06N 3/084
See application file for complete search history.

(56) References Cited

U.S. PATENT DOCUMENTS

| | | | | |
|---|---|---|---|---|
| 12,002,121 | B2 * | 6/2024 | Elbsat | G05B 13/026 |
| 12,242,259 | B2 * | 3/2025 | Elbsat | G16Y 20/30 |
| 2016/0146493 | A1 * | 5/2016 | Ettl | F24F 11/62 700/29 |
| 2019/0187635 | A1 * | 6/2019 | Fan | F24F 11/63 |
| 2019/0360711 | A1 * | 11/2019 | Sohn | F24F 11/47 |
| 2020/0355387 | A1 * | 11/2020 | Samuni | G05B 23/0254 |

OTHER PUBLICATIONS

Rei Kadota et al., "Development and verification of heat load prediction model combining dynamic heat load simulation and machine learning", The Society of Heating, Air-Conditioning and Sanitary Engineers of Japan Collection of Papers, E-19, Sep. 1, 2020, Japan.

Extended European Search Report of corresponding EP Application No. 21 864 471.4 dated Sep. 30, 2024.

Afram et al. "Black-box modeling of residential HVAC system and comparison of gray-box and black-box modeling methods" Journal, Energy and Buildings vol. 94, May 2015, pp. 121-149, Amsterdam, NL.

Freire et al. "Development of regression equations for predicting energy and hygrothermal performance of buildings" Journal, Energy and Buildings vol. 40, Jan. 2008, pp. 810-820, Amsterdam, NL.

International Preliminary Report of corresponding PCT Application No. PCT/JP2021/032779 dated Mar. 16, 2023.

* cited by examiner

AIR CONDITIONING LOAD LEARNING APPARATUS AND AIR CONDITIONING LOAD PREDICTION APPARATUS

CROSS-REFERENCE TO RELATED APPLICATIONS

This U.S. National stage application claims priority under 35 U.S.C. § 119(a) to Japanese Patent Applications Nos. 2020-149959, filed in Japan on Sep. 7, 2020, and 2021-123224, filed in Japan on Jul. 28, 2021. the entire contents of which are hereby incorporated herein by reference.

BACKGROUND

Technical Field

The present invention relates to an air conditioning load learning apparatus and an air conditioning load prediction apparatus.

Background Art

To implement optimum facility design, optimum control design, and the like, at the time of updating an air conditioner, there is a need to provide a highly accurate air conditioning load prediction technique in consideration of the operation of a proposed building. In Japanese Patent No. 5943255, the difference between the actual air conditioning load measurement value and the external thermal load (excluding the internal heat generation) obtained by the physical model is determined so that the internal heat generation related to the operation of the building is estimated and used for air conditioning load prediction.

SUMMARY

In order to predict the air conditioning load by using the method disclosed in Japanese Patent No. 5943255, there is a need to input the information about the operation of the building so as to reflect the effect of the operation of the building on the internal heat generation, or the like. However, the information about the operation of the building is typically hard to obtain and is often incomplete even if it is obtained. Therefore, the method disclosed in Japanese Patent No. 5943255 has an issue that it is difficult to grasp the effect of the operation of the building on the air conditioning load.

Solution to Problem

An air conditioning load learning apparatus according to a first aspect includes an actual load acquisition unit, a first information acquisition unit, and a learning unit. The actual load acquisition unit acquires an actual air conditioning load that is an actual air conditioning load in a target space inside a target building. The first information acquisition unit acquires first information. The first information is information about an operation of the target building. The learning unit generates a learning model using at least the first information as an explanatory variable and using a value regarding the actual air conditioning load as an objective variable.

In the air conditioning load learning apparatus according to the first aspect, the learning unit generates the learning model using at least the first information as an explanatory variable and using the value regarding the actual air conditioning load as an objective variable. Therefore, the air conditioning load learning apparatus can associate the first information with the value regarding the actual air conditioning load to learn the effect of the operation of the building on the internal heat generation, etc. As a result, the air conditioning load learning apparatus can finally grasp the effect of the operation of the building on the air conditioning load.

An air conditioning load learning apparatus according to a second aspect is the air conditioning load learning apparatus according to the first aspect and further includes a prediction load acquisition unit. The prediction load acquisition unit acquires a prediction air conditioning load that is an air conditioning load in the target space predicted by a physical model from at least a thermal property of the target building. The learning unit generates the learning model using the first information as an explanatory variable and using a difference load, which is a difference between the actual air conditioning load and the prediction air conditioning load, as an objective variable.

With such a configuration, the air conditioning load learning apparatus according to the second aspect can associate the first information with the difference load (the value regarding the actual air conditioning load) to learn the effect of the operation of the building on the internal heat generation, etc. As a result, the air conditioning load learning apparatus can finally grasp the effect of the operation of the building on the air conditioning load.

An air conditioning load learning apparatus according to a third aspect is the air conditioning load learning apparatus according to the second aspect, wherein the actual air conditioning load is an air conditioning load per unit time.

With such a configuration, the air conditioning load learning apparatus according to the third aspect can learn the effect of the operation of the building on the air conditioning load in more detail.

An air conditioning load learning apparatus according to a fourth aspect is the air conditioning load learning apparatus according to the second aspect or the third aspect and further includes a second information acquisition unit. The second information acquisition unit acquires second information. The second information is at least one of an indoor humidity, an indoor temperature, an air conditioning operating time, a post air conditioning operation start elapsed time, an outside air temperature, an outside air humidity, and solar radiation. The learning unit generates the learning model further using the second information as an explanatory variable.

With such a configuration, the air conditioning load learning apparatus according to the fourth aspect can learn the effect of the operation of the building on the outside air introduction load, the heat storage load, the solar radiation load, etc. As a result, the air conditioning load learning apparatus can finally grasp the effect of the operation of the building on the air conditioning load.

An air conditioning load learning apparatus according to a fifth aspect is the air conditioning load learning apparatus according to any one of the second aspect to the fourth aspect, wherein the learning unit generates the learning model further using the prediction air conditioning load as an explanatory variable.

With such a configuration, the air conditioning load learning apparatus according to the fifth aspect can generate the learning model having a higher prediction accuracy.

An air conditioning load prediction apparatus according to a sixth aspect includes a difference load prediction unit and a load prediction unit. The difference load prediction unit uses the learning model of the air conditioning load learning apparatus according to the second aspect or the third aspect to predict the difference load from the first information. The load prediction unit predicts an air conditioning load in the target space based on the predicted difference load and the prediction air conditioning load.

With such a configuration, the air conditioning load prediction apparatus according to the sixth aspect can use the learning model having learned the effect of the operation of the building on internal heat generation, and the like, to predict the air conditioning load in consideration of the effect of the operation of the building.

An air conditioning load prediction apparatus according to a seventh aspect is the air conditioning load prediction apparatus according to the sixth aspect, wherein the learning model is generated based on the first information, the actual air conditioning load, and the prediction air conditioning load in a short period. The difference load prediction unit predicts, from the first information in a long period that is a period longer than the short period, the difference load in the long period, The load prediction unit predicts an air conditioning load in the long period in the target space based on the predicted difference load in the long period and the prediction air conditioning load in the long period.

With such a configuration, the air conditioning load prediction apparatus according to the seventh aspect can use the first learning model having learned with the data in the short period to predict the air conditioning load in the long period.

An air conditioning load prediction apparatus according to an eighth aspect includes a difference load prediction unit and a load prediction unit. The difference load prediction unit uses the learning model of the air conditioning load learning apparatus according to the fifth aspect to predict the difference load from the first information and the second information or the prediction air conditioning load. The load prediction unit predicts an air conditioning load in the target space based on the predicted difference load and the prediction air conditioning load.

With such a configuration, the air conditioning load prediction apparatus according to the eighth aspect can use the learning model having learned the effect of the operation of the building on the internal heat generation, the outside air introduction load, the heat storage load, the solar radiation load, and the like, to predict the air conditioning load in consideration of the effect of the operation of the building.

An air conditioning load prediction apparatus according to a ninth aspect is the air conditioning load prediction apparatus according to the eighth aspect, wherein the learning model is generated based on the first information, the second information, the actual air conditioning load, and the prediction air conditioning load in a short period. The difference load prediction unit predicts, from the first information and the second information or the prediction air conditioning load in a long period that is a period longer than the short period, the difference load in the long period. The load prediction unit predicts an air conditioning load in the long period in the target space based on the predicted difference load in the long period and the prediction air conditioning load in the long period.

With such a configuration, the air conditioning load prediction apparatus according to the ninth aspect can use the learning model having learned with the data in the short period to predict the air conditioning load in the long period.

An air conditioning load learning apparatus according to a tenth aspect is the air conditioning load learning apparatus according to the first aspect and further includes a prediction load acquisition unit. The prediction load acquisition unit acquires a prediction air conditioning load that is an air conditioning load in the target space predicted by a physical model from at least a thermal property of the target building. The learning unit generates the learning model using the prediction air conditioning load and the first information as explanatory variables and using the actual air conditioning load as an objective variable.

With such a configuration, the air conditioning load learning apparatus according to the tenth aspect can associate the first information with the actual air conditioning load (the value regarding the actual air conditioning load) to learn the effect of the operation of the building on the internal heat generation, etc. As a result, the air conditioning load learning apparatus can finally grasp the effect of the operation of the building on the air conditioning load.

An air conditioning load learning apparatus according to an eleventh aspect is the air conditioning load learning apparatus according to the tenth aspect, wherein the actual air conditioning load is an air conditioning load per unit time.

With such a configuration, the air conditioning load learning apparatus according to the eleventh aspect can learn the effect of the operation of the building on the air conditioning load in more detail.

An air conditioning load learning apparatus according to a twelfth aspect is the air conditioning load learning apparatus according to the tenth aspect or the eleventh aspect and further includes a second information acquisition unit. The second information acquisition unit acquires second information. The second information is at least one of an indoor humidity, an indoor temperature, an air conditioning operating time, a post air conditioning operation start elapsed time, an outside air temperature, an outside air humidity, and solar radiation. The learning unit generates the learning model further using the second information as an explanatory variable.

With such a configuration, the air conditioning load learning apparatus according to the twelfth aspect can learn the effect of the operation of the building on the outside air introduction load, the heat storage load, the solar radiation load, etc. As a result, the air conditioning load learning apparatus can finally grasp the effect of the operation of the building on the air conditioning load.

An air conditioning load prediction apparatus according to a thirteenth aspect includes a load prediction unit. The load prediction unit uses the learning model generated by the learning unit in the air conditioning load learning apparatus according to the tenth aspect or the eleventh aspect to predict an air conditioning load in the target space from the prediction air conditioning load and the first information.

With such a configuration, the air conditioning load prediction apparatus according to the thirteenth aspect can use the learning model having learned the effect of the operation of the building on internal heat generation, and the like, to predict the air conditioning load in consideration of the effect of the operation of the building.

An air conditioning load prediction apparatus according to a fourteenth aspect is the air conditioning load prediction apparatus according to the thirteenth aspect, wherein the learning model is generated based on the prediction air conditioning load, the first information, and the actual air conditioning load in a short period. Based on the prediction air conditioning load and the first information in a long period that is a period longer than the short period, the load prediction unit predicts an air conditioning load in the long period in the target space.

With such a configuration, the air conditioning load prediction apparatus according to the fourteenth aspect can use the learning model having learned with the data in the short period to predict the air conditioning load in the long period.

An air conditioning load prediction apparatus according to a fifteenth aspect includes a load prediction unit. The load prediction unit uses the learning model generated by the learning unit in the air conditioning load learning apparatus according to the twelfth aspect to predict an air conditioning load in the target space from the prediction air conditioning load, the first information, and the second information.

With such a configuration, the air conditioning load prediction apparatus according to the fifteenth aspect can use the learning model having learned the effect of the operation of the building on the internal heat generation, the outside air introduction load, the heat storage load, the solar radiation load, and the like, to predict the air conditioning load in consideration of the effect of the operation of the building.

An air conditioning load prediction apparatus according to a sixteenth aspect is the air conditioning load prediction apparatus according to the fifteenth aspect, wherein the learning model is generated based on the prediction air conditioning load, the first information, the second information, and the actual air conditioning load in a short period. Based on the prediction air conditioning load, the first information, and the second information in a long period that is a period longer than the short period, the load prediction unit predicts an air conditioning load in the long period in the target space.

With such a configuration, the air conditioning load prediction apparatus according to the sixteenth aspect can use the learning model having learned with the data in the short period to predict the air conditioning load in the long period.

An air conditioning load learning apparatus according to a seventeenth aspect is the air conditioning load learning apparatus according to the first aspect and further includes an input value acquisition unit. The input value acquisition unit acquires a first input value and a second input value. The first input value is an input value including at least a thermal property of the target building to a physical model, which outputs a prediction air conditioning load that is a predicted air conditioning load in the target space. The second input value is an input value calculated by inverse calculation of the physical model using the actual air conditioning load. The learning unit generates the learning model using the first information as an explanatory variable and using a difference input value, which is a difference between the first input value and the second input value, as an objective variable.

With such a configuration, the air conditioning load learning apparatus according to the seventeenth aspect can associate the first information with the difference input value (the value regarding the actual air conditioning load) to learn the effect of the operation of the building on the internal heat generation, etc. As a result, the air conditioning load learning apparatus can finally grasp the effect of the operation of the building on the air conditioning load.

An air conditioning load learning apparatus according to an eighteenth aspect is the air conditioning load learning apparatus according to the seventeenth aspect, wherein the learning unit generates the learning model further using the first input value as an explanatory variable.

With such a configuration, the air conditioning load learning apparatus according to the eighteenth aspect can generate the learning model having a higher prediction accuracy.

An air conditioning load prediction apparatus according to a nineteenth aspect includes a difference input value prediction unit and a prediction load acquisition unit. The difference input value prediction unit uses the learning model of the air conditioning load learning apparatus according to the seventeenth aspect or the eighteenth aspect to predict the difference input value from at least the first information. The prediction load acquisition unit acquires a prediction air conditioning load that is an air conditioning load in the target space predicted by the physical model. The prediction air conditioning load is predicted by the physical model using, as an input, a third input value. The third input value is obtained by correcting the first input value using the predicted difference input value.

With such a configuration, the air conditioning load prediction apparatus according to the nineteenth aspect can use the learning model having learned the effect of the operation of the building on internal heat generation, and the like, to predict the air conditioning load in consideration of the effect of the operation of the building.

An air conditioning load learning apparatus according to a twentieth aspect is the air conditioning load learning apparatus according to the first aspect and further includes a prediction load acquisition unit and a difference input value acquisition unit. The prediction load acquisition unit acquires a prediction air conditioning load that is an air conditioning load in the target space predicted by a physical model from at least a thermal property of the target building. The difference input value acquisition unit acquires a difference input value calculated by inverse calculation of the physical model using a difference load that is a difference between the actual air conditioning load and the prediction air conditioning load. The learning unit generates the learning model using the first information as an explanatory variable and using the difference input value as an objective variable.

With such a configuration, the air conditioning load learning apparatus according to the twentieth aspect can associate the first information with the difference input value (the value regarding the actual air conditioning load) to learn the effect of the operation of the building on the internal heat generation, etc. As a result, the air conditioning load learning apparatus can finally grasp the effect of the operation of the building on the air conditioning load.

An air conditioning load learning apparatus according to a twenty-first aspect is the air conditioning load learning apparatus according to the twentieth aspect, wherein the learning unit generates the learning model further using an input value to the physical model as an explanatory variable.

With such a configuration, the air conditioning load learning apparatus according to the twenty-first aspect can generate the learning model having a higher prediction accuracy.

An air conditioning load prediction apparatus according to a twenty-second aspect includes a difference input value prediction unit, a prediction difference load acquisition unit, and a load prediction unit. The difference input value prediction unit uses the learning model of the air conditioning load learning apparatus according to the twentieth aspect or the twenty-first aspect to predict the difference input value from at least the first information. The prediction difference load acquisition unit acquires the difference load predicted by the physical model using the predicted difference input value as an input. The load prediction unit predicts an air conditioning load in the target space based on the acquired difference load and the prediction air conditioning load.

With such a configuration, the air conditioning load prediction apparatus according to the twenty-second aspect can use the learning model having learned the effect of the operation of the building on internal heat generation, and the like, to predict the air conditioning load in consideration of the effect of the operation of the building.

An air conditioning load learning apparatus according to a twenty-third aspect is the air conditioning load learning apparatus according to the first aspect and further includes an input value acquisition unit. The input value acquisition unit acquires a first input value and a second input value. The first input value is an input value including at least a thermal property of the target building to a physical model, which outputs a prediction air conditioning load that is a predicted air conditioning load in the target space. The second input value is an input value calculated by inverse calculation of the physical model using the actual air conditioning load. The learning unit generates the learning model using the first information and the first input value as explanatory variables and using the second input value as an objective variable.

With such a configuration, the air conditioning load learning apparatus according to the twenty-third aspect can associate the first information with the second input value (the value regarding the actual air conditioning load) to learn the effect of the operation of the building on the internal heat generation, etc. As a result, the air conditioning load learning apparatus can finally grasp the effect of the operation of the building on the air conditioning load.

An air conditioning load prediction apparatus according to a twenty-fourth aspect includes an input value prediction unit and a prediction load acquisition unit. The input value prediction unit uses the learning model of the air conditioning load learning apparatus according to the twenty-third aspect to predict the second input value from the first information and the first input value. The prediction load acquisition unit acquires a prediction air conditioning load that is an air conditioning load in the target space predicted by the physical model using the predicted second input value as an input.

With such a configuration, the air conditioning load prediction apparatus according to the twenty-fourth aspect can use the learning model having learned the effect of the operation of the building on internal heat generation, and the like, to predict the air conditioning load in consideration of the effect of the operation of the building.

DETAILED DESCRIPTION OF EMBODIMENT(S)

First Embodiment (1) Overall Configuration

Figure 1:
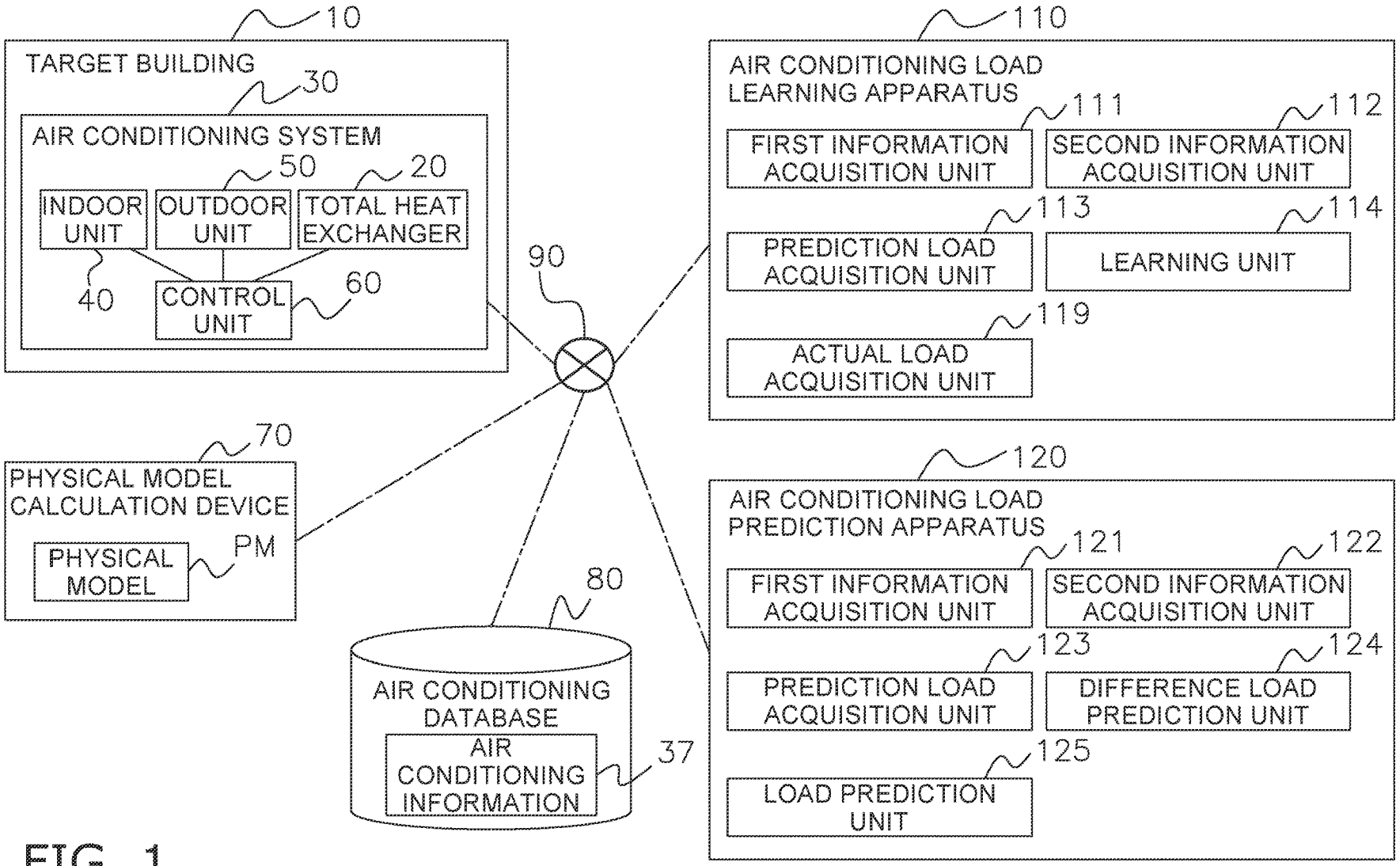
FIG. 1 is a configuration diagram of an air conditioning load learning apparatus and an air conditioning load prediction apparatus according to a first embodiment.

An air conditioning load learning apparatus 110 learns an air conditioning load of an air conditioning system 30 installed in a target building 10 and generates a learning model LM1. Hereinafter, a learning process by the air conditioning load learning apparatus 110 is referred to as an air conditioning load learning process. An air conditioning load prediction apparatus 120 uses the learning model LM1 generated by the air conditioning load learning apparatus 110 to predict the air conditioning load of the air conditioning system 30 installed in the target building 10. Hereinafter, a prediction process by the air conditioning load prediction apparatus 120 is referred to as an air conditioning load prediction process. The target building 10 is, for example, an office building. The target space 11 of the air conditioning system 30 in the target building 10 is, for example, an office space.

During the air conditioning load learning process and the air conditioning load prediction process, the air conditioning load learning apparatus 110 and the air conditioning load prediction apparatus 120 use thermal load calculation results by a physical model calculation device 70. The physical model calculation device 70 calculates the thermal load of the target building 10 based on a physical model PM. Hereinafter, a calculation process by the physical model calculation device 70 is referred to as a physical model calculation process.

FIG. 1 is a configuration diagram of the air conditioning load learning apparatus 110 and the air conditioning load prediction apparatus 120. As illustrated in FIG. 1, the air conditioning load learning apparatus 110, the air conditioning load prediction apparatus 120, the physical model calculation device 70, the air conditioning system 30, and an air conditioning database 80 are communicatively coupled via a network 90. According to the present embodiment, the network 90 is the Internet. However, the network 90 is not limited to the Internet as long as the air conditioning load learning apparatus 110, the air conditioning load prediction apparatus 120, the physical model calculation device 70, and the air conditioning system 30 are communicatively coupled. For example, when the air conditioning load learning apparatus 110, the air conditioning load prediction apparatus 120, and the physical model calculation device 70 are installed in the target building 10, the network 90 may be a wired or wireless LAN, etc. Furthermore, the air conditioning load learning apparatus 110, the air conditioning load prediction apparatus 120, and the physical model calculation device 70 may be implemented as a single device, and in this case, the network 90 is an electronic circuit, etc. Moreover, the functions of the physical model calculation device 70 may be implemented as functional blocks of the air conditioning load learning apparatus 110 and the air conditioning load prediction apparatus 120.

(2) Detailed Configuration (2-1) Air Conditioning System

The air conditioning system 30 forms a vapor compression refrigeration cycle to air-condition the target space 11. According to the present embodiment, the air conditioning system 30 is a multi-air conditioning system for buildings. However, the air conditioning system 30 is not limited thereto, and the air conditioning system 30 may be of any type.

Figure 2:
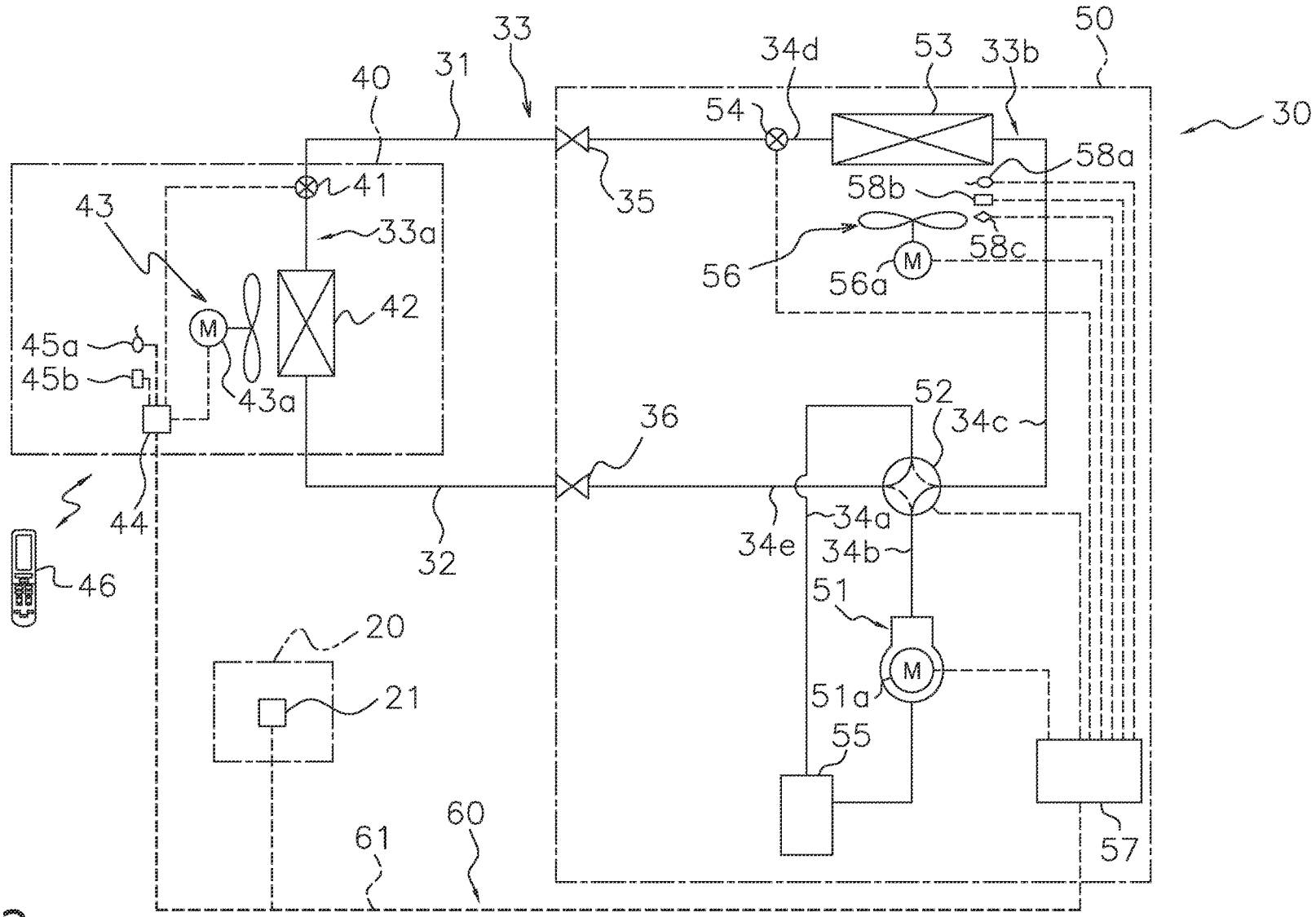
FIG. 2 is a schematic configuration diagram of an air conditioning system according to the first embodiment.

FIG. 2 is a schematic configuration diagram of the air conditioning system 30. As illustrated in FIGS. 1 and 2, the air conditioning system 30 primarily includes an indoor unit 40, an outdoor unit 50, a total heat exchanger 20, and a control unit 60. Although the one indoor unit 40, the one outdoor unit 50, and the one total heat exchanger 20 are illustrated in FIG. 2, this is not a limitation, and the air conditioning system 30 may include a plurality of the indoor units 40, a plurality of the outdoor units 50, and a plurality of the total heat exchangers 20. In particular, according to the present embodiment, the air conditioning system 30 includes the plurality of indoor units 40, and the second and subsequent indoor units 40 are not illustrated in FIG. 2.

The indoor unit 40 and the outdoor unit 50 are coupled via a liquid refrigerant connection pipe 31 and a gas refrigerant connection pipe 32 to form a refrigerant circuit 33. The refrigerant circuit 33 includes an indoor expansion valve 41 and an indoor heat exchanger 42 of the indoor unit 40. Furthermore, the refrigerant circuit 33 includes a compressor 51, a flow direction switching mechanism 52, an outdoor heat exchanger 53, and an outdoor expansion valve 54 of the outdoor unit 50.

The air conditioning system 30 has, as primary operating modes for the air conditioning operation, a cooling operating mode for performing a cooling operation and a heating operating mode for performing a heating operation. The cooling operation is an operation for causing the outdoor heat exchanger 53 to function as a condenser of the refrigerant and causing the indoor heat exchanger 42 to function as an evaporator of the refrigerant to cool the air in the target space 11 where the indoor unit 40 is installed. The heating operation is an operation for causing the outdoor heat exchanger 53 to function as an evaporator of the refrigerant and causing the indoor heat exchanger 42 to function as a condenser of the refrigerant to heat the air in the target space 11 where the indoor unit 40 is installed.

(2-1-1) Indoor Unit

The indoor unit 40 is a unit installed in the target space 11. For example, the indoor unit 40 is a ceiling-embedded unit. As illustrated in FIG. 2, the indoor unit 40 is coupled to the outdoor unit 50 via the liquid refrigerant connection pipe 31 and the gas refrigerant connection pipe 32. The indoor unit 40 includes an indoor-side refrigerant circuit 33*a* forming part of the refrigerant circuit 33.

The indoor unit 40 primarily includes the indoor expansion valve 41, the indoor heat exchanger 42, an indoor fan 43, various sensors, and an indoor control unit 44. Various sensors included in the indoor unit 40 will be described below.

(2-1-1-1) Indoor Expansion Valve

The indoor expansion valve 41 is a mechanism that adjusts the pressure and the flow rate of the refrigerant flowing through the indoor-side refrigerant circuit 33*a*. The indoor expansion valve 41 is provided in a refrigerant pipe that couples the liquid side of the indoor heat exchanger 42 and the liquid refrigerant connection pipe 31. The indoor expansion valve 41 is, for example, an electronic expansion valve whose opening degree is adjustable.

(2-1-1-2) Indoor Heat Exchanger

In the indoor heat exchanger 42, heat is exchanged between the refrigerant flowing through the indoor heat exchanger 42 and the air in the target space 11. The indoor heat exchanger 42 is, for example, a fin-and-tube heat exchanger including a plurality of heat transfer tubes and fins.

One end of the indoor heat exchanger 42 is coupled to the liquid refrigerant connection pipe 31 via a refrigerant pipe.

The other end of the indoor heat exchanger 42 is coupled to the gas refrigerant connection pipe 32 via a refrigerant pipe. During the cooling operation, the refrigerant flows into the indoor heat exchanger 42 from the liquid refrigerant connection pipe 31 side, and the indoor heat exchanger 42 functions as an evaporator of the refrigerant. During the heating operation, the refrigerant flows into the indoor heat exchanger 42 from the gas refrigerant connection pipe 32 side, and the indoor heat exchanger 42 functions as a condenser of the refrigerant.

(2-1-1-3) Indoor Fan

The indoor fan 43 is a fan that supplies the air to the indoor heat exchanger 42. The indoor fan 43 is, for example, a cross-flow fan. The indoor fan 43 is driven by an indoor fan motor 43*a*. The number of revolutions of the indoor fan motor 43*a* can be controlled by an inverter.

(2-1-1-4) Sensor

As illustrated in FIG. 2, the indoor unit 40 includes an indoor temperature sensor 45*a* and an indoor humidity sensor 45*b*.

The indoor temperature sensor 45*a* is provided on an air intake side of a casing (not illustrated) of the indoor unit 40. The indoor temperature sensor 45*a* detects the temperature of the air in the target space 11 that flows into the casing of the indoor unit 40 (the suction temperature of the indoor unit 40).

The indoor humidity sensor 45*b* is provided on the air intake side of the casing (not illustrated) of the indoor unit 40. The indoor humidity sensor 45*b* detects the humidity of the air in the target space 11 that flows into the casing of the indoor unit 40. According to the present embodiment, the indoor humidity sensor 45*h* detects a relative humidity. However, this is not a limitation, and the indoor humidity sensor 45*b* may detect an absolute humidity.

(2-1-1-5) Indoor Control Unit

The indoor control unit 44 controls the operation of each unit included in the indoor unit 40. The indoor control unit 44 includes a control arithmetic device and a storage device. A processor such as a CPU or a GPU may be used as the control arithmetic device. The control arithmetic device reads a program stored in the storage device and performs predetermined arithmetic processing in accordance with the program. Further, the control arithmetic device can write an arithmetic result in the storage device and read information stored in the storage device in accordance with the program. Furthermore, the indoor control unit 44 includes a timer. According to the present embodiment, the timer is installed in the indoor control unit 44, but may be installed in an outdoor control unit 57 described below.

As illustrated in FIG. 2, the indoor control unit 44 is electrically connected to the indoor expansion valve 41, the indoor fan 43, the indoor temperature sensor 45*a*, and the indoor humidity sensor 45*b* to enable exchange of control signals and information.

The indoor control unit 44 is configured to enable reception of various signals transmitted from a remote controller 46 to operate the indoor unit 40. The various signals transmitted from the remote controller 46 include signals for giving instructions to operate or stop the indoor unit 40 and signals regarding various settings. The signals regarding various settings include, for example, switching signals for the operating modes and signals regarding a setting temperature or a setting humidity for the cooling operation and the heating operation.

The indoor control unit 44 is coupled to the outdoor control unit 57 of the outdoor unit 50 and a total heat exchange control unit 21 of the total heat exchanger 20 via a transmission line 61 in a state where control signals, and the like, can be exchanged. Further, instead of being coupled via the physical transmission line 61, the indoor control unit 44, the outdoor control unit 57, and the total heat exchange control unit 21 may be coupled wirelessly to enable communications. The indoor control unit 44, the outdoor control unit 57, and the total heat exchange control unit 21 cooperate with each other to function as the control unit 60 that controls the overall operation of the air conditioning system 30. The control unit 60 will be described below.

(2-1-2) Outdoor Unit

The outdoor unit 50 is installed outside the target space 11. The outdoor unit 50 is installed, for example, on a roof floor of the target building 10, in which the air conditioning system 30 is provided, or is installed adjacent to the target building 10. As illustrated in FIG. 2, the outdoor unit 50 is coupled to the indoor units 40 via the liquid refrigerant connection pipe 31 and the gas refrigerant connection pipe 32. The outdoor unit 50 includes an outdoor-side refrigerant circuit 33*b* forming part of the refrigerant circuit 33.

The outdoor unit 50 primarily includes the compressor 51, the flow direction switching mechanism 52, the outdoor heat exchanger 53, the outdoor expansion valve 54, an accumulator 55, an outdoor fan 56, various sensors, and the outdoor control unit 57. Various sensors included in the outdoor unit 50 will be described below.

Further, the outdoor unit 50 includes an intake pipe 34*a*, a discharge pipe 34*b*, a first gas refrigerant pipe 34*c*, a liquid refrigerant pipe 34*d*, a second gas refrigerant pipe 34*e*, a liquid-side shutoff valve 35, and a gas-side shutoff valve 36. The intake pipe 34*a* couples the flow direction switching mechanism 52 and an intake side of the compressor 51. The intake pipe 34*a* is provided with the accumulator 55. The discharge pipe 34*b* couples a discharge side of the compressor 51 and the flow direction switching mechanism 52. The first gas refrigerant pipe 34*c* couples the flow direction switching mechanism 52 and a gas side of the outdoor heat exchanger 53. The liquid refrigerant pipe 34*d* couples a liquid side of the outdoor heat exchanger 53 and the liquid refrigerant connection pipe 31. The liquid refrigerant pipe 34*d* is provided with the outdoor expansion valve 54. The liquid-side shutoff valve 35 is provided in a coupling portion between the liquid refrigerant pipe 34*d* and the liquid refrigerant connection pipe 31. The second gas refrigerant pipe 34*e* couples the flow direction switching mechanism 52 and the gas refrigerant connection pipe 32. The gas-side shutoff valve 36 is provided in a coupling portion between the second gas refrigerant pipe 34*e* and the gas refrigerant connection pipe 32.

(2-1-2-1) Compressor

As illustrated in FIG. 2, the compressor 51 is a device that takes in the low-pressure refrigerant in the refrigeration cycle from the intake pipe 34*a*, compresses the refrigerant with a compression mechanism (not illustrated), and discharges the compressed refrigerant to the discharge pipe 34*b*.

The compressor 51 is, for example, a rotary type or scroll type volume compressor. The compression mechanism of the compressor 51 is driven by a compressor motor 51*a*. When the compression mechanism is driven by the compressor motor 51*a*, the refrigerant is compressed by the compression mechanism. The compressor motor 51*a* is a motor whose number of revolutions can be controlled by an inverter. By controlling the number of revolutions of the compressor motor 51*a*, the volume of the compressor 51 is controlled.

(2-1-2-2) Flow Direction Switching Mechanism

The flow direction switching mechanism 52 is a mechanism that switches the flow direction of the refrigerant to change the state of the refrigerant circuit 33 between a first state and a second state.

When the refrigerant circuit 33 is in the first state, the outdoor heat exchanger 53 functions as a condenser of the refrigerant, and the indoor heat exchanger 42 functions as an evaporator of the refrigerant. The flow direction switching mechanism 52 sets the state of the refrigerant circuit 33 to the first state during the cooling operation. In other words, during the cooling operation, the flow direction switching mechanism 52 causes the intake pipe 34*a* to communicate with the second gas refrigerant pipe 34*e* and causes the discharge pipe 34*b* to communicate with the first gas refrigerant pipe 34*c* as indicated in the solid lines in the flow direction switching mechanism 52 in FIG. 2.

When the refrigerant circuit 33 is in the second state, the outdoor heat exchanger 53 functions as an evaporator of the refrigerant, and the indoor heat exchanger 42 functions as a condenser of the refrigerant. The flow direction switching mechanism 52 sets the state of the refrigerant circuit 33 to the second state during the heating operation. In other words, during the heating operation, the flow direction switching mechanism 52 causes the intake pipe 34*a* to communicate with the first gas refrigerant pipe 34*c* and causes the discharge pipe 34*b* to communicate with the second gas refrigerant pipe 34*e* as indicated in the broken lines in the flow direction switching mechanism 52 in FIG. 2.

According to the present embodiment, the flow direction switching mechanism 52 is a four-way switching valve.

(2-1-2-3) Outdoor Heat Exchanger

In the outdoor heat exchanger 53, heat is exchanged between the refrigerant flowing inside the outdoor heat exchanger 53 and the air in the outdoor area where the outdoor unit 50 is installed. The outdoor heat exchanger 53 is, for example, a fin-and-tube heat exchanger including a plurality of heat transfer tubes and fins.

One end of the outdoor heat exchanger 53 is coupled to the liquid refrigerant pipe 34*d*. The other end of the outdoor heat exchanger 53 is coupled to the first gas refrigerant pipe 34*c*.

The outdoor heat exchanger 53 functions as a condenser of the refrigerant during the cooling operation and functions as an evaporator of the refrigerant during the heating operation.

(2-1-2-4) Outdoor Expansion Valve

The outdoor expansion valve 54 is a mechanism that adjusts the pressure and the flow rate of the refrigerant flowing through the liquid refrigerant pipe 34*d*. As illustrated in FIG. 2, the outdoor expansion valve 54 is provided in the liquid refrigerant pipe 34*d*. The outdoor expansion valve 54 is, for example, an electronic expansion valve whose opening degree is adjustable.

(2-1-2-5) Accumulator

The accumulator 55 has a gas-liquid separation function to separate the flowing refrigerant into a gas refrigerant and a liquid refrigerant. Furthermore, the accumulator 55 is a container that has the function to store an excess refrigerant generated in accordance with fluctuations in the operation load of the indoor unit 40, etc. As illustrated in FIG. 2, the accumulator 55 is provided in the intake pipe 34*a*. The refrigerant flowing into the accumulator 55 is separated into a gas refrigerant and a liquid refrigerant, and the gas refrigerant collected in an upper space flows into the compressor 51.

(2-1-2-6) Outdoor Fan

The outdoor fan 56 is a fan that supplies air to the outdoor heat exchanger 53. Specifically, the outdoor fan 56 is a fan that takes in the heat source air outside the outdoor unit 50 into the casing (not illustrated) of the outdoor unit 50, supplies the heat source air to the outdoor heat exchanger 53, and discharges the air, which has exchanged heat with the refrigerant in the outdoor heat exchanger 53, to the outside of the casing of the outdoor unit 50. The outdoor fan 56 is, for example, a propeller fan. The outdoor fan 56 is driven by an outdoor fan motor 56*a*. The number of revolutions of the outdoor fan motor 56*a* can be controlled by an inverter.

(2-1-2-7) Sensor

As illustrated in FIG. 2, the outdoor unit 50 includes an outdoor temperature sensor 58*a*, an outdoor humidity sensor 58*b*, and an outdoor solar radiation sensor 58*c*.

The outdoor temperature sensor 58*a* measures the temperature of the air in the outdoor area where the outdoor unit 50 is installed.

The outdoor humidity sensor 58*b* measures the humidity of the air in the outdoor area where the outdoor unit 50 is installed. According to the present embodiment, the outdoor humidity sensor 58*b* detects the relative humidity. However, this is not a limitation, and the outdoor humidity sensor 58*b* may detect the absolute humidity.

The outdoor solar radiation sensor 58*c* measures the solar radiation in the outdoor area where the outdoor unit 50 is installed.

Furthermore, these sensors are some of the sensors, and the outdoor unit 50 also includes sensors that measure the refrigerant temperature, the refrigerant pressure, etc.

(2-1-2-8) Outdoor Control Unit

The outdoor control unit 57 controls the operation of each unit included in the outdoor unit 50. The outdoor control unit 57 includes a control arithmetic device and a storage device. A processor such as a CPU or a GPU may be used as the control arithmetic device. The control arithmetic device reads a program stored in the storage device and performs predetermined arithmetic processing in accordance with the program. Further, the control arithmetic device can write an arithmetic result in the storage device and read information stored in the storage device in accordance with the program.

As illustrated in FIG. 2, the outdoor control unit 57 is electrically connected to the compressor 51, the flow direction switching mechanism 52, the outdoor expansion valve 54, the outdoor fan 56, the outdoor temperature sensor 58*a*, the outdoor humidity sensor 58*b*, and the outdoor solar radiation sensor 58*c* to enable exchange of control signals and information.

The outdoor control unit 57 is coupled to the indoor control unit 44 of the indoor unit 40 and the total heat exchange control unit 21 of the total heat exchanger 20 via the transmission line 61 in a state where control signals, and the like, can be exchanged. The outdoor control unit 57, the indoor control unit 44, and the total heat exchange control unit 21 cooperate with each other to function as the control unit 60 that controls the overall operation of the air conditioning system 30. The control unit 60 will be described below.

(2-1-3) Total Heat Exchanger

The total heat exchanger 20 is a unit installed in the target space 11. For example, the total heat exchanger 20 is a ceiling-embedded unit. The total heat exchanger 20 performs total heat exchange operation. The total heat exchange refers to the exchange of sensible heat and the exchange of latent heat. The total heat exchange operation is an operation to perform total heat exchange between the exhaust air discharged from the target space 11 to outside the room and the intake air taken into the target space 11 as fresh air from outside the room.

The total heat exchanger 20 includes the total heat exchange control unit 21. The total heat exchange control unit 21 controls the operation of each unit included in the total heat exchanger 20. The total heat exchange control unit 21 includes a control arithmetic device and a storage device. A processor such as a CPU or a GPU may be used as the control arithmetic device. The control arithmetic device reads a program stored in the storage device and performs predetermined arithmetic processing in accordance with the program. Further, the control arithmetic device can write an arithmetic result in the storage device and read information stored in the storage device in accordance with the program.

The total heat exchange control unit 21 is configured to enable reception of various signals transmitted from the remote controller 46 to operate the total heat exchanger 20. The various signals transmitted from the remote controller 46 include signals for giving instructions to operate or stop the total heat exchanger 20 and signals regarding various settings.

(2-1-4) Control Unit

As illustrated in FIG. 2, the control unit 60 is configured by communicatively coupling the indoor control unit 44 of the indoor unit 40, the outdoor control unit 57 of the outdoor unit 50, and the total heat exchange control unit 21 of the total heat exchanger 20 via the transmission line 61. The control unit 60 controls the overall operation of the air conditioning system 30 when the control arithmetic devices of the indoor control unit 44, the outdoor control unit 57, and the total heat exchange control unit 21 execute programs stored in the storage devices.

As illustrated in FIG. 2, the control unit 60 is electrically connected to the indoor expansion valve 41, the indoor fan 43, the indoor temperature sensor 45*a*, and the indoor humidity sensor 45*b* of the indoor unit 40. Furthermore, the control unit 60 is electrically connected to the compressor 51, the flow direction switching mechanism 52, the outdoor expansion valve 54, the outdoor fan 56, the outdoor temperature sensor 58*a*, the outdoor humidity sensor 58*b*, and the outdoor solar radiation sensors 58*c* of the outdoor unit 50.

The control unit 60 controls the operation and stoppage of the air conditioning system 30 and the operations of various devices of the air conditioning system 30 based on measurement signals of the various sensors 45*a*, 45*b*, 58*a*, 58*b*, 58*c*, and the like, commands received by the indoor control unit 44 and the total heat exchange control unit 21 from the remote controller 46, etc.

Furthermore, the control unit 60 acquires information (air conditioning information 37) about the air conditioning system 30 from the air conditioning system 30 at predetermined time intervals and transmits the information to the air conditioning database 80. According to the present embodiment, the predetermined time interval is per unit time. For the verification described below, the unit time is set to one hour. The air conditioning database 80 stores the transmitted air conditioning information 37.

Figure 3:
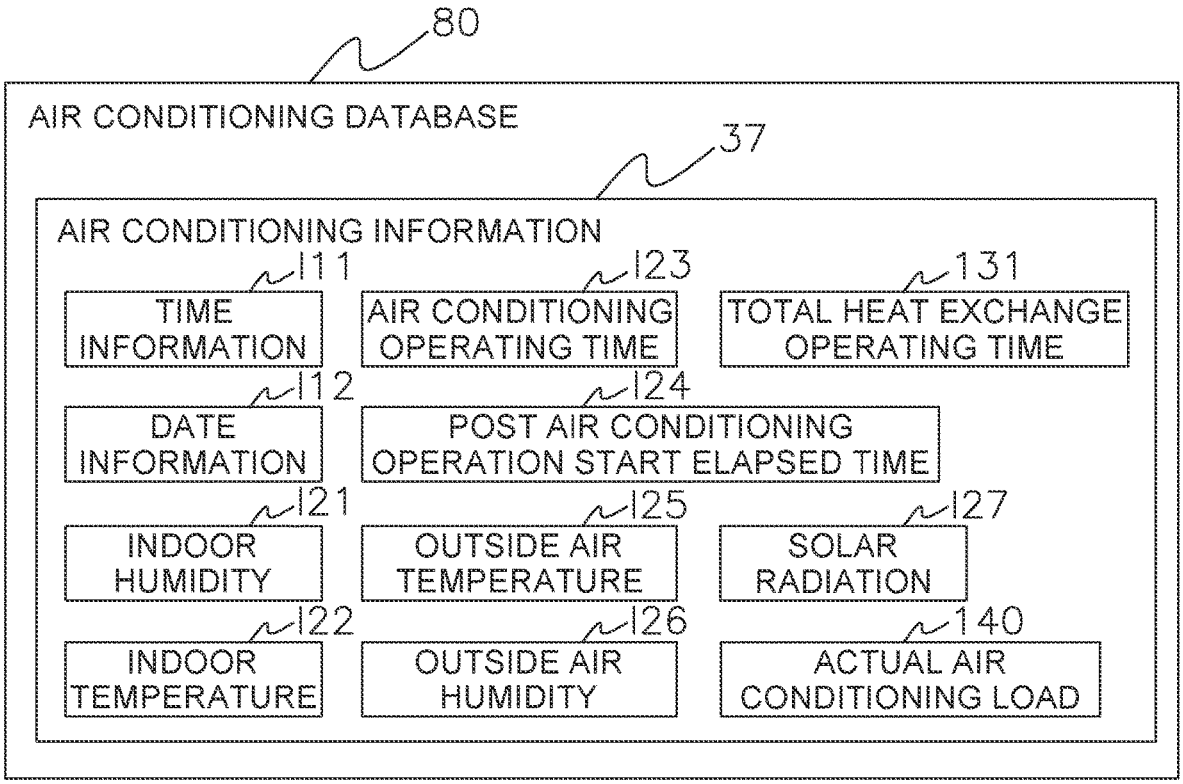
FIG. 3 is a configuration diagram of an air conditioning database according to the first embodiment.

FIG. 3 is a configuration diagram of the air conditioning database 80. As illustrated in FIGS. 1 and 3, the air conditioning information 37 includes time information I11, date information I12, an indoor humidity I21, an indoor temperature I22, an air conditioning operating time I23, a post air conditioning operation start elapsed time I24, an outside air temperature I25, an outside air humidity I26, solar radiation I27, an actual air conditioning load 140, and a total heat exchange operating time 131. The air conditioning information 37 is not limited to these pieces of information, and may include measurement information of other sensors, etc.

The time information I11 and the date information I12 are the time and date when the control unit 60 acquires the air conditioning information 37. The time information I11 is, for example, a 6-digit numerical value indicating a time, such as 18 (hour) 00 (minute) 00 (second). The date information I12 is, for example, an 8-digit numerical value indicating a date, such as 2018 (year) 01 (month) 01 (day).

The indoor humidity I21 is a measurement value of the indoor humidity sensor 45*b* when the control unit 60 acquires the air conditioning information 37.

The indoor temperature I22 is a measurement value of the indoor temperature sensor 45*a* when the control unit 60 acquires the air conditioning information 37.

The air conditioning operating time I23 is a time during which the air conditioning operation is performed. In other words, the air conditioning operating time I23 is a time in a state where the indoor unit 40 is on in the remote controller 46. According to the present embodiment, the air conditioning operating time I23 is a time during which the air conditioning operation is performed in a unit time from the previous acquisition of the air conditioning information 37 by the control unit 60. The time up to a unit time is stored as the air conditioning operating time I23.

The post air conditioning operation start elapsed time 124 is a cumulative operating time (e.g., up to three hours) from the start of the most recent air conditioning operation after the stoppage of the air conditioning operation for a long time (e.g., five hours or more) at the time when the control unit 60 acquires the air conditioning information 37. When the air conditioning operation has stopped when the control unit 60 acquires the air conditioning information 37, 0 is stored as the post air conditioning operation start elapsed time I24. Even when the air conditioning operation has started, 0 is stored as the post air conditioning operation start elapsed time I24 in a case where the operation does not correspond to the operation after the stoppage of the air conditioning operation for a long time or in a case where the cumulative operating time from the start of the air conditioning operation is more than a predetermined time (e.g., three hours described above). When the air conditioning operation has started, the operation corresponds to the operation after the stoppage of the air conditioning operation for a long time, and the cumulative operating time from the start of the air conditioning operation falls within a predetermined time (e.g., three hours described above), the time from the start of the most recent air conditioning operation to the time when the control unit 60 acquires the air conditioning information 37 is stored as the post air conditioning operation start elapsed time I24.

The outside air temperature I25 is a measurement value of the outdoor temperature sensor 58*a* when the control unit 60 acquires the air conditioning information 37.

The outside air humidity I26 is a measurement value of the outdoor humidity sensor 58*b* when the control unit 60 acquires the air conditioning information 37.

The solar radiation I27 is a measurement value of the outdoor solar radiation sensor 58*c* when the control unit 60 acquires the air conditioning information 37.

The actual air conditioning load 140 is an actual air conditioning load processed by the air conditioning system 30 in the target space 11 inside the target building 10. According to the present embodiment, the actual air conditioning load 140 is an air conditioning capacity actual measurement value of the outdoor unit 50. The air conditioning capacity actual measurement value of the outdoor unit 50 is calculated using a compressor curve method (CC method) based on the actual measurement value of an internal sensor of the outdoor unit 50. The CC method is a method for calculating a supply capacity by using a refrigerant enthalpy difference obtained from sensor information (refrigerant temperature, refrigerant pressure, etc.) inside the multi-air conditioning system for buildings and a refrigerant circulation amount obtained from the number of revolutions of the compressor motor 51*a* using a compressor property curve. As the cooling load actual measurement value included in the actual air conditioning load 140, a cooling capacity actual measurement value of the outdoor unit 50 is used as it is. As the heating load actual measurement value included in the actual air conditioning load 140, the value is used, which is obtained by removing heat loss due to the liquid refrigerant connection pipe 31 and the gas refrigerant connection pipe 32 between the outdoor unit 50 and the indoor unit 40 from the heating capacity actual measurement value of the outdoor unit 50. The cooling load actual measurement value and the heating load actual measurement value are calculated for each system of the outdoor unit 50.

The total heat exchange operating time 131 is a time during which the total heat exchange operation is performed. In other words, the total heat exchange operating time 131 is a time in a state where the total heat exchanger 20 is on in the remote controller 46. According to the present embodiment, the total heat exchange operating time 131 is a time during which the total heat exchange operation is performed in a unit time from the previous acquisition of the air conditioning information 37 by the control unit 60. The time up to a unit time is stored as the total heat exchange operating time 131.

(2-2) Physical Model Calculation Device

The physical model calculation device 70 includes a control arithmetic device and a storage device. A processor such as a CPU or a GPU may be used as the control arithmetic device. The control arithmetic device reads a program stored in the storage device and performs predetermined image processing and arithmetic processing in accordance with the program. Further, the control arithmetic device can write an arithmetic result in the storage device and read information stored in the storage device in accordance with the program.

Figure 4:
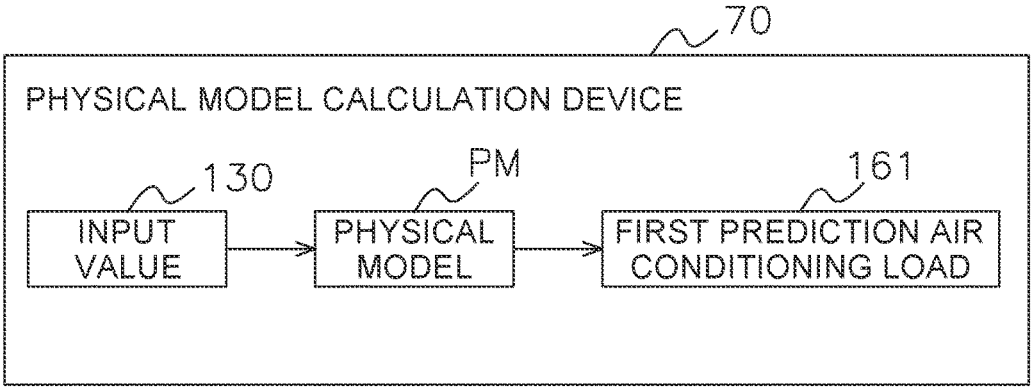
FIG. 4 is a configuration diagram of a physical model calculation process according to the first embodiment.

The physical model calculation device 70 calculates the thermal load of the target building 10 based on the physical model PM. FIG, 4 is a configuration diagram of a physical model calculation process. As illustrated in FIG. 4, the physical model calculation device 70 inputs an input value 130 to the physical model PM to calculate a first prediction air conditioning load 161. The first prediction air conditioning load 161 is a predicted air conditioning load in the target space 11.

The input value 130 includes at least a thermal property of the target building 10. The thermal property of the target building 10 is, for example, thermal insulation property, heat capacity, building shape, solar radiation shielding performance, amount of ventilation of the target building 10, the thermal property of building materials used for obtaining them, Q value, etc. The content of the input value 130 depends on the physical model PM and dynamic thermal load calculation software. In addition to the thermal property of the target building 10, the input value 130 may include, for example, outside air condition, solar radiation condition, indoor condition (e.g., indoor temperature and indoor humidity), condition of air conditioning or outside air introduction (e.g., air conditioning, on/off or ventilation introduction on/off), and information about internal heat generation, etc.

The physical model PM may be a model including a simple heat balance equation or may be a model included in existing dynamic thermal load calculation software.

Examples of the model including a simple heat balance equation include the following Equation 1.

$$Q_{solar}+Q_{skin}+Q_{buil}+Q_{air}+Q_{outair}+I_g=\Phi_{HVAC} \quad \text{Math 1}$$

Here, $Q_{solar}$ is a solar radiation load from a window, $Q_{outair}$ is a through-flow thermal load from a wall, $Q_{buil}$ is heat storage of indoor thermal mass, $Q_{air}$ is heat storage of air, $Q_{solar}$ is a ventilation load, $I_g$ is internal heat generation, and $\Phi_{HVAC}$ is an air conditioning load in the target space 11. The linear physical model PM such as Math. 1 makes it possible to inversely calculate the corresponding input value 130 from the air conditioning load in the target space 11. Furthermore, the linear physical model PM such as Math. 1 makes it possible to calculate the difference in the air conditioning load in the target space 11 from the difference in the input value 130 and to inversely calculate the difference in the corresponding input value 130 from the difference in the air conditioning load in the target space 11.

(2-3) Air Conditioning Load Learning Apparatus

Figure 5:
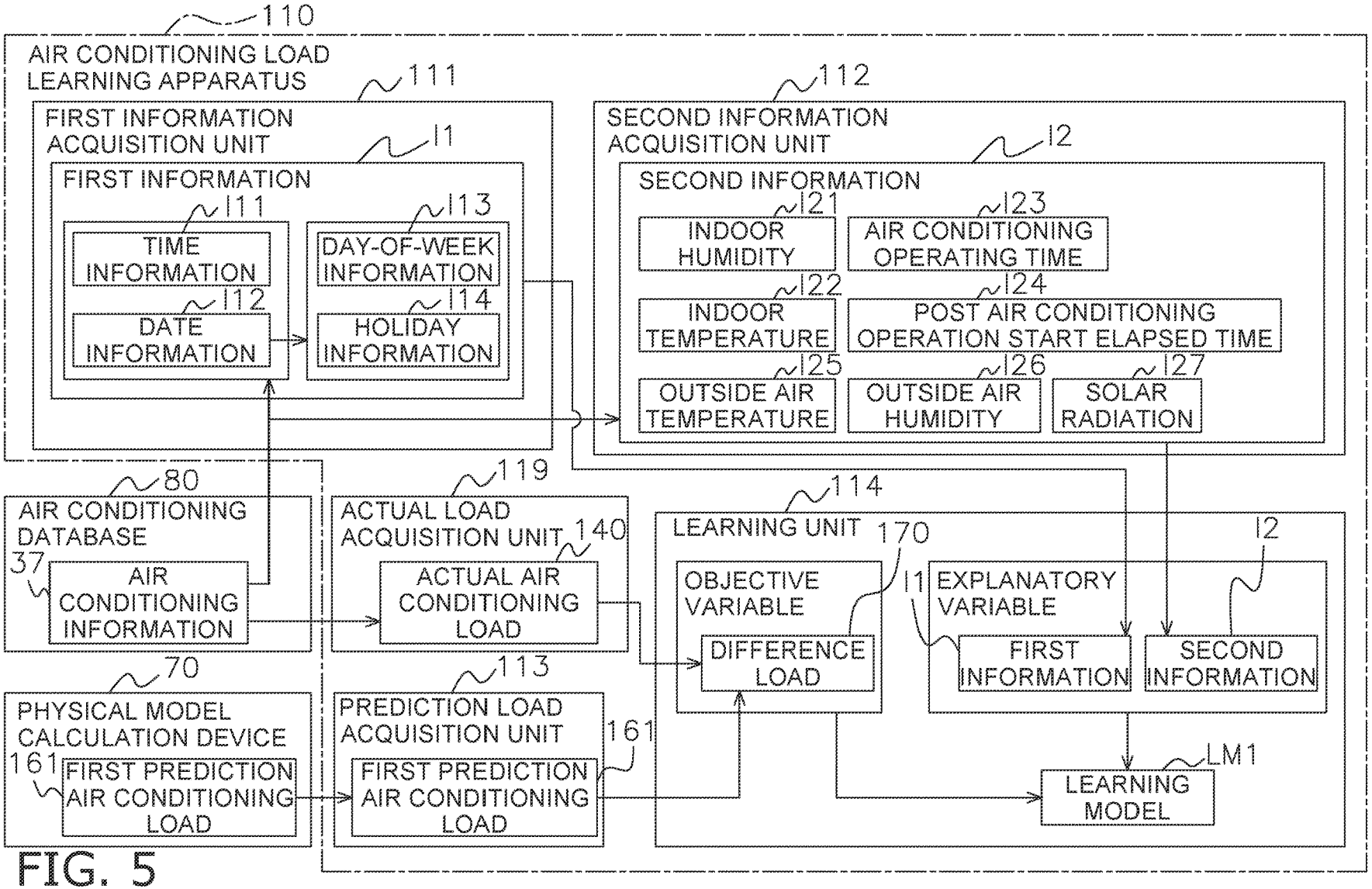
FIG. 5 is a configuration diagram of an air conditioning load learning process according to the first embodiment.

FIG. 5 is a configuration diagram of an air conditioning load learning process. As illustrated in FIGS. 1 and 5, the air conditioning load learning apparatus 110 primarily includes an actual load acquisition unit 119, a prediction load acquisition unit 113, a first information acquisition unit 111, a second information acquisition unit 112, and a learning unit 114.

The air conditioning load learning apparatus 110 includes a control arithmetic device and a storage device. A processor such as a CPU or a GPU may be used as the control arithmetic device. The control arithmetic device reads a program stored in the storage device and performs predetermined image processing and arithmetic processing in accordance with the program. Further, the control arithmetic device can write an arithmetic result in the storage device and read information stored in the storage device in accordance with the program. The actual load acquisition unit 119, the prediction load acquisition unit 113, the first information acquisition unit 111, the second information acquisition unit 112, and the learning unit 114 are various functional blocks implemented by the control arithmetic device and the storage device.

(2-3-1) Actual Load Acquisition Unit

As illustrated in FIG. 5, the actual load acquisition unit 119 acquires the actual air conditioning load 140, which is the actual air conditioning load in the target space 11 inside the target building 10, from the air conditioning information 37 in the air conditioning database 80. According to the present embodiment, the actual air conditioning load 140 is an air conditioning load per unit time.

(2-3-2) Prediction Load Acquisition Unit

As illustrated in FIG. 5, the prediction load acquisition unit 113 acquires, from the physical model calculation device 70, the first prediction air conditioning load 161 that is an air conditioning load in the target space 11 predicted by the physical model PM from at least the thermal property of the target building 10.

(2-3-3) First Information Acquisition Unit

As illustrated in FIG. 5, the first information acquisition unit 111 acquires the first information I1. The first information I1 is information about the operation of the target building 10. According to the present embodiment, the first information I1 includes the time information I11, the date information I12, day-of-week information I13, and holiday information I14. The first information I1 may further include information about an operation schedule such as an event.

According to the present embodiment, the time information I11 and the date information I12 are acquired from the air conditioning information 37 in the air conditioning database 80. The day-of-week information I13 and the holiday information I14 are calculated based on the date information I12. The day-of-week information I13 is a numerical value corresponding to the day of week, such as "1" for Monday and "2" for Tuesday. The holiday information I14 is a numerical value, for example, "0" for a day that is not a holiday and "1" for a holiday.

(2-3-4) Second Information Acquisition Unit

As illustrated in FIG. 5, the second information acquisition unit 112 acquires the second information I2. The second information I2 is at least one of the indoor humidity I21, the indoor temperature I22, the air conditioning operating time I23, the post air conditioning operation start elapsed time I24, the outside air temperature I25, the outside air humidity I26, and the solar radiation I27. FIG. 5 illustrates all of these pieces of information.

According to the present embodiment, the second information I2 is acquired from the air conditioning information 37 in the air conditioning database 80.

(2-3-5) Learning Unit

As illustrated in FIG. 5, the learning unit 114 generates the learning model LM1 using the first information I1 and the second information I2 as explanatory variables and using a difference load 170, which is the difference between the actual air conditioning load 140 and the first prediction air conditioning load 161, as an objective variable.

The period (learning data period) of data used for the air conditioning load learning process of the air conditioning load learning apparatus 110 may be shorter than the period (prediction data period) of data used for the air conditioning load prediction process of the air conditioning load prediction apparatus 120. Specifically, the learning model LM1 may be generated based on the first information I1, the second information I2, the actual air conditioning load 140, and the first prediction air conditioning load 161 in a period shorter than the prediction data period.

According to the present embodiment, the learning model LM1 is a regression-type multilayer perceptron. However, the learning model LM1 is not limited thereto, and the learning model LM1 may be any regression model. The regression-type multilayer perceptron will be described in the verification below.

(2-4) Air Conditioning Load Prediction Apparatus

Figure 6:
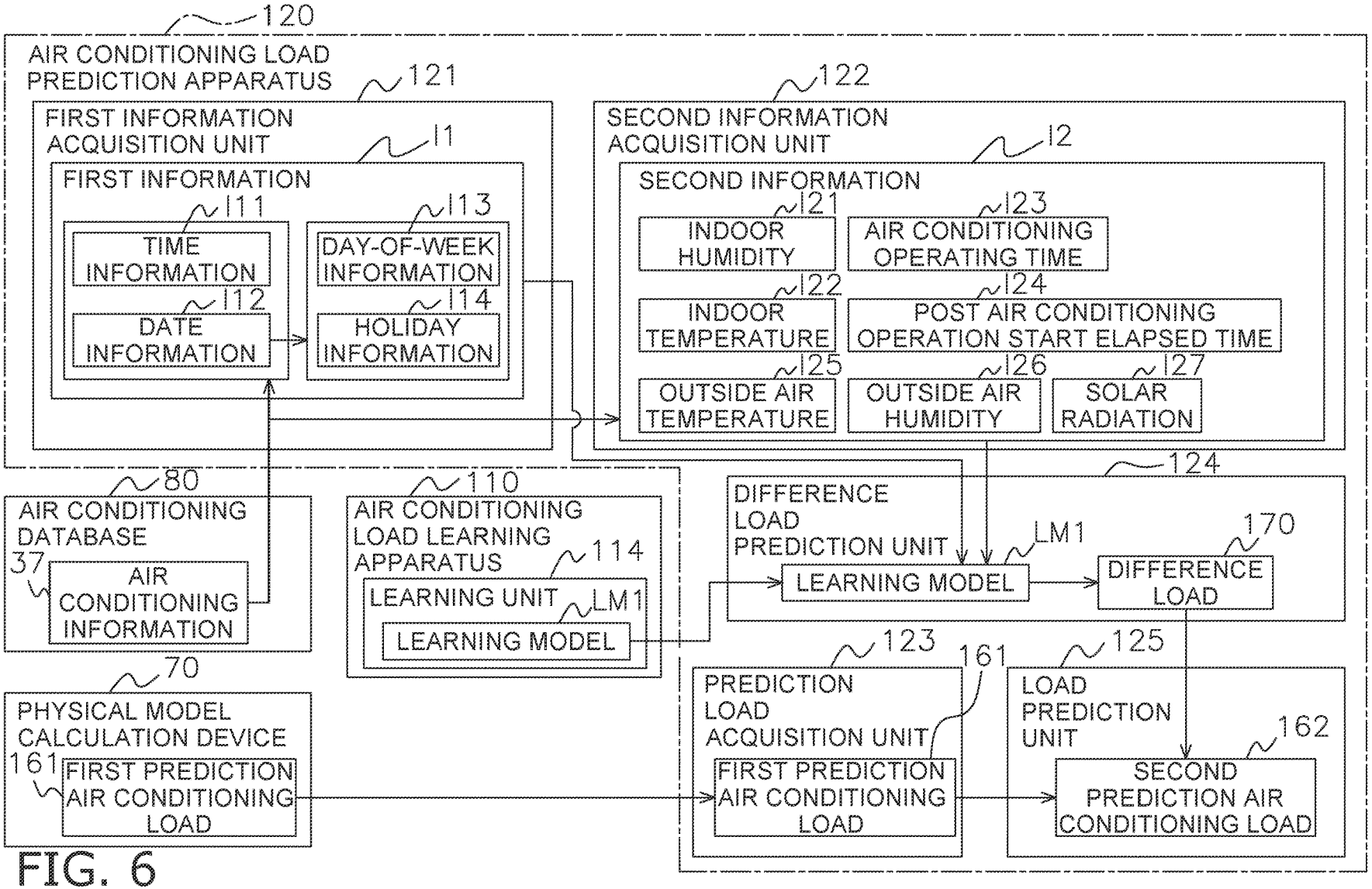
FIG. 6 is a configuration diagram of an air conditioning load prediction process according to the first embodiment.

FIG. 6 is a configuration diagram of an air conditioning load prediction process. As illustrated in FIGS. 1 and 6, the air conditioning load prediction apparatus 120 primarily includes a prediction load acquisition unit 123, a first information acquisition unit 121, a second information acquisition unit 122, a difference load prediction unit 124, and a load prediction unit 125.

The air conditioning load prediction apparatus 120 includes a control arithmetic device and a storage device. A processor such as a CPU or a GPU may be used as the control arithmetic device. The control arithmetic device reads a program stored in the storage device and performs predetermined image processing and arithmetic processing in accordance with the program. Further, the control arithmetic device can write an arithmetic result in the storage device and read information stored in the storage device in accordance with the program. The prediction load acquisition unit 123, the first information acquisition unit 121, the second information acquisition unit 122, the difference load prediction unit 124, and the load prediction unit 125 are various functional blocks implemented by the control arithmetic device and the storage device.

(2-4-1) Prediction Load Acquisition Unit

As illustrated in FIG. 6, the prediction load acquisition unit 123 acquires the first prediction air conditioning load 161 in the same manner as the prediction load acquisition unit 113 in the air conditioning load learning apparatus 110.

(2-4-2) First Information Acquisition Unit

As illustrated in FIG. 6, the first information acquisition unit 121 acquires the first information I1 in the same manner as the first information acquisition unit 111 in the air conditioning load learning apparatus 110.

(2-4-3) Second Information Acquisition Unit

As illustrated in FIG. 6, the second information acquisition unit 122 acquires the second information I2 in the same manner as the second information acquisition unit 112 in the air conditioning load learning apparatus 110.

(2-4-4) Difference Load Prediction Unit

As illustrated in FIG. 6, the difference load prediction unit 124 uses the learning model LM1 generated by the learning unit 114 to predict the difference load 170 from the first information I1 and the second information I2.

From the first information I1 and the second information I2 in a period longer than the learning data period, the difference load prediction unit 124 may predict the difference load 170 in the same long period.

(2-4-5) Load Prediction Unit

As illustrated in FIG. 6, the load prediction unit 125 predicts the air conditioning load (a second prediction air conditioning load 162) in the target space 11 based on the predicted difference load 170 and the first prediction air conditioning load 161 (by adding or subtracting the difference load 170 to or from the first prediction air conditioning load 161).

Based on the predicted difference load 170 in the long period and the first prediction air conditioning load 161 in the same long period, the load prediction unit 125 may predict the air conditioning load in the same long period in the target space 11.

(3) Process (3-1) Air Conditioning Load Learning Process

Figure 7:
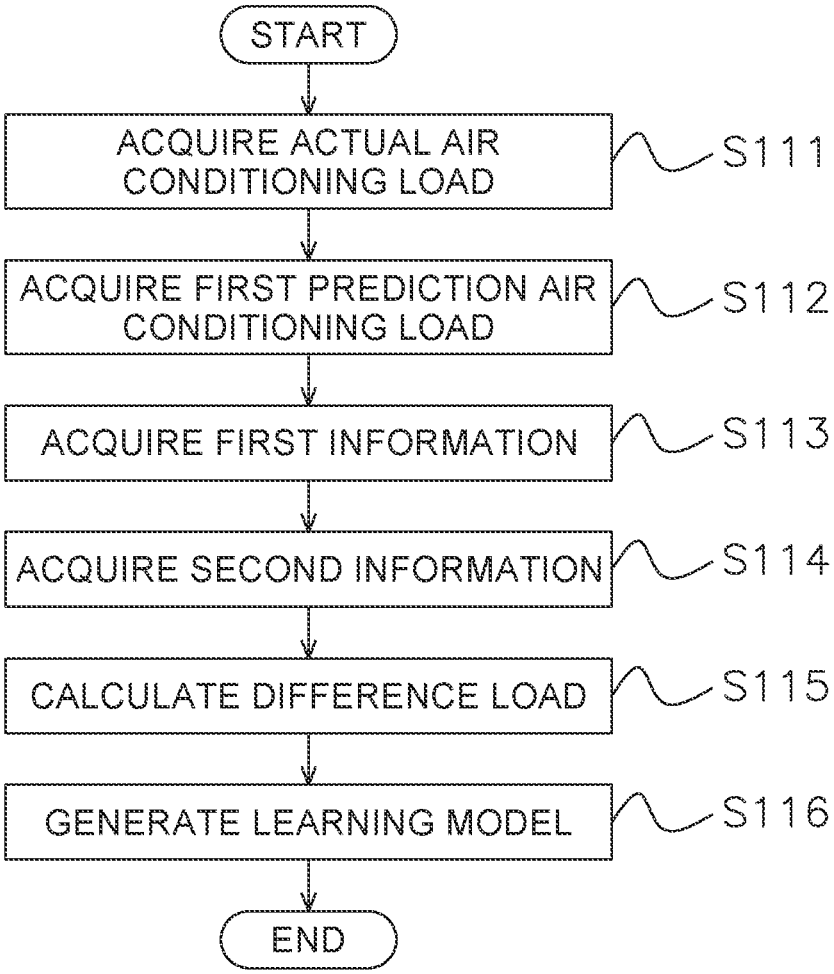
FIG. 7 is a flowchart of the air conditioning load learning process according to the first embodiment.

The air conditioning load learning process will be described using the flowchart of FIG. 7.

As described in Step S111, the air conditioning load learning apparatus 110 acquires the actual air conditioning load 140 from the air conditioning information 37 in the air conditioning database 80.

After acquiring the actual air conditioning load 140, the air conditioning load learning apparatus 110 acquires the first prediction air conditioning load 161 from the physical model calculation device 70 as described in Step S112.

After acquiring the first prediction air conditioning load 161, the air conditioning load learning apparatus 110 acquires the first information I1 from the air conditioning information 37 in the air conditioning database 80 as described in Step S113.

After acquiring the first information I1, the air conditioning load learning apparatus 110 acquires the second information I2 from the air conditioning information 37 in the air conditioning database 80 as described in Step S114.

After acquiring the second information I2, the air conditioning load learning apparatus 110 calculates the difference load 170, which is the difference between the actual air conditioning load 140 and the first prediction air conditioning load 161, as described in Step S115.

After calculating the difference load 170, the air conditioning load learning apparatus 110 generates the learning model LM1 using the first information I1 and the second information I2 as explanatory variables and using the difference load 170 as an objective variable as described in Step S116.

(3-2) Air Conditioning Load Prediction Process

Figure 8:
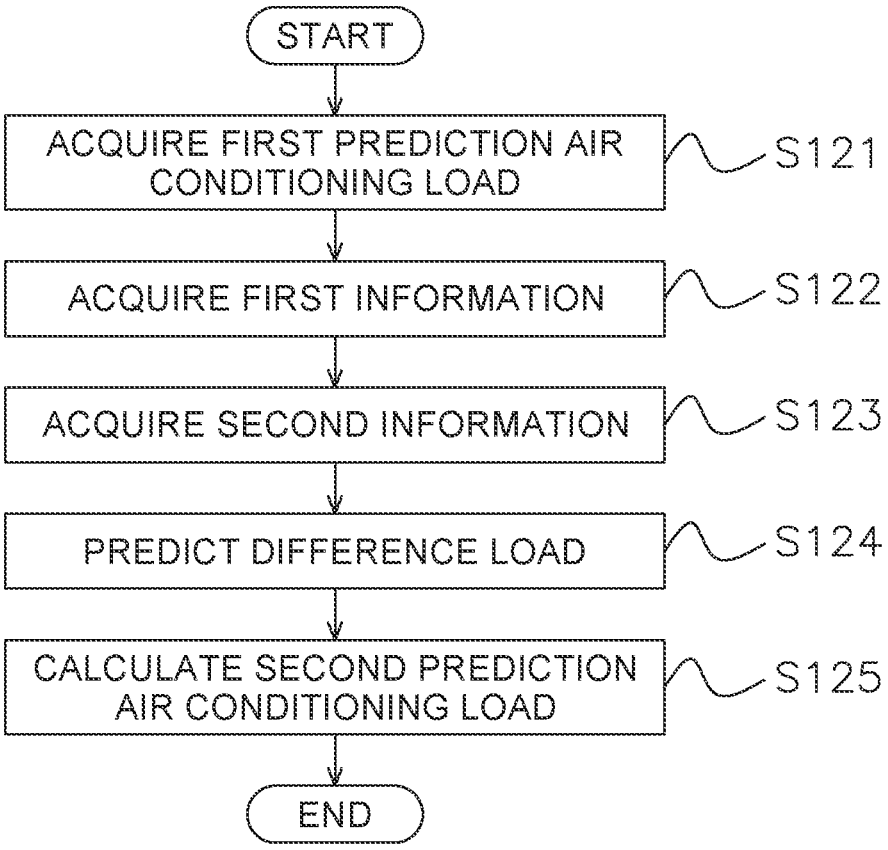
FIG. 8 is a flowchart of the air conditioning load prediction process according to the first embodiment.

The air conditioning load prediction process will be described using the flowchart of FIG. 8.

As described in Step S121, the air conditioning load prediction apparatus 120 acquires the first prediction air conditioning load 161 from the physical model calculation device 70.

After acquiring the first prediction air conditioning load 161, the air conditioning load prediction apparatus 120 acquires the first information I1 from the air conditioning information 37 in the air conditioning database 80 as described in Step S122.

After acquiring the first information I1, the air conditioning load prediction apparatus 120 acquires the second information I2 from the air conditioning information 37 in the air conditioning database 80 as described in Step S123.

After acquiring the second information I2, the air conditioning load prediction apparatus 120 predicts the difference load 170 from the first information I1 and the second information I2 using the learning model LM1 as described in Step S124.

After predicting the difference load 170, the air conditioning load prediction apparatus 120 adds or subtracts the difference load 170 to or from the first prediction air conditioning load 161 to calculate the second prediction air conditioning load 162 as described in Step S125.

(4) Verification of Prediction Accuracy (4-1) Verification Flow

The air conditioning load of the target building 10 is predicted using the air conditioning load learning apparatus 110 and the air conditioning load prediction apparatus 120, and the prediction accuracy is verified.

The learning data period of this verification is the entire period of 2018 and a partial period of 2018. The prediction data period for this verification is the entire period of 2019.

In this verification, first, the air conditioning load learning apparatus 110 generates the learning model LM1 from the first information I1, the second information I2, the actual air conditioning load 140, and the first prediction air conditioning load 161 of 2018. Subsequently, the air conditioning load prediction apparatus 120 inputs the first information I1, and the second information I2 of 2019 to the learning model LM1, from which the difference load 170 of 2019 is output. Further, the first prediction air conditioning load 161 of 2019 is added to the difference load 170 of 2019 to calculate the second prediction air conditioning load 162 of 2019. Finally, the actual air conditioning load 140 of 2019 is compared with the second prediction air conditioning load 162 of 2019 to verify the prediction accuracy.

(4-2) Target Building, Target Space

Table 1 below is an overview of the target building 10 used for this verification.

TABLE 1

| | |
|---|---|
| Location | Tokyo |
| Floor number | 9th floor above the ground |
| Total floor area | Approximately 6,900 <$m^2$> |
| Target space 11 | 2nd to 9th floors: offices (approximately 600 <$m^2$>) |

Figure 9:
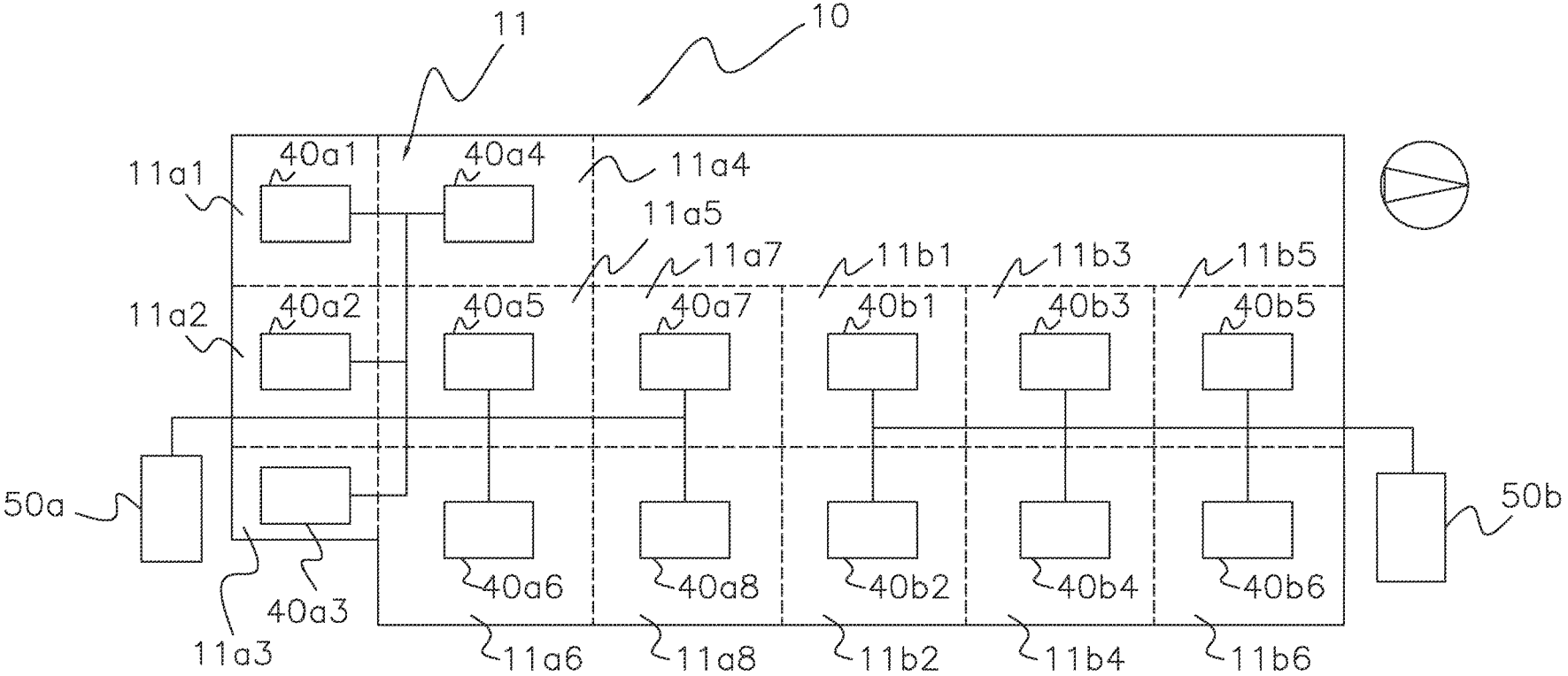
FIG. 9 is a plan view of a target building used for verification according to the first embodiment.

As described in Table 1, the target space 11 of the target building 10 is offices on the second to ninth floors. FIG. 9 is a plan view of the target building 10 used for this verification. As illustrated in FIG. 9, the office on each floor includes 14 zones 11*a*1 to 11*a*8, 11*b*1 to 11*b*6.

(4-3) Air Conditioning System

The air conditioning system 30 for this verification is a multi-air conditioning system for buildings. As illustrated in FIG. 9, the air conditioning system 30 includes two systems of outdoor unit 50*a*, 50*b* per floor. In the zones 11*a*1 to 11*a*8, indoor units 40*a*1 to 40*a*8 are installed as a system of the outdoor unit 50*a*. In the zones 11*b*1 to 11*b*6, indoor units 40*b*1 to 40*b*6 are installed as a system of the outdoor unit 50*b*.

(4-4) Various Types of Data

For this verification, hourly data is used.

(4-4-1) Actual Air Conditioning Load

The actual air conditioning load 140 is acquired from the air conditioning information 37 in the air conditioning database 80. In this verification, as there are two systems of the outdoor units 50 per floor, the sums of the cooling load actual measurement value and the heating load actual measurement value of the two systems are used as the cooling load actual measurement value and the heating load actual measurement value of each floor.

(4-4-2) First Prediction Air Conditioning Load

For this verification, Energyplus is used as dynamic thermal load calculation software for calculating the first prediction air conditioning load 161. Trimble SketchUp is used to model the chamber shape. Table 2 below describes the wall and window structure of the target building 10 for the dynamic thermal load calculation.

TABLE 2

| | Material name | Material thickness <mm> | Thermal conductivity <W/(m · K)> Heat resistance <$m^2$ · K/W> in hollow layer |
|---|---|---|---|
| Outer wall | Tile | 8 | 1.3 |
| | Mortar | 20 | 1.5 |
| | Prestressed concrete | 150 | 1.5 |
| | Styrene foam plate | 25 | 0.037 |
| | Hollow layer in outer wall | — | Thermal resistance: 0.07 |
| | Gypsum board | 12 | 0.17 |
| Inner wall | Gypsum board | 19 | 0.17 |
| | Hollow layer in inner wall | — | Thermal resistance: 0.15 |
| | Gypsum board | 19 | 0.17 |
| Ceiling (floor) | Lightweight concrete | 106 | 0.53 |
| | Hollow layer in ceiling | — | Thermal resistance: 0.18 |
| | Sound absorbing tile | 19 | 0.06 |
| Window | Heat-absorbing glass | 6 | 0.9 |

Table 3 below describes various input conditions to the dynamic thermal load calculation software (the input value 130 to the physical model PM).

TABLE 3

| Item | Content |
|---|---|
| Weather data | Create a weather file for EnergyPlus from Tokyo weather data (AMEDAS) from 2018 to 2019. |
| Chamber shape | Input based on building drawings. |
| Adjacent building conditions | Estimate and input adjacent-building distance and height from Google Maps. |
| Air conditioning on/off | Turn on when the time-by-time indoor unit remote controller ON time <min> is larger than 0. The air conditioning operating time I23 is used as the indoor unit remote controller ON time. |
| Achieved temperature (when air conditioning is on) | Cooling: indoor unit suction temperature<br>Heating: indoor unit suction temperature −2° C. (considering upper and lower temperature differences)<br>The indoor temperature I22 is used as the indoor unit suction temperature. |
| Outside air introduction on/off | Turn on when the time-by-time total heat exchanger remote controller ON time <min> is larger than 0. The total heat exchange operating time I31 is used as the total heat exchanger remote controller ON time. |
| Introduced outside air amount | Input based on catalogue values of the total heat exchanger 20. 375 <$m^3$/h> per indoor unit zone |
| Wall and window structure | Input the content of Table 2. |
| Draft | 0.2 <times/h> |
| Blind open/close | Neutral-colored blind. Always closed. |
| Internal heat generation | Persons: 0.1 <person/$m^2$><br>Illumination: 12 <W/$m^2$><br>Device heat generation: 12 <W/$m^2$> |
| Internal heat generation schedule | Summer and winter: internal heat is generated when air conditioning is on. (The ratio is determined based on energy saving law calculation schedule)<br>Intermediate period: energy-saving law calculation schedule |
| Inter-zone mixing | 150 <$m^3$/(m · h)> |

(4-4-3) Explanatory Variable of Learning Model

Table 4 below describes the explanatory variables of the learning model LM1 for this verification.

TABLE 4

| Explanatory variable | Content |
|---|---|
| Outside air temperature <° C.> | Use the outside air temperature I25 of the second information I2. |
| Solar radiation <MJ/$m^2$> | Use the solar radiation I27 of the second information I2. |
| Relative humidity <%> | Use the outside air humidity I26 of the second information I2. |
| Wind velocity <m/s> | Acquire values on the neighborhood of the target building 10 from Tokyo weather data (AMEDAS) from 2018 to 2019. |
| Precipitation <mm> | Acquire values on the neighborhood of the target building 10 from Tokyo weather data (AMEDAS) from 2018 to 2019. |
| Time <0 to 23> | Use the date information I12 and the time information I11 of the first information I1. |
| Day of week <Monday to Sunday, holiday> | Use the date information I12, the day-of-week information I13, and the holiday information I14 of the first information I1. |
| Total remote controller ON time <min> of all indoor units | Calculate from the air conditioning operating time I23 of the second information I2. |
| Average suction air temperature of all indoor units <° C.> | Calculate from the indoor temperature I22 of the second information I2. |
| Suction air temperature of each indoor unit <° C.> | Use the indoor temperature I22 of the second information I2. |

(4-4-4) Objective Variable of Learning Model

The objective variable of the learning model LM1 in this verification is the difference load 170 obtained by subtracting the first prediction air conditioning load 161 from the actual air conditioning load 140.

(4-5) Learning Model

In this verification, the learning model LM1 uses a multilayer perceptron. The multilayer perceptron is a model that enables nonlinear regression by providing a hidden layer between an input layer and an output layer for linear regression and applying a nonlinear function to a result of a weighted sum.

To create the model, the data set of 2018 is divided into a training set and a validation set, and hyperparameters (the number of hidden layers, the number of nodes in the hidden layer, and a regularization parameter) are adjusted such that the accuracy in the validation set becomes the highest. Learning is then performed again with the adjusted parameters using all the data set of 2018.

(4-6) Evaluation Index

As an error index, the CVRMSE (Coefficient of Variation of the Root Mean Square Error) described below is used.

$$CVRMSE = \frac{1}{m} \times \sqrt{\frac{\sum_{i=1}^{n} (m_i - s_i)^2}{n}} \quad \text{Math 2}$$

Here, $m_i$ is an actual measurement value, $s_i$ is a prediction value, $\overline{m}$ is the mean of actual measurement values, and n is the number of data. According to ASHRAE Guideline 14, in the case of time-by-time data prediction, 30% or less of the CVRMSE is used as a reference value for prediction accuracy evaluation. Furthermore, as prediction accuracy verification of a peak load that is important at the time of design, a relative error of top 2.5% from the peak is also evaluated.

(4-7) Verification Result

A result of annual cooling load prediction in the future (one year of 2019) from the annual (one year of 2018) actual measurement and the short-period (one month of July 2018) actual measurement is described here.

Figure 10:
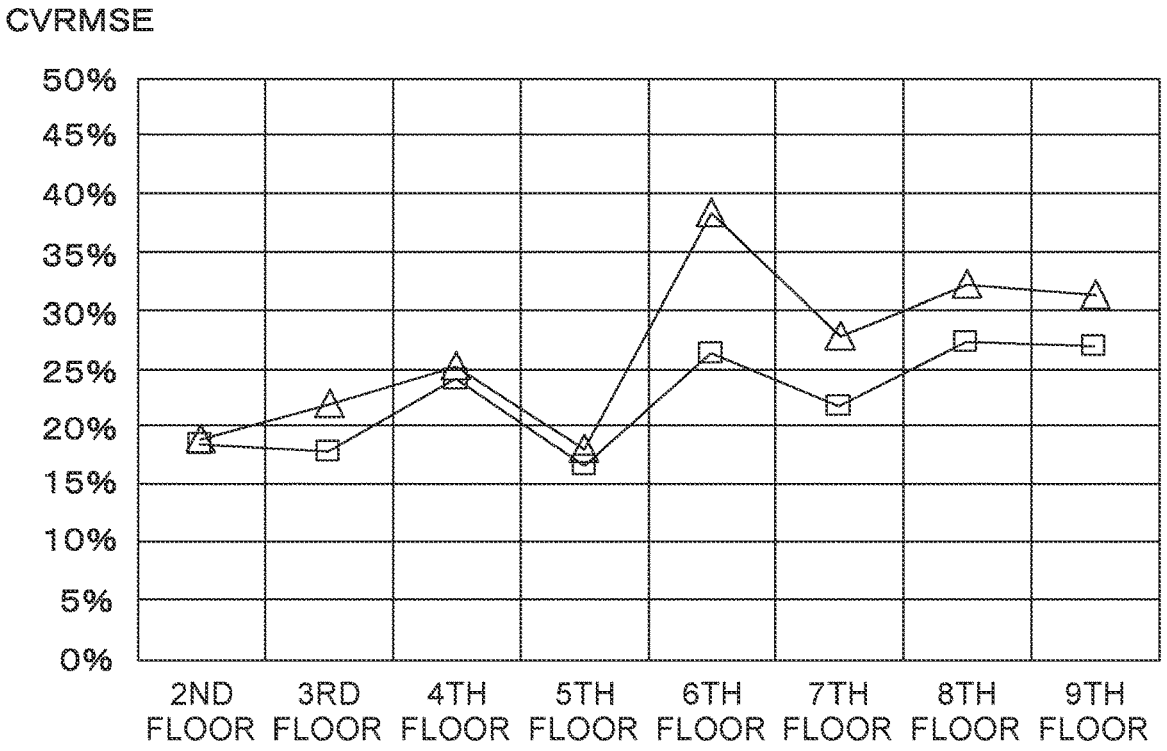
FIG. 10 is a graph illustrating a verification result of cooling load prediction according to the first embodiment.

FIG. 10 illustrates the CVRMSE for each floor when the future annual time-by-time cooling load is predicted from the annual actual measurement and the short-period actual measurement. In FIG. 10, the accuracy of the annual actual measurement is indicated in the graph line in which the values are plotted with square marks. Further, the accuracy of the short-period actual measurement is indicated in the graph line in which the values are plotted with triangle marks. As illustrated in FIG. 10, in the case of the prediction based on the annual actual measurement, the values of the CVRMSE fall within 30%, which is the reference value of ASHRAE Guideline 14, in all the floors. The mean value for all the floors in the CVRMSE is 22% in the case of the annual actual measurement and is 27% in the case of the short-period actual measurement. In the case of the short-period actual measurement, as the learning data is naturally reduced, the accuracy of the model is lowered as a whole as compared with the annual actual measurement.

Figure 11:
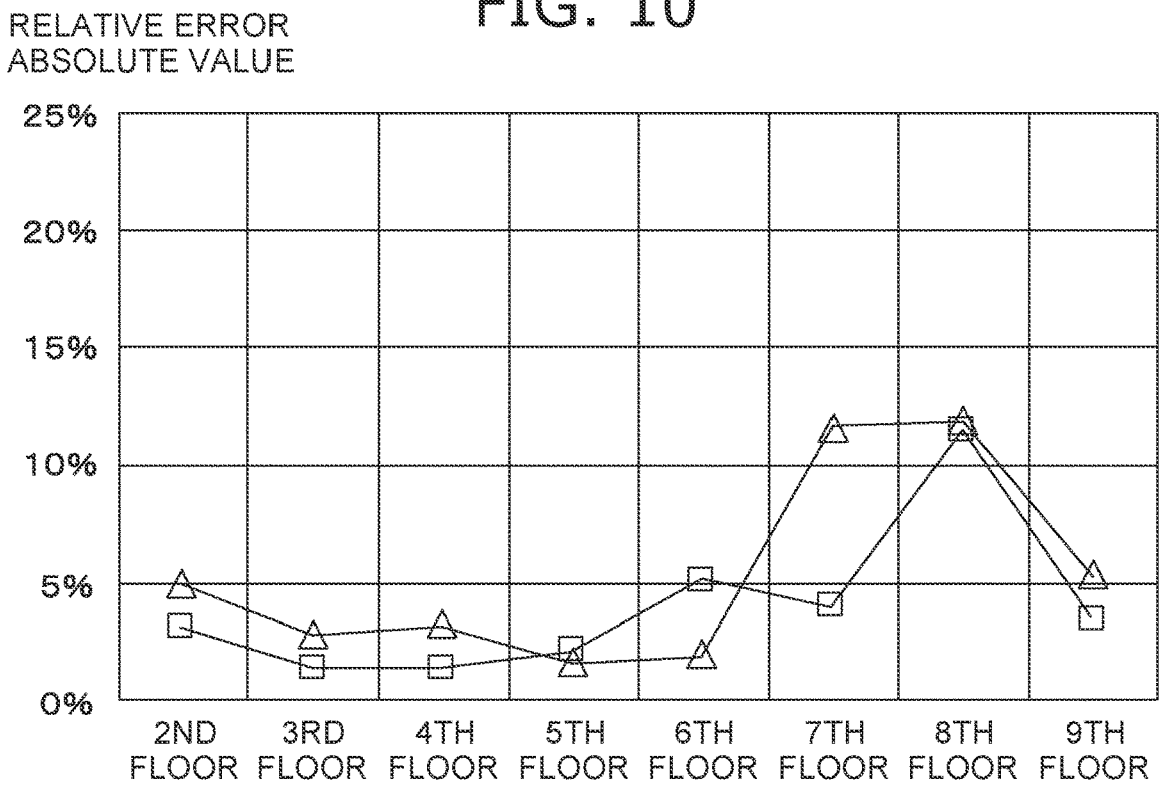
FIG. 11 is a graph illustrating a verification result of cooling load prediction according to the first embodiment.

FIG. 11 illustrates the relative error absolute values of the top 2.5% cooling load prediction values. The graph lines are represented in FIG. 11 in the same manner as that in FIG. 10. As illustrated in FIG. 11, there is a difference between the short-period actual measurement and the annual actual measurement for the sixth floor and the seventh floor, but the accuracy is almost the same for the other floors. The mean value of the relative error absolute values of the top 2.5% cooling load prediction values for all the floors is 4% in the case of the annual actual measurement and is 5% in the case of the short-period actual measurement.

Figure 12:
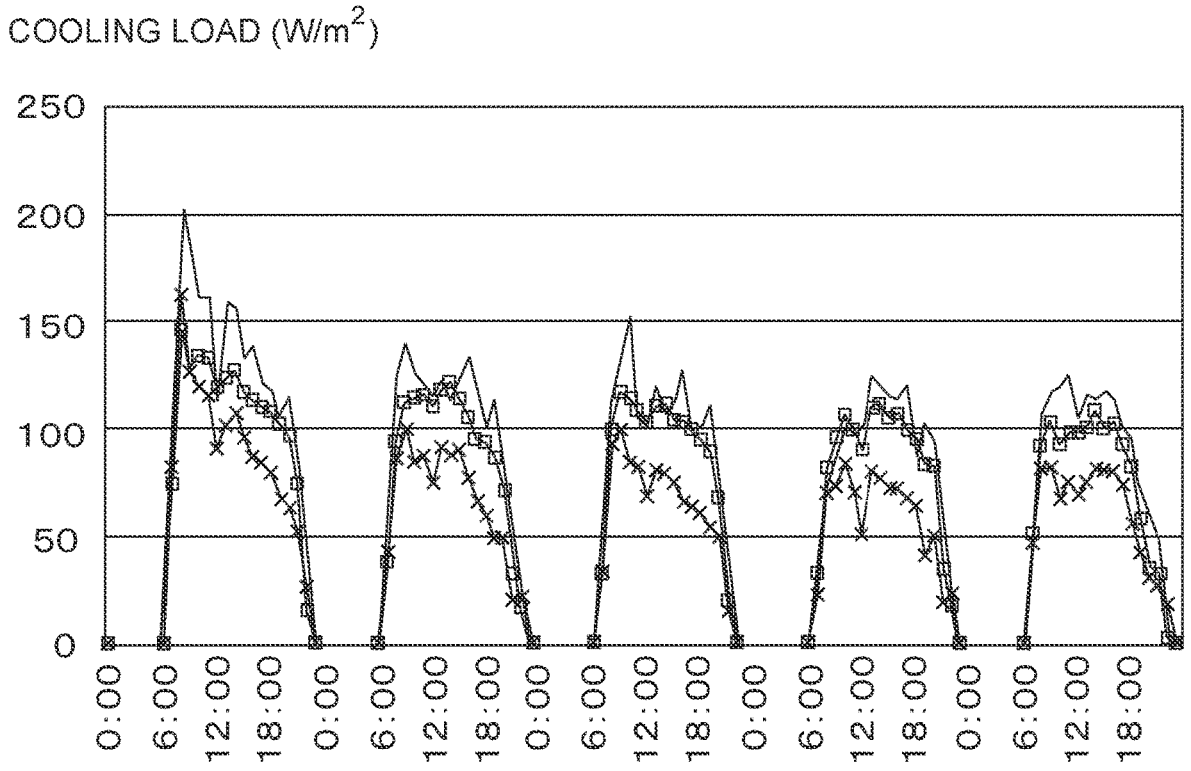
FIG. 12 is a graph illustrating a verification result of cooling load prediction according to the first embodiment.

FIG. 12 illustrates the comparison among the time-by-time cooling load actual measurement value, the prediction value by the annual actual measurement, and the dynamic thermal load calculation value of the second floor in representative summer five days (August 19 to 23). In FIG. 12, the actual measurement values are indicated in a graph line in which no values are plotted. Further, the prediction values by the annual actual measurement are indicated in a graph line in which the values are plotted with square marks. The dynamic thermal load calculation values are indicated in a graph line in which the values are plotted with cross marks. As illustrated in FIG. 12, it can be seen that the prediction value by the annual actual measurement using the combination of the physical model PM and the learning model LM1 is closer to the actual measurement value as compared with the dynamic thermal load calculation value using only the physical model PM.

(5) Feature (5-1)

Conventionally, the difference between the actual air conditioning load measurement value and the external thermal load (excluding the internal heat generation) obtained by the physical model is determined so that the internal heat generation related to the operation of the building is estimated and used for air conditioning load prediction. In order to predict the air conditioning load according to this method, there is a need to input the information about the operation of the building so as to reflect the effect of the operation of the building on the internal heat generation, etc.

However, the information about the operation of the building is typically hard to obtain and is often incomplete even if it is obtained. Therefore, the conventional method has an issue that it is difficult to grasp the effect of the operation of the building on the air conditioning load.

In the air conditioning load learning apparatus 110 according to the present embodiment, the actual load acquisition unit 119 acquires the actual air conditioning load 140 that is an actual air conditioning load in the target space 11 inside the target building 10. The first information acquisition unit 111 acquires the first information I1. The first information i1 is information about the operation of the target building 10. The prediction load acquisition unit 113 acquires the first prediction air conditioning load 161 that is an air conditioning load in the target space 11 predicted by the physical model PM from at least the thermal property of the target building 10. The second information acquisition unit 112 acquires the second information I2. The second information I2 is at least one of the indoor humidity I21, the indoor temperature I22, the air conditioning operating time I23, the post air conditioning operation start elapsed time I24, the outside air temperature I25, the outside air humidity I26, and the solar radiation I27. The learning unit 114 generates the learning model LM1 using the first information I1 and the second information I2 as explanatory variables and using the difference load 170, which is the difference between the actual air conditioning load 140 and the first prediction air conditioning load 161, as an objective variable.

Therefore, the air conditioning load learning apparatus 110 associates the first information I1 and the second information I2 with the difference load 170 (the value regarding the actual air conditioning load 140) so as to learn the effect of the operation of the building on the internal heat generation, the outside air introduction load, the heat storage load, the solar radiation load, etc. As a result, the air conditioning load learning apparatus 110 can finally grasp the effect of the operation of the building on the air conditioning load.

(5-2)

In the air conditioning load learning apparatus 110 according to the present embodiment, the actual air conditioning load 140 is an air conditioning load per unit time.

As a result, the air conditioning load learning apparatus 110 can learn the effect of the operation of the building on the air conditioning load in more detail.

(5-3)

In the air conditioning load prediction apparatus 120 according to the present embodiment, the difference load prediction unit 124 uses the learning model LM1 to predict the difference load 170 from the first information I1 and the second information I2. The load prediction unit 125 predicts the air conditioning load (the second prediction air conditioning load 162) in the target space 11 based on the predicted difference load 170 and the first prediction air conditioning load 161.

As a result, the air conditioning load prediction apparatus 120 can use the learning model LM1 having learned the effect of the operation of the building on the internal heat generation, the outside air introduction load, the heat storage load, the solar radiation load, and the like, to predict the air conditioning load in consideration of the effect of the operation of the building.

(5-4)

In the air conditioning load prediction apparatus 120 according to the present embodiment, the learning model LM1 is generated based on the first information I1, the second information I2, the actual air conditioning load 140, and the first prediction air conditioning load 161 in the short period. From the first information I1 and the second information I2 in the long period that is a period longer than the short period, the difference load prediction unit 124 predicts the difference load 170 in the same long period. Based on the predicted difference load 170 in the long period and the first prediction air conditioning load 161 in the same long period, the load prediction unit 125 predicts the air conditioning load (the second prediction air conditioning load 162) in the same long period in the target space 11.

As a result, the air conditioning load prediction apparatus 120 can use the learning model LM1 having learned with the data in the short period to predict the air conditioning load in the long period.

(6) Modification (6-1) Modification 1A

According to the present embodiment, the first information I1, the second information I2, and the actual air conditioning load 140 are acquired from the air conditioning information 37 in the air conditioning database 80. However, these pieces of information may be directly acquired from the air conditioning system 30.

(6-2) Modification 1B

According to the present embodiment, the outside air temperature I25, the outside air humidity I26, and the solar radiation I27, which are the second information I2, are acquired from the air conditioning information 37 in the air conditioning database 80. However, these pieces of information may be acquired from weather data (AMEDAS) on the neighborhood of the target building 10, etc.

(6-3) Modification 1C

According to the present embodiment, the learning unit 114 generates the learning model LM1 using the first information I1 and the second information I2 as explanatory variables and using the difference load 170, which is the difference between the actual air conditioning load 140 and the first prediction air conditioning load 161, as an objective variable. However, the learning unit 114 may generate the learning model LM1 using the first prediction air conditioning load 161 as an explanatory variable instead of the second information I2. Further, the learning unit 114 may generate the learning model LM1 using the first information I1, the second information I2, and the first prediction air conditioning load 161 as explanatory variables.

As a result, the air conditioning load learning apparatus 110 can generate the learning model LM1 with a higher prediction accuracy.

In this case, the difference load prediction unit 124 uses the learning model LM1 to predict the difference load 170 from the first information I1 and the second information I2 or the first prediction air conditioning load 161. Furthermore, from the first information I1 and the second information I2 or the first prediction air conditioning load 161 in the long period that is a period longer than the short period, the difference load prediction unit 124 predicts the difference load 170 in the same long period.

(6-4)

Although the embodiment of the present disclosure has been described above, it is understood that various modifications may be made to forms and details without departing from the spirit and scope of the present disclosure described in claims.

Second Embodiment

A different part from the first embodiment is primarily described below. Therefore, the present embodiment is basically the same as the first embodiment except for the contents described according to the present embodiment.

(1) Overall Configuration

Figure 13:
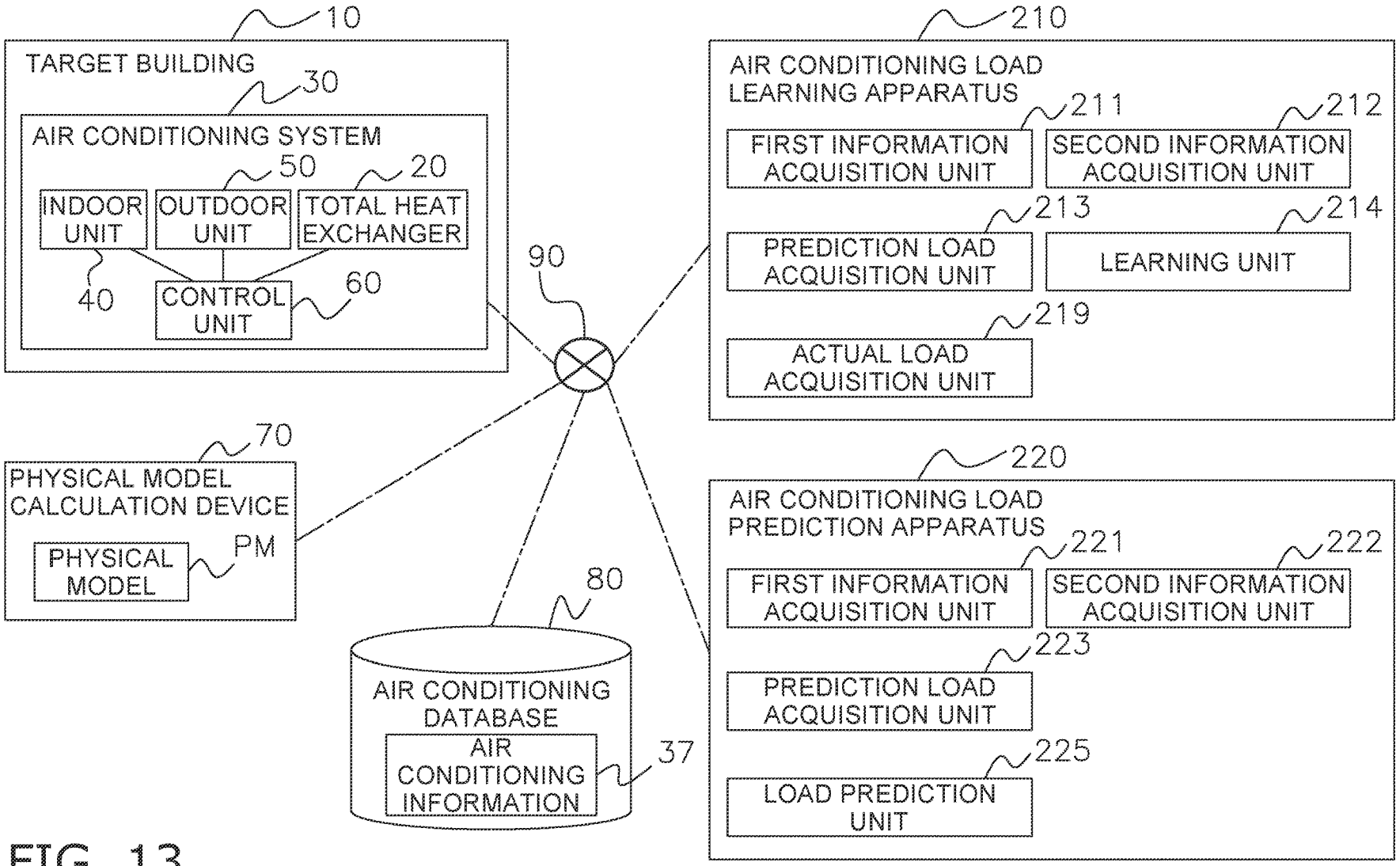
FIG. 13 is a configuration diagram of an air conditioning load learning apparatus and an air conditioning load prediction apparatus according to a second embodiment.

FIG. 13 is a configuration diagram of an air conditioning load learning apparatus 210 and an air conditioning load prediction apparatus 220. As illustrated in FIG. 13, the air conditioning load learning apparatus 210, the air conditioning load prediction apparatus 220, the physical model calculation device 70, the air conditioning system 30, and the air conditioning database 80 are communicatively coupled via the network 90.

(2) Detailed Configuration (2-1) Air Conditioning System

The air conditioning system 30 and the air conditioning database 80 are the same as those according to the first embodiment.

(2-2) Physical Model Calculation Device

Figure 14:
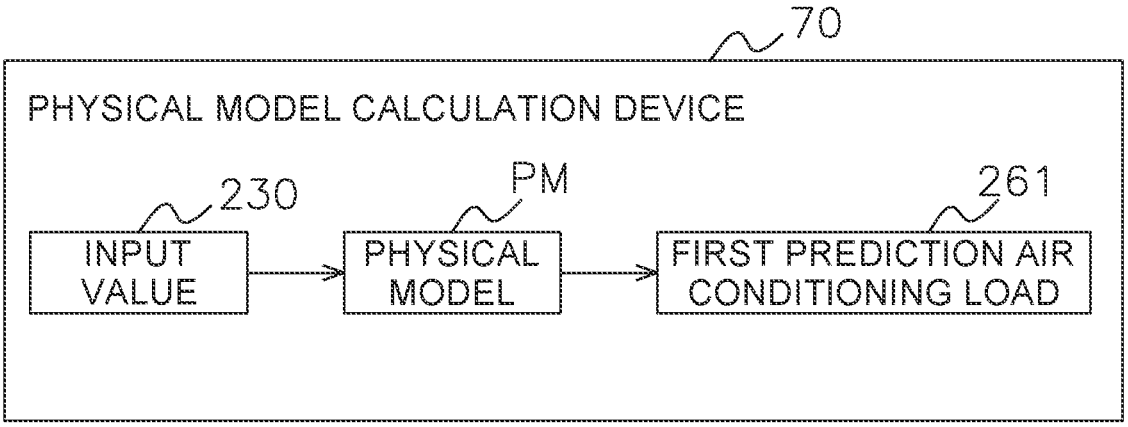
FIG. 14 is a configuration diagram of a physical model calculation process according to the second embodiment.

The physical model calculation device 70 calculates the thermal load of the target building 10 based on the physical model PM. FIG. 14 is a configuration diagram of the physical model calculation process. As illustrated in FIG. 14, the physical model calculation device 70 inputs an input value 230 to the physical model PM to calculate a first prediction air conditioning load 261. The input value 230 includes at least a thermal property of the target building 10. The first prediction air conditioning load 261 is a predicted air conditioning load in the target space 11.

(2-3) Air Conditioning Load Learning Apparatus

Figure 15:
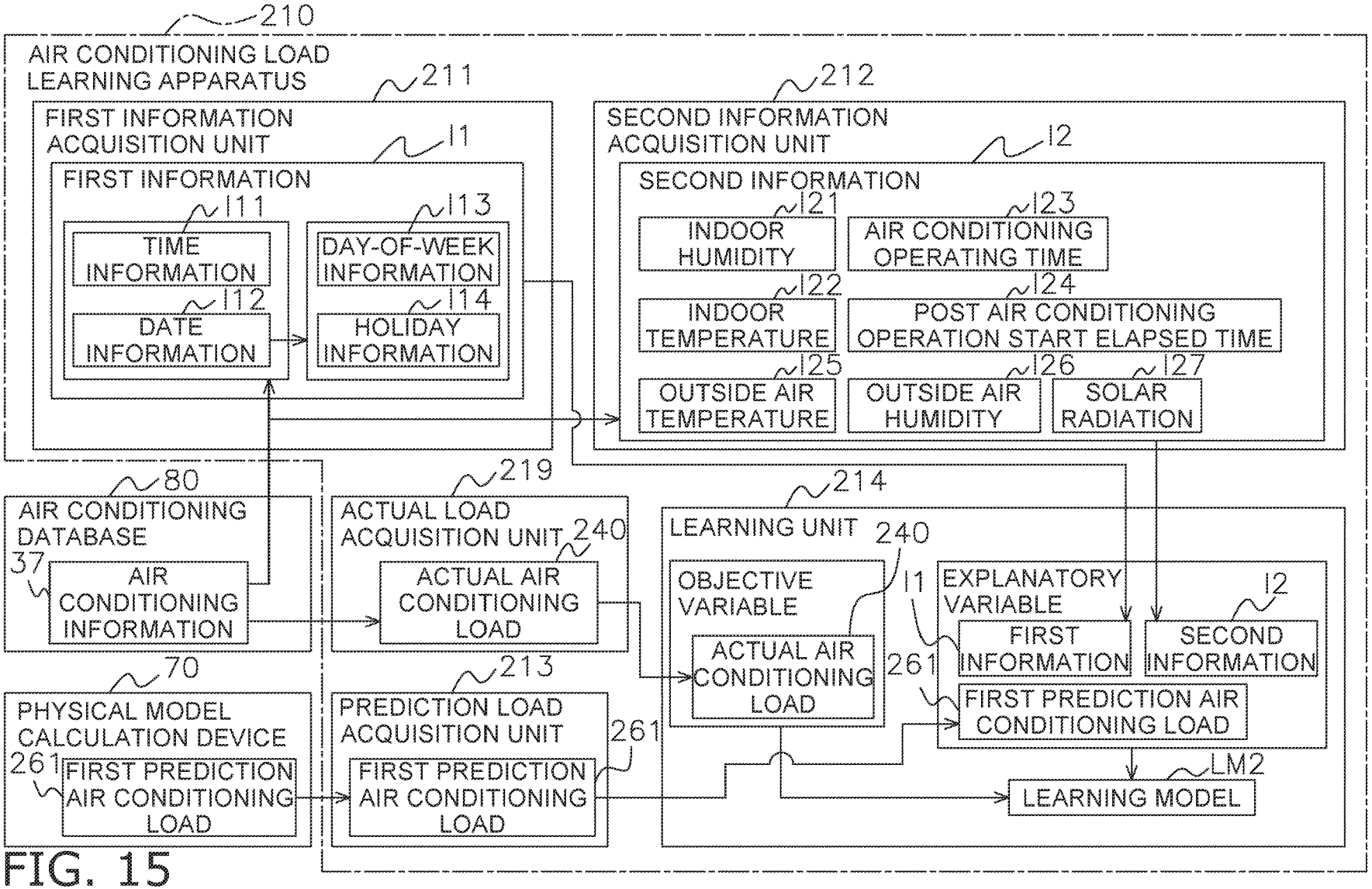
FIG. 15 is a configuration diagram of an air conditioning load learning process according to the second embodiment.

FIG. 15 is a configuration diagram of an air conditioning load learning process. As illustrated in FIGS. 13 and 15, the air conditioning load learning apparatus 210 primarily includes an actual load acquisition unit 219, a prediction load acquisition unit 213, a first information acquisition unit 211, a second information acquisition unit 212, and a learning unit 214.

The air conditioning load learning apparatus 300 includes a control arithmetic device and a storage device. A processor such as a CPU or a GPU may be used as the control arithmetic device. The control arithmetic device reads a program stored in the storage device and performs predetermined image processing and arithmetic processing in accordance with the program. Further, the control arithmetic device can write an arithmetic result in the storage device and read information stored in the storage device in accordance with the program. The actual load acquisition unit 219, the prediction load acquisition unit 213, the first information acquisition unit 211, the second information acquisition unit 212, and the learning unit 214 are various functional blocks implemented by the control arithmetic device and the storage device.

(2-3-1) Actual Load Acquisition Unit

As illustrated in FIG. 15, the actual load acquisition unit 219 acquires an actual air conditioning load 240, which is an actual air conditioning load in the target space 11 inside the target building 10, from the air conditioning information 37 in the air conditioning database 80. According to the present embodiment, the actual air conditioning load 240 is an air conditioning load per unit time.

(2-3-2) Prediction Load Acquisition Unit

As illustrated in FIG. 15, the prediction load acquisition unit 213 acquires, from the physical model calculation device 70, the first prediction air conditioning load 261 that is an air conditioning load in the target space 11 predicted by the physical model PM from at least the thermal property of the target building 10.

(2-3-3) First Information Acquisition Unit

As illustrated in FIG. 15, the first information acquisition unit 211 acquires the first information I1 from the air conditioning information 37 in the air conditioning database 80. The first information I1 is information about the operation of the target building 10.

(2-3-4) Second Information Acquisition Unit

As illustrated in FIG. 15, the second information acquisition unit 212 acquires the second information I2 from the air conditioning information 37 in the air conditioning database 80. The second information I2 is at least one of the indoor humidity I21, the indoor temperature I22, the air conditioning operating time I23, the post air conditioning operation start elapsed time I24, the outside air temperature I25, the outside air humidity I26, and the solar radiation I27. FIG. 15 describes all of these pieces of information.

(2-3-5) Learning Unit

As illustrated in FIG. 15, the learning unit 214 generates a learning model LM2 using the first prediction air conditioning load 261, the first information I1, and the second information I2 as explanatory variables and using the actual air conditioning load 240 as an objective variable.

The period (learning data period) of data used for the air conditioning load learning process of the air conditioning load learning apparatus 210 may be shorter than the period (prediction data period) of data used for the air conditioning load prediction process of the air conditioning load prediction apparatus 220. Specifically, the learning model LM2 may be generated based on the first prediction air conditioning load 261, the first information I1, the second information I2, and the actual air conditioning load 240 in a period shorter than the prediction data period.

(2-4) Air Conditioning Load Prediction Apparatus

Figure 16:
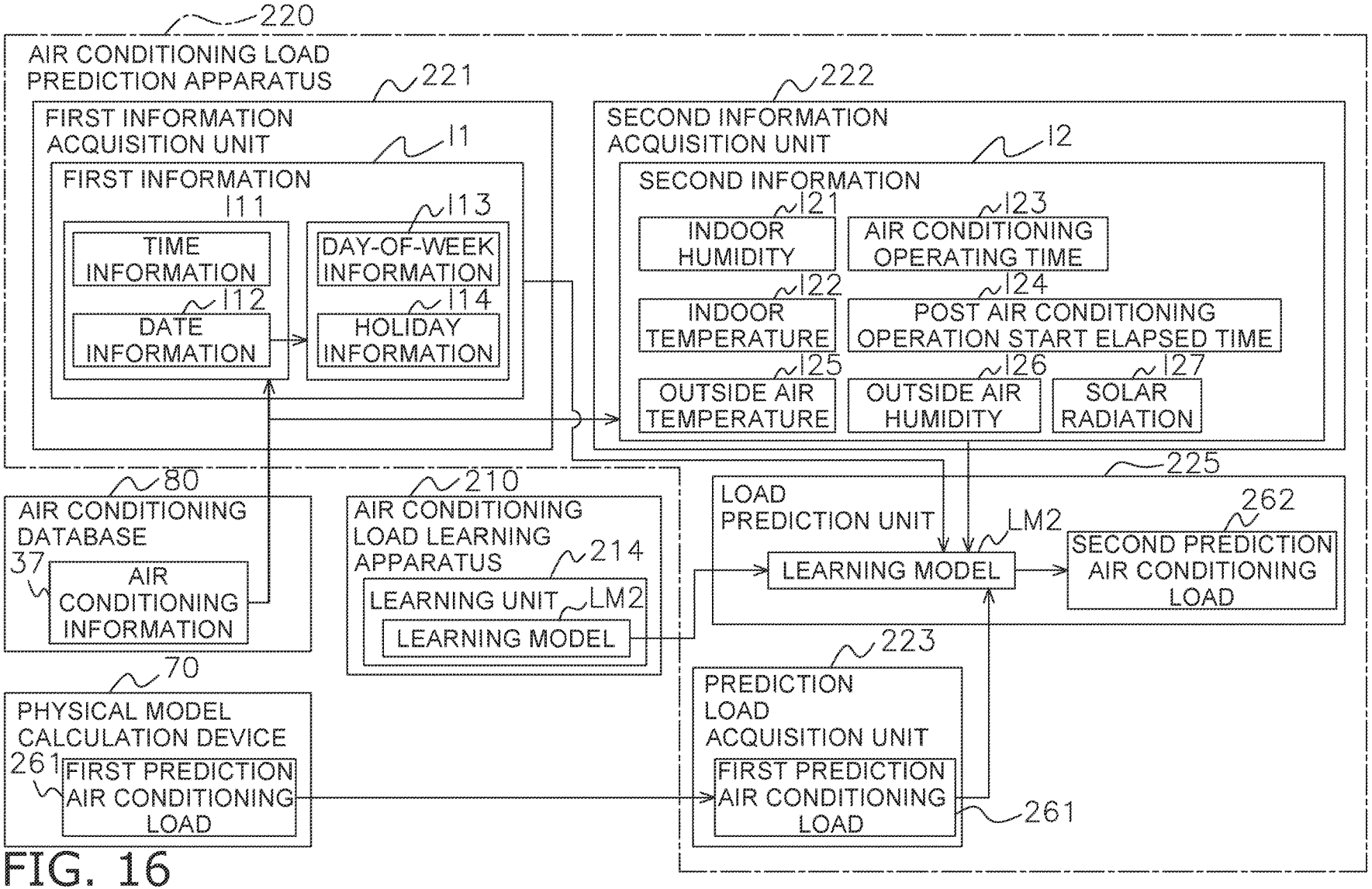
FIG. 16 is a configuration diagram of an air conditioning load prediction process according to the second embodiment.

FIG. 16 is a configuration diagram of an air conditioning load prediction process. As illustrated in FIGS. 13 and 16, the air conditioning load prediction apparatus 220 primarily includes a prediction load acquisition unit 223, a first information acquisition unit 221, a second information acquisition unit 222, and a load prediction unit 225.

The air conditioning load prediction apparatus 220 includes a control arithmetic device and a storage device. A processor such as a CPU or a GPU may be used as the control arithmetic device. The control arithmetic device reads a program stored in the storage device and performs predetermined image processing and arithmetic processing in accordance with the program. Further, the control arithmetic device can write an arithmetic result in the storage device and read information stored in the storage device in accordance with the program. The prediction load acquisition unit 223, the first information acquisition unit 221, the second information acquisition unit 222, and the load prediction unit 225 are various functional blocks implemented by the control arithmetic device and the storage device.

(2-4-1) Prediction Load Acquisition Unit

As illustrated in FIG. 16, the prediction load acquisition unit 223 acquires the first prediction air conditioning load 261 in the same manner as the prediction load acquisition unit 213 in the air conditioning load learning apparatus 210.

(2-4-2) First Information Acquisition Unit

As illustrated in FIG. 16, the first information acquisition unit 221 acquires the first information I1 in the same manner as the first information acquisition unit 211 in the air conditioning load learning apparatus 210.

(2-4-3) Second Information Acquisition Unit

As illustrated in FIG. 16, the second information acquisition unit 222 acquires the second information I2 in the same manner as the second information acquisition unit 212 in the air conditioning load learning apparatus 210.

(2-4-4) Load Prediction Unit

As illustrated in FIG. 16, the load prediction unit 225 uses the learning model LM2 generated by the learning unit 214 to predict the air conditioning load (a second prediction air conditioning load 262) in the target space 11 from the first prediction air conditioning load 261, the first information I1, and the second information I2.

Based on the first prediction air conditioning load 261, the first information I1, and the second information I2 in a period longer than the learning data period, the load prediction unit 225 may predict the air conditioning load in the same long period in the target space 11.

(3) Process (3-1) Air Conditioning Load Learning Process

Figure 17:
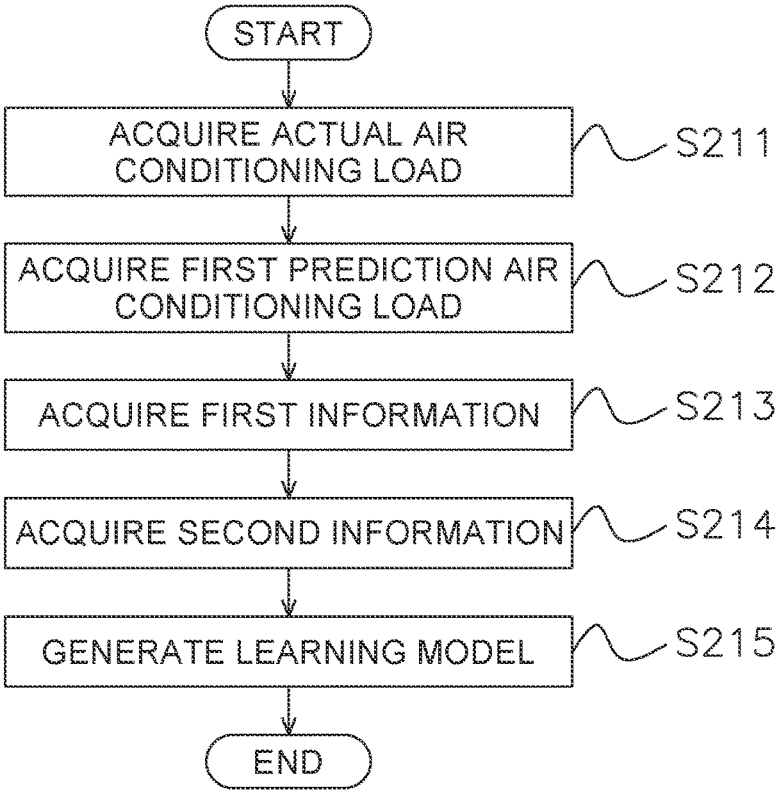
FIG. 17 is a flowchart of the air conditioning load learning process according to the second embodiment.

The air conditioning load learning process will be described using the flowchart of FIG. 17.

As described in Step S211, the air conditioning load learning apparatus 210 acquires the actual air conditioning load 240 from the air conditioning information 37 in the air conditioning database 80.

After acquiring the actual air conditioning load 240, the air conditioning load learning apparatus 210 acquires the first prediction air conditioning load 261 from the physical model calculation device 70 as described in Step S212.

After acquiring the first prediction air conditioning load 261, the air conditioning load learning apparatus 210 acquires the first information I1 from the air conditioning information 37 in the air conditioning database 80 as described in Step S213.

After acquiring the first information I1, the air conditioning load learning apparatus 210 acquires the second information I2 from the air conditioning information 37 in the air conditioning database 80 as described in Step S214.

After acquiring the second information I2, the air conditioning load learning apparatus 210 generates the learning model LM2 using the first prediction air conditioning load 261, the first information I1, and the second information I2 as explanatory variables and using the actual air conditioning load 240 as an objective variable as described in Step S215.

(3-2) Air Conditioning Load Prediction Process

Figure 18:
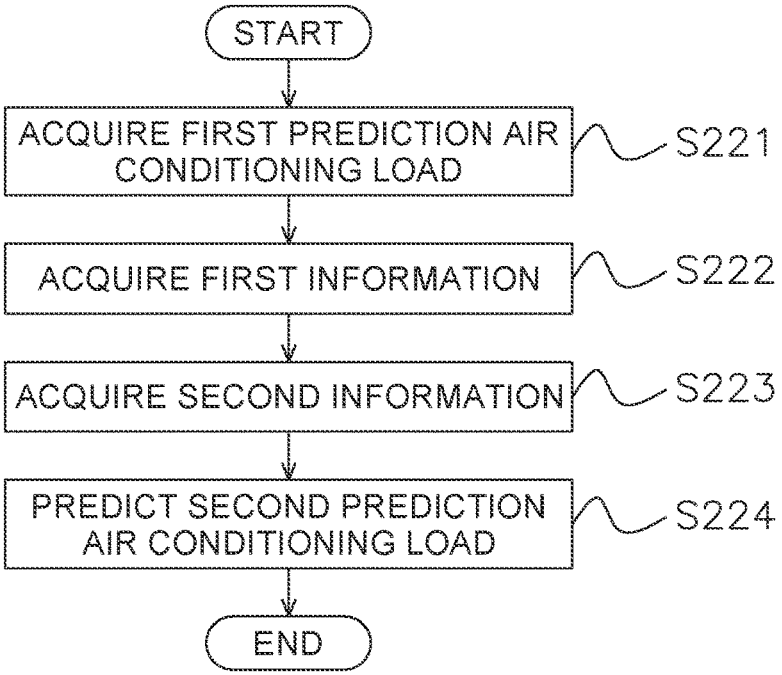
FIG. 18 is a flowchart of the air conditioning load prediction process according to the second embodiment.

The air conditioning load prediction process will be described using the flowchart of FIG. 18.

As described in Step S221, the air conditioning load prediction apparatus 220 acquires the first prediction air conditioning load 261 from the physical model calculation device 70.

After acquiring the first prediction air conditioning load 261, the air conditioning load prediction apparatus 220 acquires the first information I1 from the air conditioning information 37 in the air conditioning database 80 as described in Step S222.

After acquiring the first information I1, the air conditioning load prediction apparatus 220 acquires the second information I2 from the air conditioning information 37 in the air conditioning database 80 as described in Step S223.

After acquiring the second information I2, the air conditioning load prediction apparatus 220 uses the learning model LM2 to predict the second prediction air conditioning load 262 in the target space 11 from the first prediction air conditioning load 261, the first information I1, and the second information I2 as described in Step S224.

(4) Feature (4-1)

In the air conditioning load learning apparatus 210 according to the present embodiment, the actual load acquisition unit 219 acquires the actual air conditioning load 240, which is an actual air conditioning load in the target space 11 inside the target building 10. The first information acquisition unit 211 acquires the first information I1. The first information I1 is information about the operation of the target building 10. The prediction load acquisition unit 213 acquires the first prediction air conditioning load 261 that is an air conditioning load in the target space 11 predicted by the physical model PM from at least the thermal property of the target building 10. The second information acquisition unit 212 acquires the second information I2. The second information I2 is at least one of the indoor humidity I21, the indoor temperature I22, the air conditioning operating time I23, the post air conditioning operation start elapsed time I24, the outside air temperature I25, the outside air humidity I26, and the solar radiation I27. The learning unit 214 generates the learning model LM2 using the first prediction air conditioning load 261, the first information I1, and the second information I2 as explanatory variables and using the actual air conditioning load 240 as an objective variable.

Thus, the air conditioning load learning apparatus 210 associates the first information I1 and the second information I2 with the actual air conditioning load 240 (the value regarding the actual air conditioning load 240) so as to learn the effect of the operation of the building on the internal heat generation, the outside air introduction load, the heat storage load, the solar radiation load, etc. As a result, the air conditioning load learning apparatus 210 can finally grasp the effect of the operation of the building on the air conditioning load.

(4-2)

In the air conditioning load learning apparatus 210 according to the present embodiment, the actual air conditioning load 240 is an air conditioning load per unit time.

As a result, the air conditioning load learning apparatus 210 can learn the effect of the operation of the building on the air conditioning load in more detail.

(4-3)

In the air conditioning load prediction apparatus 220 according to the present embodiment, the load prediction unit 225 uses the learning model LM2 to predict the air conditioning load (the second prediction air conditioning load 262) in the target space 11 from the first prediction air conditioning load 261, the first information I1, and the second information I2.

As a result, the air conditioning load prediction apparatus 220 can use the learning model LM2 having learned the effect of the operation of the building on the internal heat generation, the outside air introduction load, the heat storage load, the solar radiation load, and the like, to predict the air conditioning load in consideration of the effect of the operation of the building.

(4-4)

In the air conditioning load prediction apparatus 220 according to the present embodiment, the learning model LM2 is generated based on the first prediction air conditioning load 261, the first information I1, the second information I2, and the actual air conditioning load 240 in a short period. Based on the first prediction air conditioning load 261, the first information I1, and the second information I2 in the long period that is a period longer than the short period, the load prediction unit 225 predicts the air conditioning load (the second prediction air conditioning load 262) in the same long period in the target space 11.

As a result, the air conditioning load prediction apparatus 220 can use the learning model LM2 having learned with the data in the short period to predict the air conditioning load in the long period.

(5) Modification

Although the embodiment of the present disclosure has been described above, it is understood that various modifications may be made to forms and details without departing from the spirit and scope of the present disclosure described in claims.

Third Embodiment

A different part from the first embodiment is primarily described below. Therefore, the present embodiment is basically the same as the first embodiment except for the contents described according to the present embodiment.

(1) Overall Configuration

Figure 19:
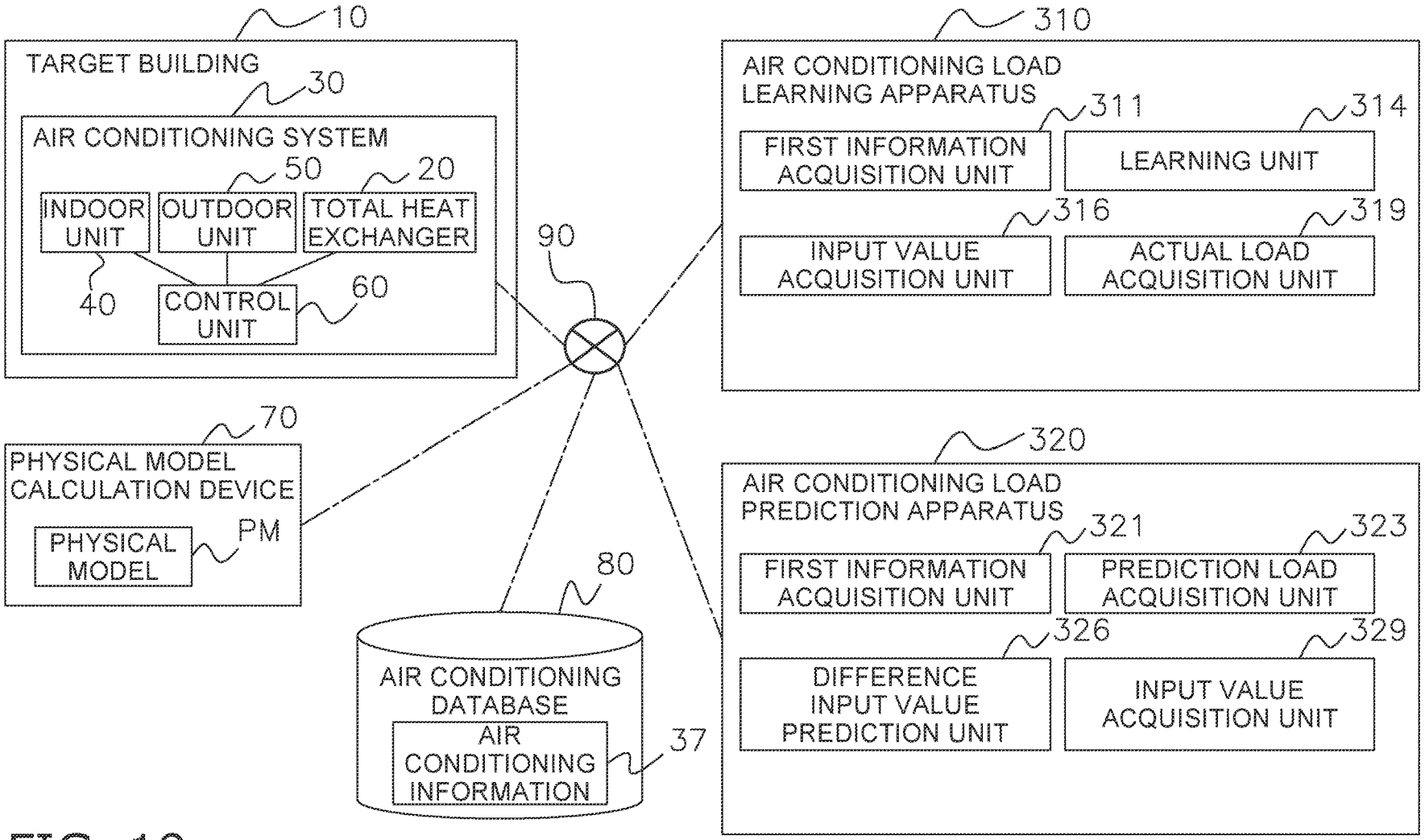
FIG. 19 is a configuration diagram of an air conditioning load learning apparatus and an air conditioning load prediction apparatus according to a third embodiment.

FIG. 19 is a configuration diagram of an air conditioning load learning apparatus 310 and an air conditioning load prediction apparatus 320. As illustrated in FIG. 19, the air conditioning load learning apparatus 310, the air conditioning load prediction apparatus 320, the physical model calculation device 70, the air conditioning system 30, and the air conditioning database 80 are communicatively coupled via the network 90.

(2) Detailed Configuration (2-1) Air Conditioning System

The air conditioning system 30 and the air conditioning database 80 are the same as those according to the first embodiment.

(2-2) Physical Model Calculation Device

The physical model calculation device 70 calculates the thermal load of the target building 10 based on the physical model PM. The present embodiment uses the physical model PM that can inversely calculate the corresponding input value from the air conditioning load in the target space 11.

Figure 20:
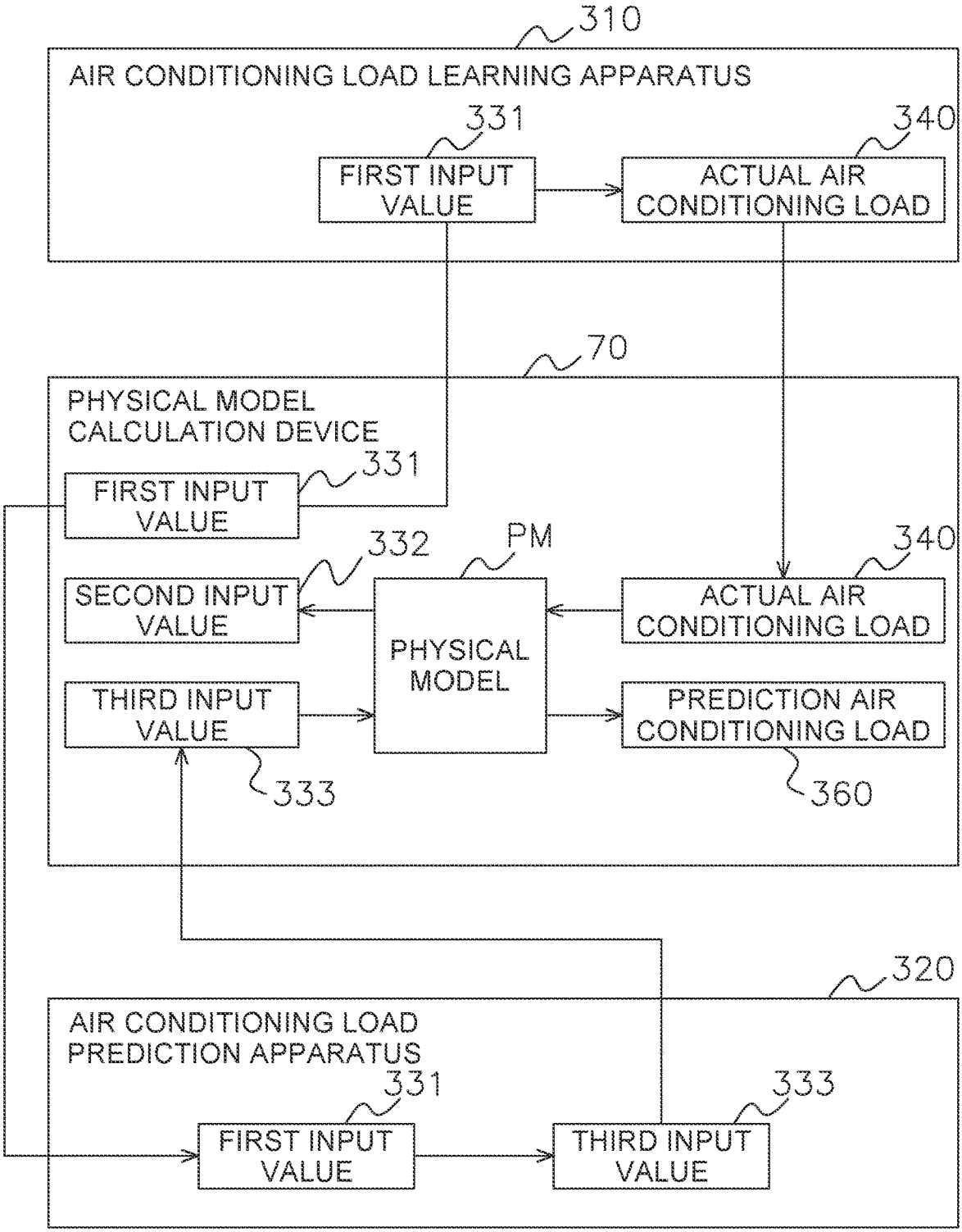
FIG. 20 is a configuration diagram of a physical model calculation process according to the third embodiment.

FIG. 20 is a configuration diagram of the physical model calculation process. As illustrated in FIG. 20, the physical model calculation device 70 transmits a first input value 331, which is an input value to the physical model PM, to the air conditioning load learning apparatus 310 and thus acquires an actual air conditioning load 340 corresponding to the first input value 331. The physical model calculation device 70 uses the actual air conditioning load 340 to calculate a second input value 332 by inverse calculation of the physical model PM. Furthermore, the physical model calculation device 70 transmits the first input value 331 to the air conditioning load prediction apparatus 320 and thus inputs a third input value 333 received from the air conditioning load prediction apparatus 320 to the physical model PM, and calculates a prediction air conditioning load 360. The first input value 331, the second input value 332, and the third input value 333 include at least the thermal property of the target building 10. The prediction air conditioning load 360 is a predicted air conditioning load in the target space 11.

(2-3) Air Conditioning Load Learning Apparatus

Figure 21:
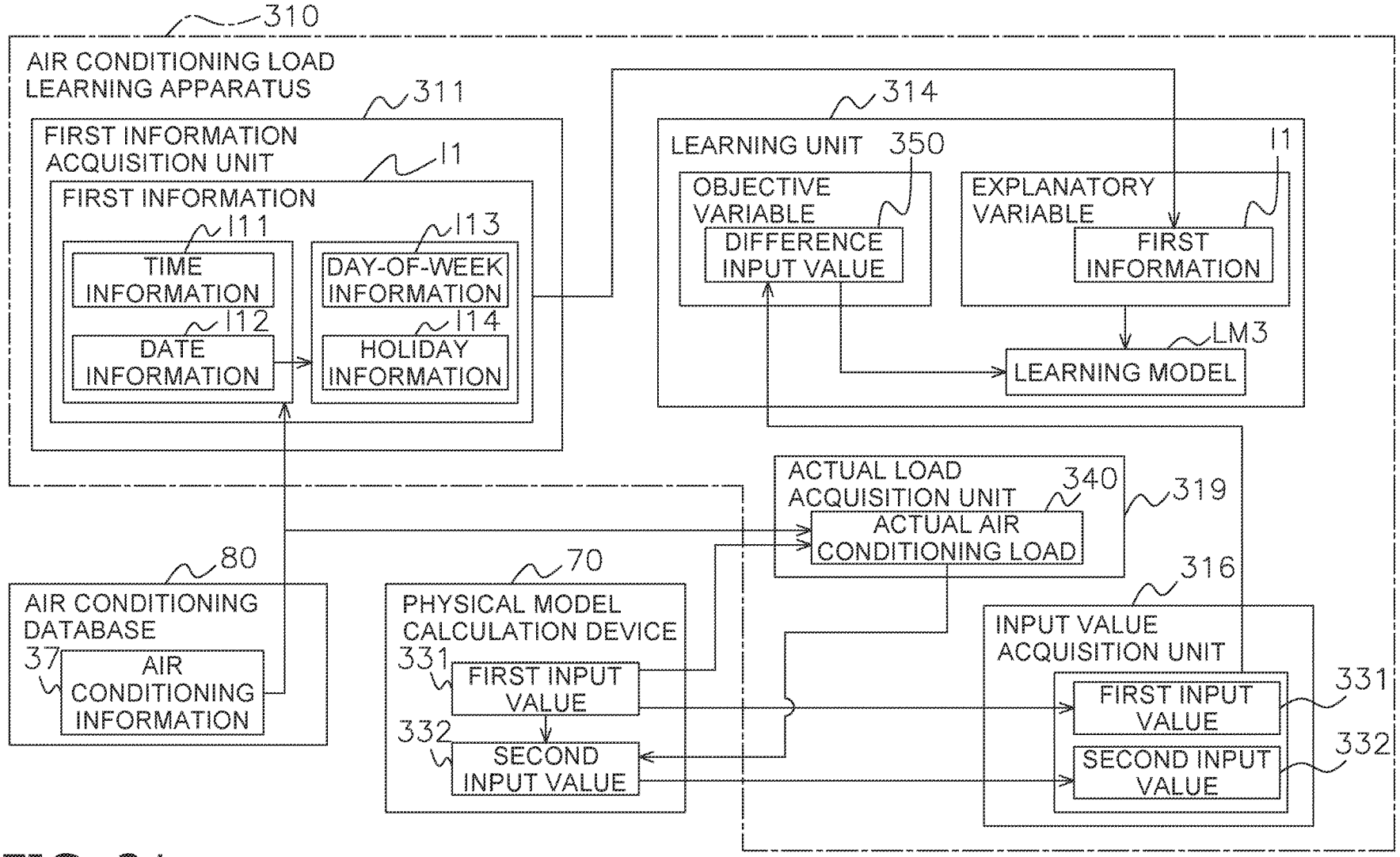
FIG. 21 is a configuration diagram of an air conditioning load learning process according to the third embodiment.

FIG. 21 is a configuration diagram of an air conditioning load learning process. As illustrated in FIGS. 19 and 21, the air conditioning load learning apparatus 310 primarily includes an actual load acquisition unit 319, an input value acquisition unit 316, a first information acquisition unit 311, and a learning unit 314.

The air conditioning load learning apparatus 310 includes a control arithmetic device and a storage device. A processor such as a CPU or a GPU may be used as the control arithmetic device. The control arithmetic device reads a program stored in the storage device and performs predetermined image processing and arithmetic processing in accordance with the program. Further, the control arithmetic device can write an arithmetic result in the storage device and read information stored in the storage device in accordance with the program. The actual load acquisition unit 319, the input value acquisition unit 316, the first information acquisition unit 311, and the learning unit 314 are various functional blocks implemented by the control arithmetic device and the storage device.

(2-3-1) Actual Load Acquisition Unit

As illustrated in FIG. 21, the actual load acquisition unit 319 acquires, from the air conditioning information 37 in the air conditioning database 80, the actual air conditioning load 340, which is an actual air conditioning load in the target space 11 inside the target building 10, corresponding to the first input value 331 acquired from the physical model calculation device 70.

(2-3-2) Input Value Acquisition Unit

As illustrated in FIG. 21, the input value acquisition unit 316 acquires the first input value 331 and the second input value 332 from the physical model calculation device 70.

(2-3-3) First Information Acquisition Unit

As illustrated in FIG. 21, the first information acquisition unit 311 acquires the first information I1 from the air conditioning information 37 in the air conditioning database 80. The first information I1 is information about the operation of the target building 10.

(2-3-4) Learning Unit

As illustrated in FIG. 21, the learning unit 314 generates a learning model LM3 using the first information I1 as an explanatory variable and using a difference input value 350, which is the difference between the first input value 331 and the second input value 332, as an objective variable.

(2-4) Air Conditioning Load Prediction Apparatus

Figure 22:
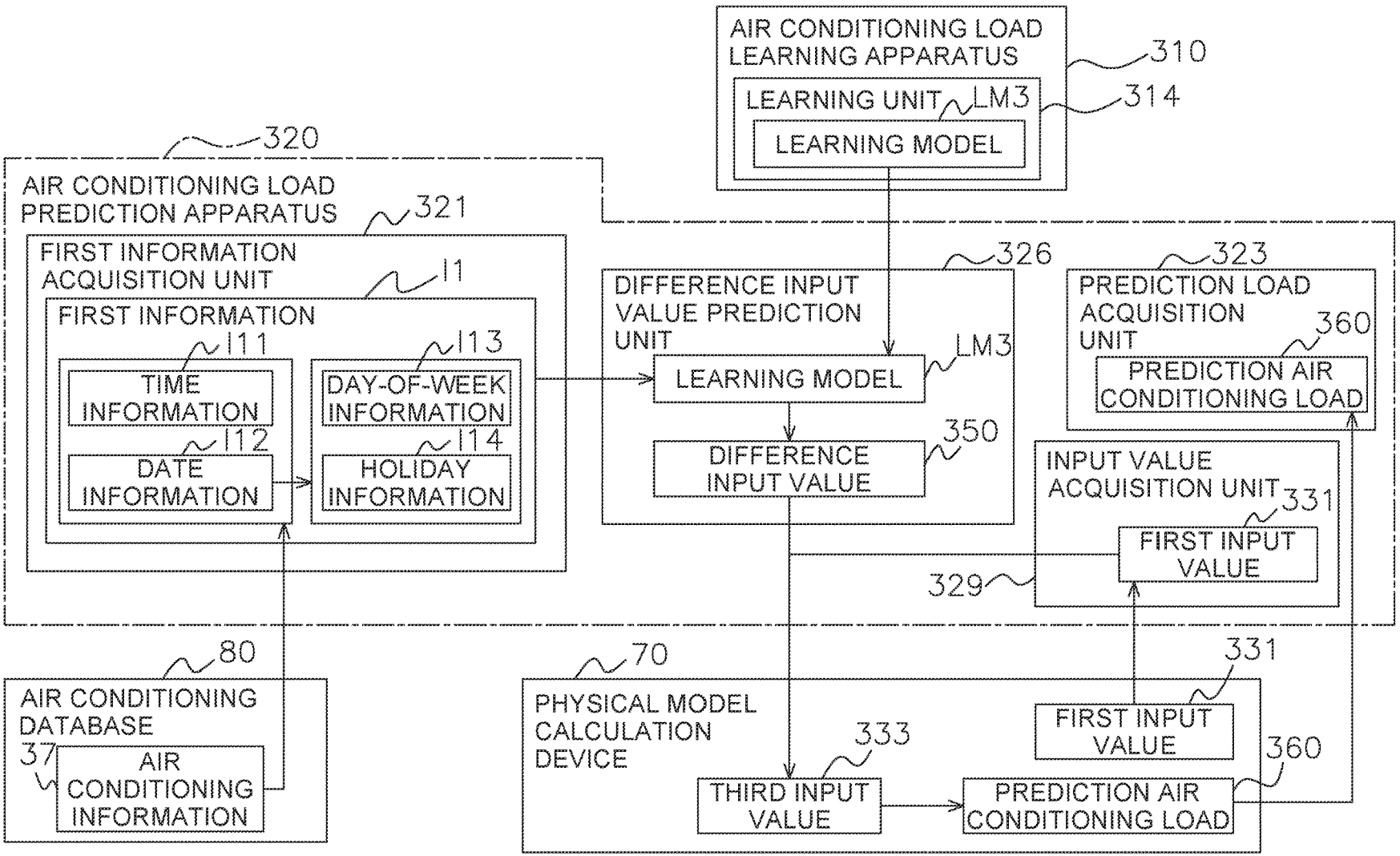
FIG. 22 is a configuration diagram of an air conditioning load prediction process according to the third embodiment.

FIG. 22 is a configuration diagram of an air conditioning load prediction process. As illustrated in FIGS. 19 and 22, the air conditioning load prediction apparatus 320 primarily includes a first information acquisition unit 321, a difference input value prediction unit 326, a prediction load acquisition unit 323, and an input value acquisition unit 329.

The air conditioning load prediction apparatus 320 includes a control arithmetic device and a storage device. A processor such as a CPU or a GPU may be used as the control arithmetic device. The control arithmetic device reads a program stored in the storage device and performs predetermined image processing and arithmetic processing in accordance with the program. Further, the control arithmetic device can write an arithmetic result in the storage device and read information stored in the storage device in accordance with the program. The first information acquisition unit 321, the difference input value prediction unit 326, the prediction load acquisition unit 323, and the input value acquisition unit 329 are various functional blocks implemented by the control arithmetic device and the storage device.

(2-4-1) First Information Acquisition Unit

As illustrated in FIG. 22, the first information acquisition unit 321 acquires the first information I1 in the same manner as the first information acquisition unit 311 in the air conditioning load learning apparatus 310.

(2-4-2) Difference Input Value Prediction Unit

As illustrated in FIG. 22, the difference input value prediction unit 326 predicts the difference input value 350 from the first information I1 by using the learning model LM3 generated by the learning unit 314.

(2-4-3) Input Value Acquisition Unit

As illustrated in FIG. 22, the input value acquisition unit 329 acquires the first input value 331 in the same manner as the input value acquisition unit 316 in the air conditioning load learning apparatus 310.

(2-4-4) Prediction Load Acquisition Unit

As illustrated in FIG. 22, the prediction load acquisition unit 323 acquires the prediction air conditioning load 360 that is an air conditioning load in the target space 11 predicted by the physical model PM. The prediction air conditioning load 360 is predicted by the physical model PM using the third input value 333 as an input. The third input value 333 is obtained by correcting the first input value 331 using the predicted difference input value 350 (by adding or subtracting the difference input value 350 to or from the first input value 331).

(3) Process (3-1) Air Conditioning Load Learning Process

Figure 23:
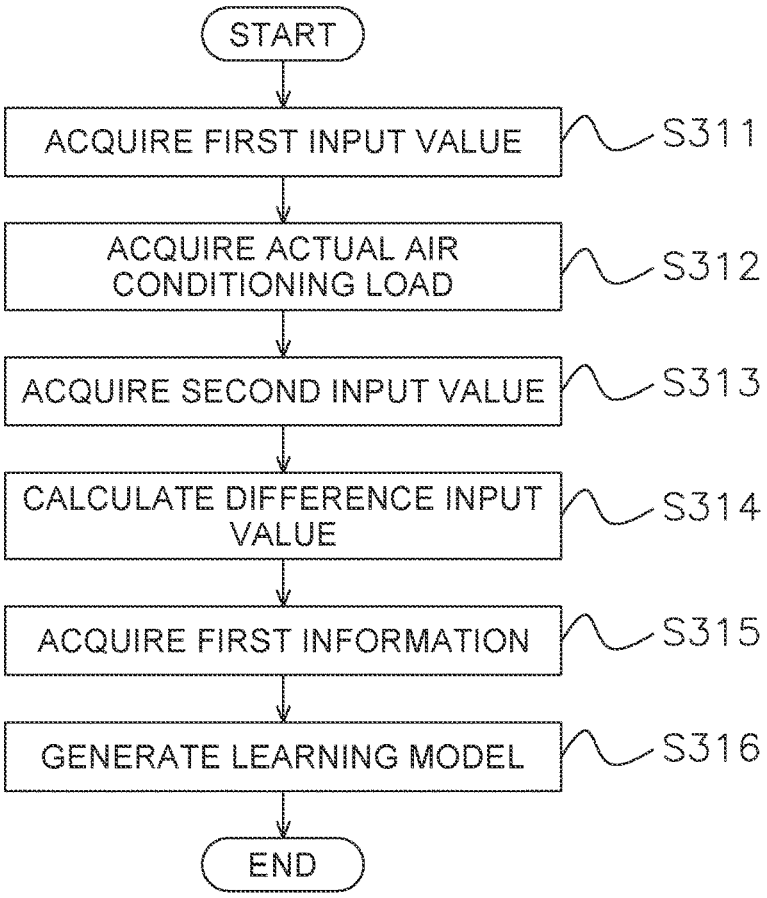
FIG. 23 is a flowchart of the air conditioning load learning process according to the third embodiment.

The air conditioning load learning process will be described using the flowchart of FIG. 23.

As described in Step S311, the air conditioning load learning apparatus 310 acquires the first input value 331 from the physical model calculation device 70.

After acquiring the first input value 331, the air conditioning load learning apparatus 310 acquires the actual air conditioning load 340 corresponding to the first input value 331 from the air conditioning information 37 in the air conditioning database 80 as described in Step S312.

After acquiring the actual air conditioning load 340, the air conditioning load learning apparatus 310 transmits the actual air conditioning load 340 to the physical model calculation device 70 and acquires the second input value 332 as described in Step S313.

After acquiring the second input value 332, the air conditioning load learning apparatus 310 calculates the difference input value 350 that is the difference between the first input value 331 and the second input value 332 as described in Step S314.

After calculating the difference input value 350, the air conditioning load learning apparatus 310 acquires the first information I1 from the air conditioning information 37 in the air conditioning database 80 as described in Step S315.

After calculating the difference input value 350 and acquiring the first information I1, the air conditioning load learning apparatus 310 generates the learning model LM3 using the first information I1 as an explanatory variable and using the difference input value 350 as an objective variable as described in Step S316.

(3-2) Air Conditioning Load Prediction Process

Figure 24:
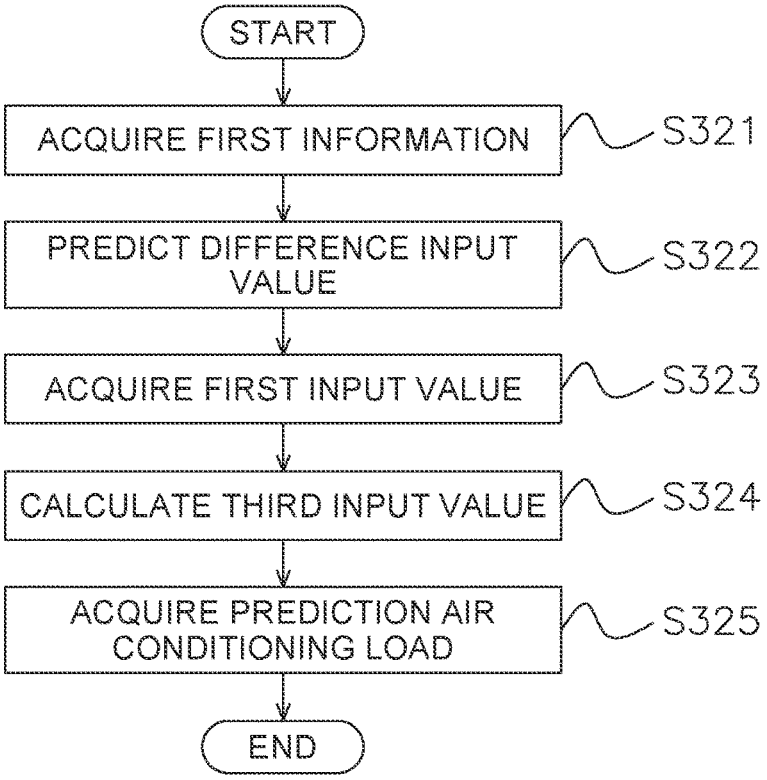
FIG. 24 is a flowchart of the air conditioning load prediction process according to the third embodiment.

The air conditioning load prediction process will be described using the flowchart of FIG. 24.

The air conditioning load prediction apparatus 320 acquires the first information I1 from the air conditioning information 37 in the air conditioning database 80 as described in Step S321.

After acquiring the first information I1, the air conditioning load prediction apparatus 320 uses the learning model LM3 to predicts the difference input value 350 from the first information I1 as described in Step S322.

After predicting the difference input value 350, the air conditioning load prediction apparatus 320 acquires the first input value 331 from the physical model calculation device 70 as described in Step S323.

After acquiring the first input value 331, the air conditioning load prediction apparatus 320 adds or subtracts the difference input value 350 to or from the first input value 331 to calculate the third input value 333 as described in Step S324.

After calculating the third input value 333, the air conditioning load prediction apparatus 320 acquires, from the physical model calculation device 70, the prediction air conditioning load 360 predicted by the physical model PM using the third input value 333 as an input as described in Step S325.

(4) Feature (4-1)

In the air conditioning load learning apparatus 310 according to the present embodiment, the actual load acquisition unit 319 acquires the actual air conditioning load 340 that is an actual air conditioning load in the target space 11 inside the target building 10. The first information acquisition unit 311 acquires the first information I1. The first information I1 is information about the operation of the target building 10. The input value acquisition unit 316 acquires the first input value 331 and the second input value 332. The first input value 331 is an input value including at least the thermal property of the target building 10 to the physical model PM that outputs the prediction air conditioning load 360 that is a predicted air conditioning load in the target space 11. The second input value 332 is an input value calculated by inverse calculation of the physical model PM using the actual air conditioning load 340. The learning unit 314 generates the learning model LM3 using the first information I1 as an explanatory variable and using the difference input value 350, which is the difference between the first input value 331 and the second input value 332, as an objective variable.

Therefore, the air conditioning load learning apparatus 310 associates the first information I1 with the difference input value 350 (the value regarding the actual air conditioning load 340) so as to learn the effect of the operation of the building on internal heat generation, etc. As a result, the air conditioning load learning apparatus 310 can finally grasp the effect of the operation of the building on the air conditioning load.

(4-2)

In the air conditioning load prediction apparatus 320 according to the present embodiment, the difference input value prediction unit 326 uses the learning model LM3 to predict the difference input value 350 from the first information I1. The prediction load acquisition unit 323 acquires the prediction air conditioning load 360 that is an air conditioning load in the target space 11 predicted by the physical model PM. The prediction air conditioning load 360 is predicted by the physical model PM using the third input value 333 as an input. The third input value 333 is obtained by correcting the first input value 331 using the predicted difference input value 350.

As a result, the air conditioning load prediction apparatus 320 can use the learning model LM2 having learned the effect of the operation of the building on internal heat generation, and the like, to predict the air conditioning load in consideration of the effect of the operation of the building.

(5) Modification (5-1) Modification 3A

According to the present embodiment, the learning unit 314 generates the learning model LM3 using the first information I1 as an explanatory variable and using the difference input value 350, which is the difference between the first input value 331 and the second input value 332, as an objective variable. However, the learning unit 314 may further generate the learning model LM3 using the first input value 331 as an explanatory variable.

As a result, the air conditioning load learning apparatus 310 can generate the learning model LM3 having a higher prediction accuracy.

In this case, the difference input value prediction unit 326 uses the learning model LM3 to predict the difference input value 350 from the first information I1 and the first input value 331.

(5-2)

Although the embodiment of the present disclosure has been described above, it is understood that various modifications may be made to forms and details without departing from the spirit and scope of the present disclosure described in claims.

Fourth Embodiment

A different part from the first embodiment is primarily described below. Therefore, the present embodiment is basically the same as the first embodiment except for the contents described according to the present embodiment.

(1) Overall Configuration

Figure 25:
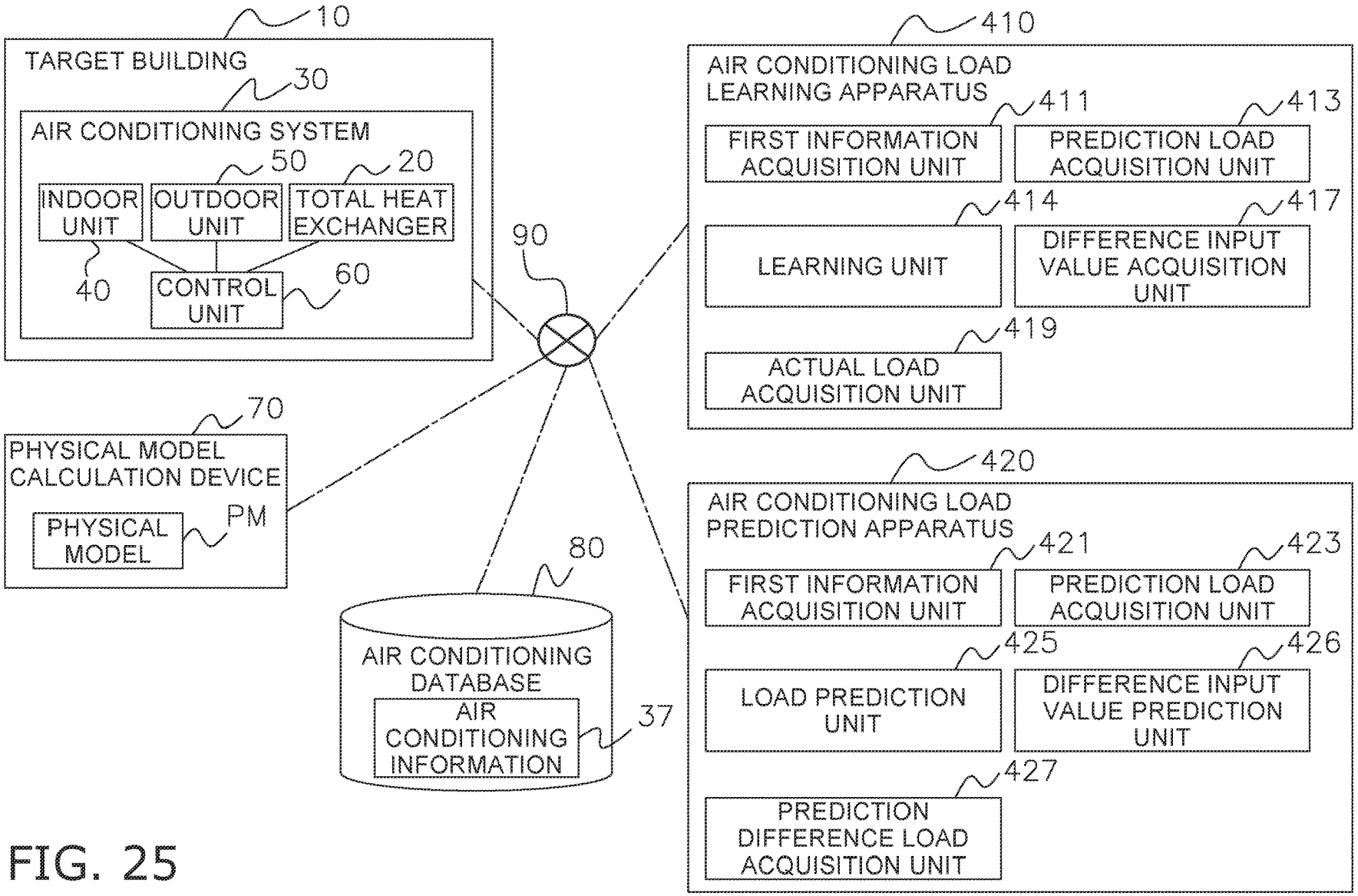
FIG. 25 is a configuration diagram of an air conditioning load learning apparatus and an air conditioning load prediction apparatus according to a fourth embodiment.

FIG. 25 is a configuration diagram of an air conditioning load learning apparatus 410 and an air conditioning load prediction apparatus 420. As illustrated in FIG. 25, the air conditioning load learning apparatus 410, the air conditioning load prediction apparatus 420, the physical model calculation device 70, the air conditioning system 30, and the air conditioning database 80 are communicatively coupled via the network 90.

(2) Detailed Configuration (2-1) Air Conditioning System

The air conditioning system 30 and the air conditioning database 80 are the same as those according to the first embodiment.

(2-2) Physical Model Calculation Device

The physical model calculation device 70 calculates the thermal load of the target building 10 based on the physical model PM. The present embodiment uses the physical model PM that can inversely calculate the corresponding input value from the air conditioning load in the target space 11. Furthermore, the present embodiment uses the physical model PM that can calculate the difference in the air conditioning load in the target space 11 from the difference in the input value and can also inversely calculate the difference in the corresponding input value from the difference in the air conditioning load in the target space 11.

Figure 26:
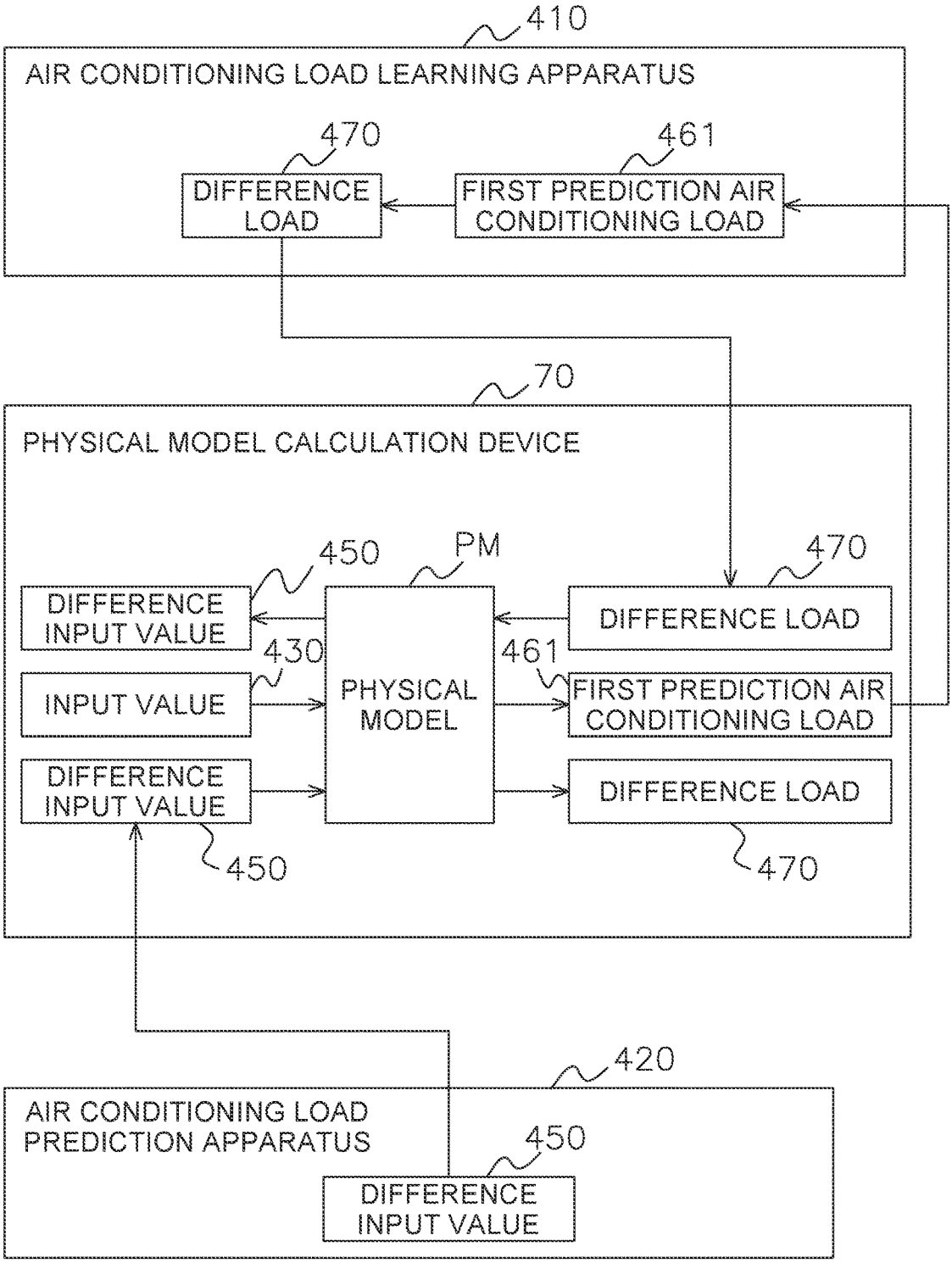
FIG. 26 is a configuration diagram of a physical model calculation process according to the fourth embodiment.

FIG. 26 is a configuration diagram of the physical model calculation process. As illustrated in FIG. 26, the physical model calculation device 70 inputs an input value 430 to the physical model PM to calculate a first prediction air conditioning load 461. The input value 430 includes at least the thermal property of the target building 10. The first prediction air conditioning load 461 is a predicted air conditioning load in the target space 11. Further, the physical model calculation device 70 transmits the first prediction air conditioning load 461 to the air conditioning load learning apparatus 410 and thus uses a difference load 470 received from the air conditioning load learning apparatus 410 to calculate a difference input value 450 by inverse calculation of the physical model PM. Further, the physical model calculation device 70 inputs the difference input value 450 received from the air conditioning load prediction apparatus 420 to the physical model PM and thus calculate the difference load 470.

(2-3) Air Conditioning Load Learning Apparatus

Figure 27:
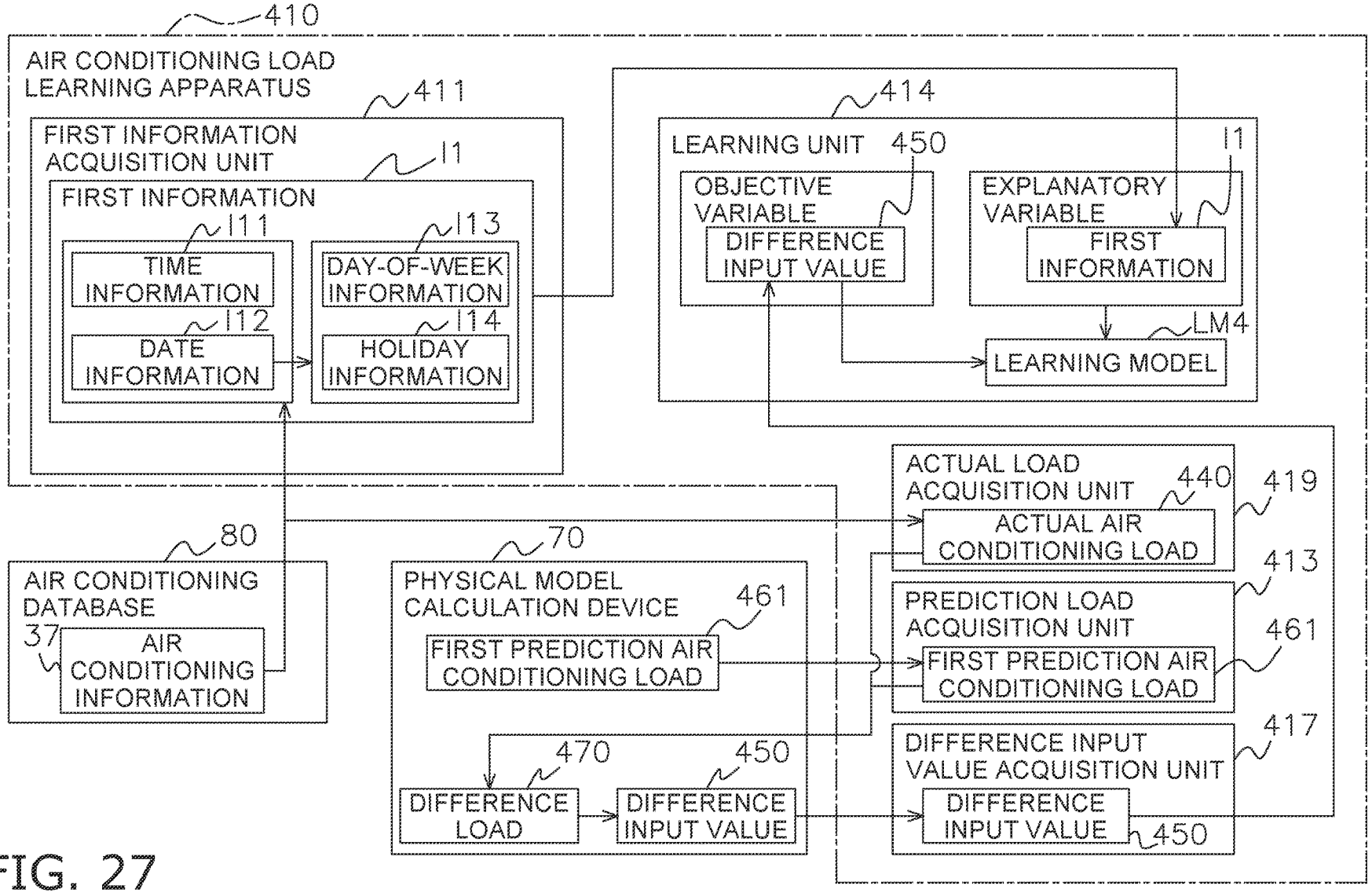
FIG. 27 is a configuration diagram of an air conditioning load learning process according to the fourth embodiment.

FIG. 27 is a configuration diagram of an air conditioning load learning process. As illustrated in FIGS. 25 and 27, the air conditioning load learning apparatus 410 primarily includes an actual load acquisition unit 419, a prediction load acquisition unit 413, a difference input value acquisition unit 417, a first information acquisition unit 411, and a learning unit 414.

The air conditioning load learning apparatus 410 includes a control arithmetic device and a storage device. A processor such as a CPU or a GPU may be used as the control arithmetic device. The control arithmetic device reads a program stored in the storage device and performs predetermined image processing and arithmetic processing in accordance with the program. Further, the control arithmetic device can write an arithmetic result in the storage device and read information stored in the storage device in accordance with the program. The actual load acquisition unit 419, the prediction load acquisition unit 413, the difference input value acquisition unit 417, the first information acquisition unit 411, and the learning unit 414 are various functional blocks implemented by the control arithmetic device and the storage device.

(2-3-1) Actual Load Acquisition Unit

As illustrated in FIG. 27, the actual load acquisition unit 419 acquires an actual air conditioning load 440, which is an actual air conditioning load in the target space 11 inside the target building 10, from the air conditioning information 37 in the air conditioning database 80.

(2-3-2) Prediction Load Acquisition Unit

As illustrated in FIG. 27, the prediction load acquisition unit 413 acquires the first prediction air conditioning load 461 that is an air conditioning load in the target space 11 predicted by the physical model PM from at least the thermal property of the target building 10.

(2-3-3) Difference Input Value Acquisition Unit

As illustrated in FIG. 27, the difference input value acquisition unit 417 acquires the difference input value 450 calculated by inverse calculation of the physical model PM using the difference load 470 that is the difference between the actual air conditioning load 440 and the first prediction air conditioning load 460.

(2-3-4) First Information Acquisition Unit

As illustrated in FIG. 27, the first information acquisition unit 411 acquires the first information I1. The first information I1 is information about the operation of the target building 10.

(2-3-5) Learning Unit

As illustrated in FIG. 27, the learning unit 414 generates a learning model LM4 using the first information I1 as an explanatory variable and using the difference input value 450 as an objective variable.

(2-4) Air Conditioning Load Prediction Apparatus

Figure 28:
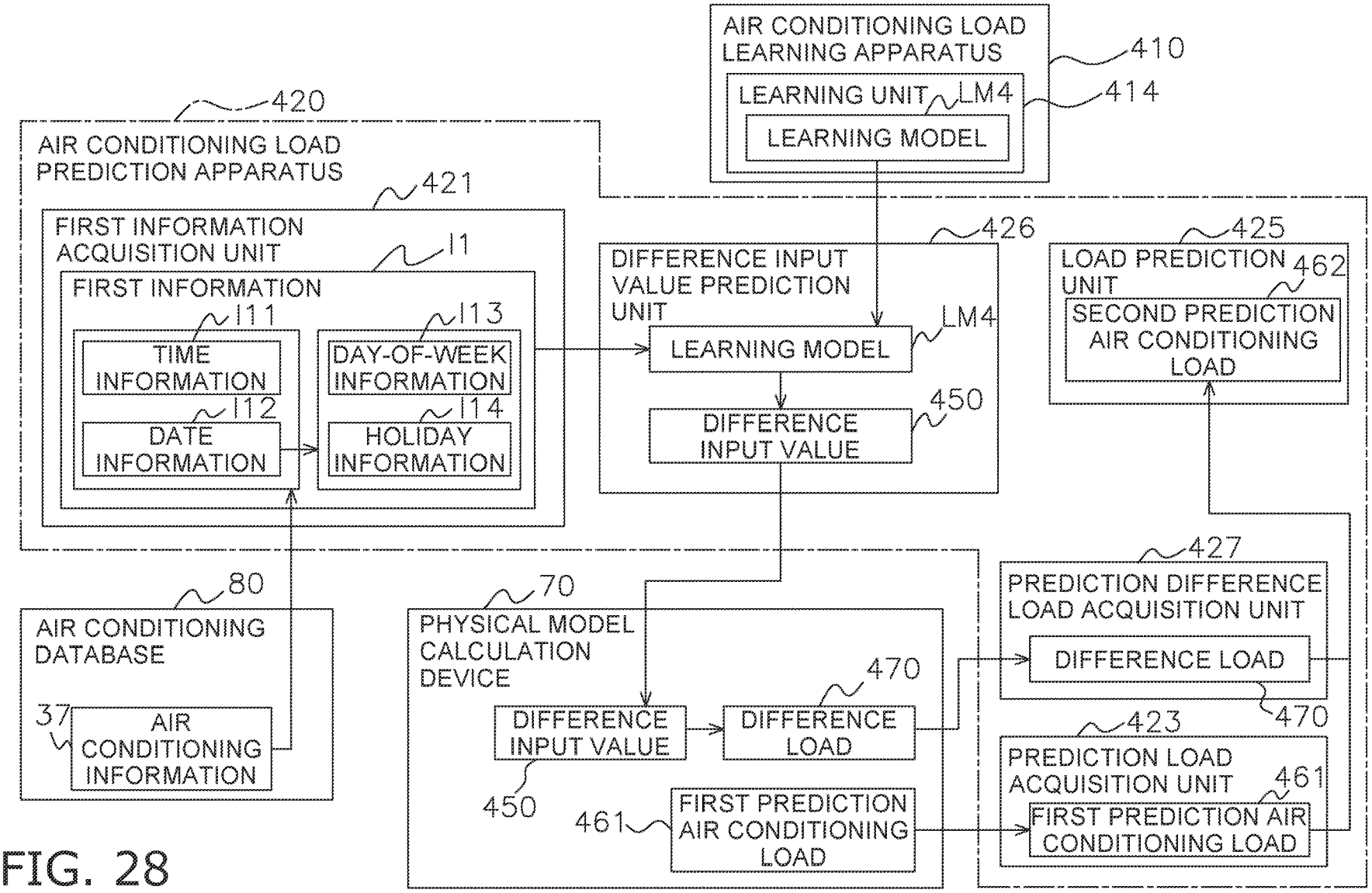
FIG. 28 is a configuration diagram of an air conditioning load prediction process according to the fourth embodiment.

FIG. 28 is a configuration diagram of an air conditioning load prediction process. As illustrated in FIGS. 25 and 28, the air conditioning load prediction apparatus 420 primarily includes a first information acquisition unit 421, a difference input value prediction unit 426, a prediction difference load acquisition unit 427, a prediction load acquisition unit 423, and a load prediction unit 425.

The air conditioning load prediction apparatus 420 includes a control arithmetic device and a storage device. A processor such as a CPU or a GPU may be used as the control arithmetic device. The control arithmetic device reads a program stored in the storage device and performs predetermined image processing and arithmetic processing in accordance with the program. Further, the control arithmetic device can write an arithmetic result in the storage device and read information stored in the storage device in accordance with the program. The first information acquisition unit 421, the difference input value prediction unit 426, the prediction difference load acquisition unit 427, the prediction load acquisition unit 423, and the load prediction unit 425 are various functional blocks implemented by the control arithmetic device and the storage device.

(2-4-1) First Information Acquisition Unit

As illustrated in FIG. 28, the first information acquisition unit 421 acquires the first information I1 in the same manner as the first information acquisition unit 411 in the air conditioning load learning apparatus 410.

(2-4-2) Difference Input Value Prediction Unit

As illustrated in FIG. 28, the difference input value prediction unit 426 uses the learning model LM4 generated by the learning unit 414 to predict the difference input value 450 from the first information I1.

(2-4-3) Prediction Difference Load Acquisition Unit

As illustrated in FIG. 28, the prediction difference load acquisition unit 427 acquires the difference load 470 predicted by the physical model PM using the predicted difference input value 450 as an input.

(2-4-4) Prediction Load Acquisition Unit

As illustrated in FIG. 28, the prediction load acquisition unit 423 acquires the first prediction air conditioning load 461 in the same manner as the prediction load acquisition unit 413 in the air conditioning load learning apparatus 410.

(2-4-5) Load Prediction Unit

As illustrated in FIG. 28, the load prediction unit 425 predicts the air conditioning load (a second prediction air conditioning load 462) in the target space 11 based on the acquired difference load 470 and the first prediction air conditioning load 461 (by adding or subtracting the difference load 470 to or from the first prediction air conditioning load 461).

(3) Process (3-1) Air Conditioning Load Learning Process

Figure 29:
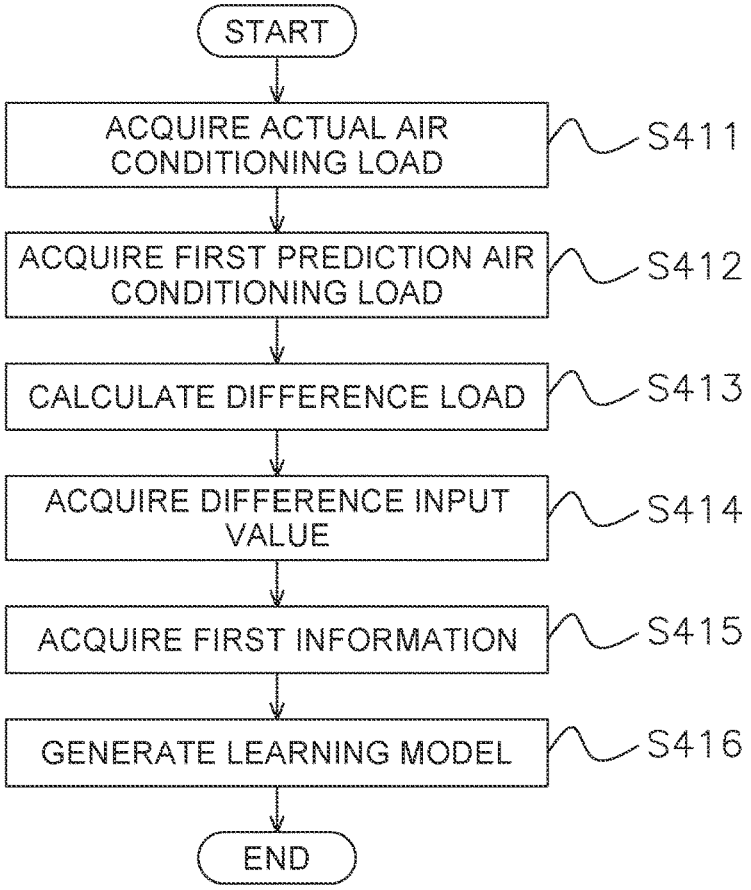
FIG. 29 is a flowchart of the air conditioning load learning process according to the fourth embodiment.

The air conditioning load learning process will be described using the flowchart of FIG. 29.

As described in Step S411, the air conditioning load learning apparatus 410 acquires the actual air conditioning load 440 from the air conditioning information 37 in the air conditioning database 80.

After acquiring the actual air conditioning load 440, the air conditioning load learning apparatus 410 acquires the first prediction air conditioning load 461 from the physical model calculation device 70 as described in Step S412.

After acquiring the first prediction air conditioning load 461, the air conditioning load learning apparatus 410 calculates the difference load 470, which is the difference between the actual air conditioning load 440 and the first prediction air conditioning load 460, as described in Step S413.

After calculating the difference load 470, the air conditioning load learning apparatus 410 acquires the difference input value 450 calculated by inverse calculation of the physical model PM using the difference load 470 as described in Step S414.

After calculating the difference input value 450, the air conditioning load learning apparatus 410 acquires the first information I1 from the air conditioning information 37 in the air conditioning database 80 as described in Step S415.

After acquiring the first information I1, the air conditioning load learning apparatus 410 generates the learning model LM4 using the first information I1 as an explanatory variable and using the difference input value 450 as an objective variable as described in Step S416.

(3-2) Air Conditioning Load Prediction Process

Figure 30:
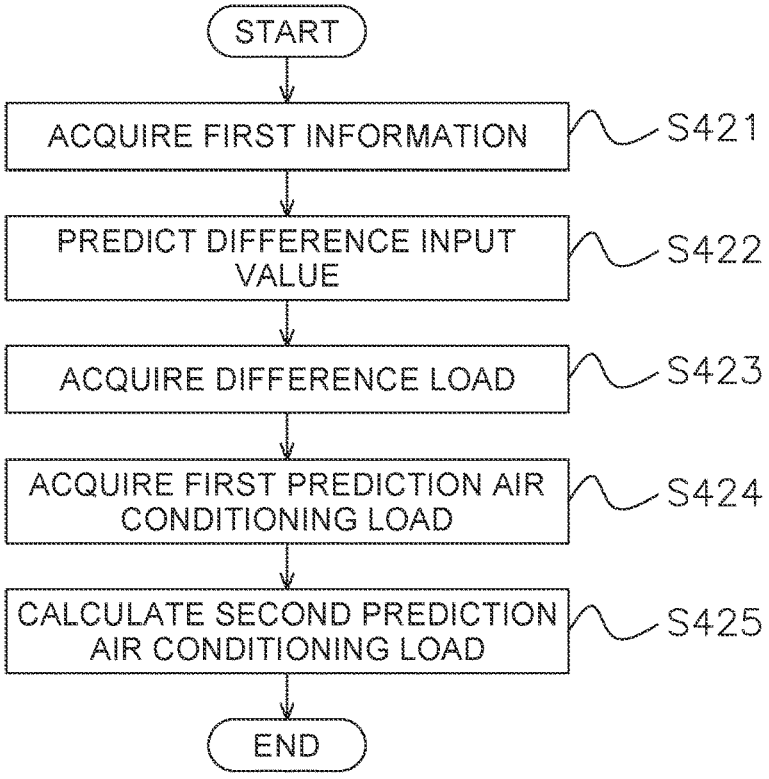
FIG. 30 is a flowchart of the air conditioning load prediction process according to the fourth embodiment.

The air conditioning load prediction process will be described using the flowchart of FIG. 30.

The air conditioning load prediction apparatus 420 acquires the first information I1 from the air conditioning information 37 in the air conditioning database 80 as described in Step S421.

After acquiring the first information I1, the air conditioning load prediction apparatus 420 uses the learning model LM4 to predict the difference input value 450 from the first information I1 as described in Step S422.

After predicting the difference input value 450, the air conditioning load prediction apparatus 420 acquires the difference load 470 predicted by the physical model PM using the difference input value 450 as an input as described in Step S423.

After acquiring the difference load 470, the air conditioning load prediction apparatus 420 acquires the first prediction air conditioning load 461 from the physical model calculation device 70 as described in Step S424.

After acquiring the first prediction air conditioning load 461, the air conditioning load prediction apparatus 420 adds or subtracts the difference load 470 to or from the first prediction air conditioning load 461 to calculate the second prediction air conditioning load 462 as described in Step S425.

(4) Feature (4-1)

In the air conditioning load learning apparatus 410 according to the present embodiment, the actual load acquisition unit 419 acquires the actual air conditioning load 440 that is an actual air conditioning load in the target space 11 inside the target building 10. The first information acquisition unit 411 acquires the first information I1. The first information I1 is information about the operation of the target building 10. The prediction load acquisition unit 413 acquires the first prediction air conditioning load 460 that is an air conditioning load in the target space 11 predicted by the physical model PM from at least the thermal property of the target building 10. The difference input value acquisition unit 417 acquires the difference input value 450 calculated by, inverse calculation of the physical model PM using the difference load 470. The learning unit 414 generates the learning model LM4 using the first information I1 as an explanatory variable and using the difference input value 450 as an objective variable.

Therefore, the air conditioning load learning apparatus 410 associates the first information I1 with the difference input value 450 (the value regarding the actual air conditioning load 440) so as to learn the effect of the operation of the building on internal heat generation, etc. As a result, the air conditioning load learning apparatus 410 can finally grasp the effect of the operation of the building on the air conditioning load.

(4-2)

In the air conditioning load prediction apparatus 420 according to the present embodiment, the difference input value prediction unit 426 uses the learning model LM4 to predict the difference input value 450 from the first information I1. The prediction difference load acquisition unit 427 acquires the difference load 470 predicted by the physical model PM using the predicted difference input value 450 as an input. The load prediction unit 425 predicts an air conditioning load (the second prediction air conditioning load 462) in the target space I1 based on the acquired difference load 470 and the first prediction air conditioning load 461.

As a result, the air conditioning load prediction apparatus 420 can use the learning model LM4 having learned the effect of the operation of the building on internal heat generation, and the like, to predict the air conditioning load in consideration of the effect of the operation of the building.

(5) Modification (5-1) Modification 4A

According to the present embodiment, the learning unit 414 generates the learning model LM4 using the first information I1 as an explanatory variable and using the difference input value 450 as an objective variable. However, the learning unit 414 may further generate the learning model LM4 using the input value 430 to the physical model PM as an explanatory variable.

As a result, the air conditioning load learning apparatus 410 can generate the learning model LM4 having a higher prediction accuracy.

In this case, the difference input value prediction unit 426 uses the learning model LM4 to predict the difference input value 450 from the first information I1 and the input value 430.

(5-2)

Although the embodiment of the present disclosure has been described above, it is understood that various modifications may be made to forms and details without departing from the spirit and scope of the present disclosure described in claims.

Fifth Embodiment

A different part from the first embodiment is primarily described below. Therefore, the present embodiment is basically the same as the first embodiment except for the contents described according to the present embodiment.

(1) Overall Configuration

Figure 31:
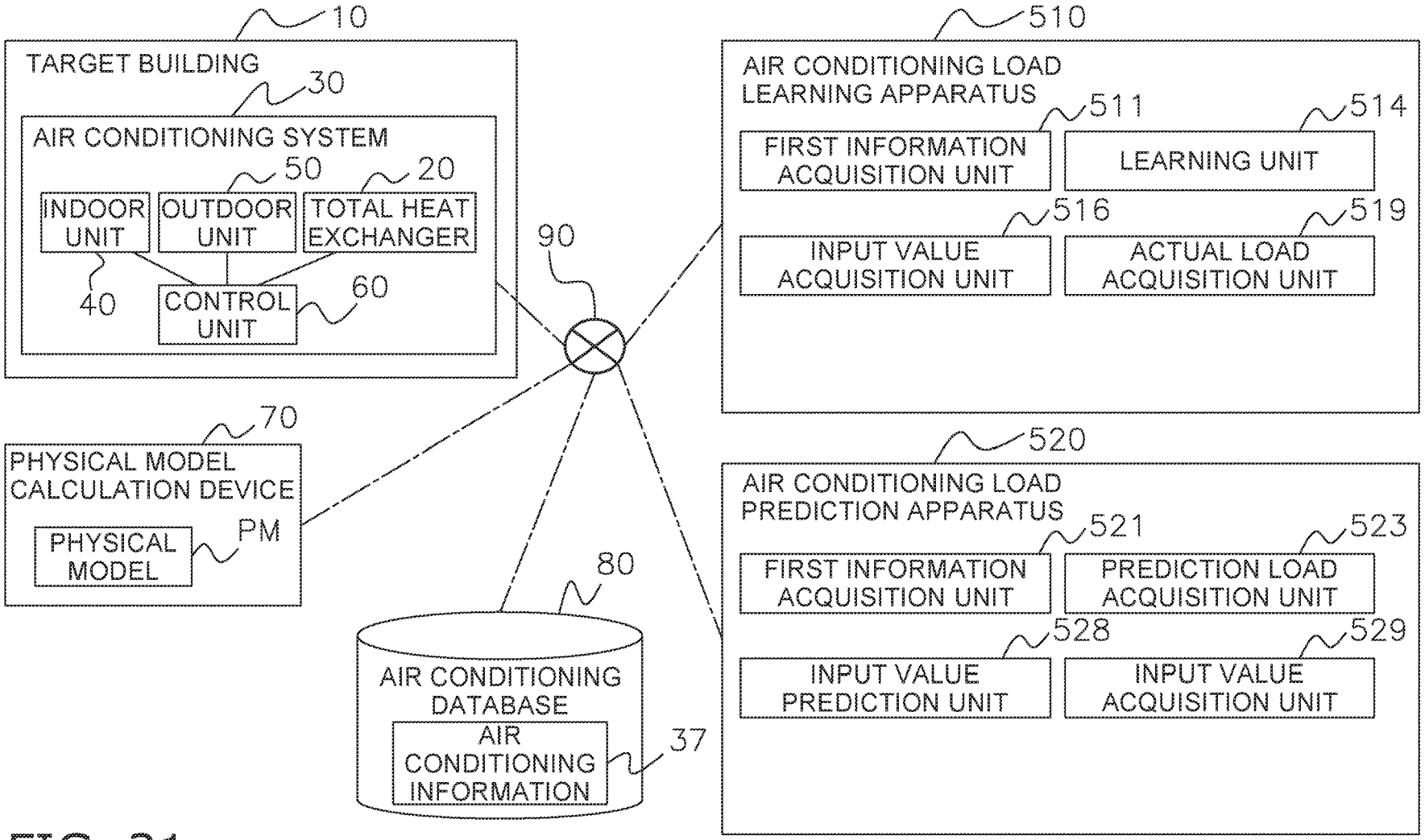
FIG. 31 is a configuration diagram of an air conditioning load learning apparatus and an air conditioning load prediction apparatus according to a fifth embodiment.

FIG. 31 is a configuration diagram of an air conditioning load learning apparatus 510 and an air conditioning load prediction apparatus 520. As illustrated in FIG. 31, the air conditioning load learning apparatus 510, the air conditioning load prediction apparatus 520, the physical model calculation device 70, the air conditioning system 30, and the air conditioning database 80 are communicatively coupled via the network 90.

(2) Detailed Configuration (2-1) Air Conditioning System

The air conditioning system 30 and the air conditioning database 80 are the same as those according to the first embodiment.

(2-2) Physical Model Calculation Device

The physical model calculation device 70 calculates the thermal load of the target building 10 based on the physical model PM. The present embodiment uses the physical model PM that may inversely calculate the corresponding input value from the air conditioning load in the target space 11.

Figure 32:
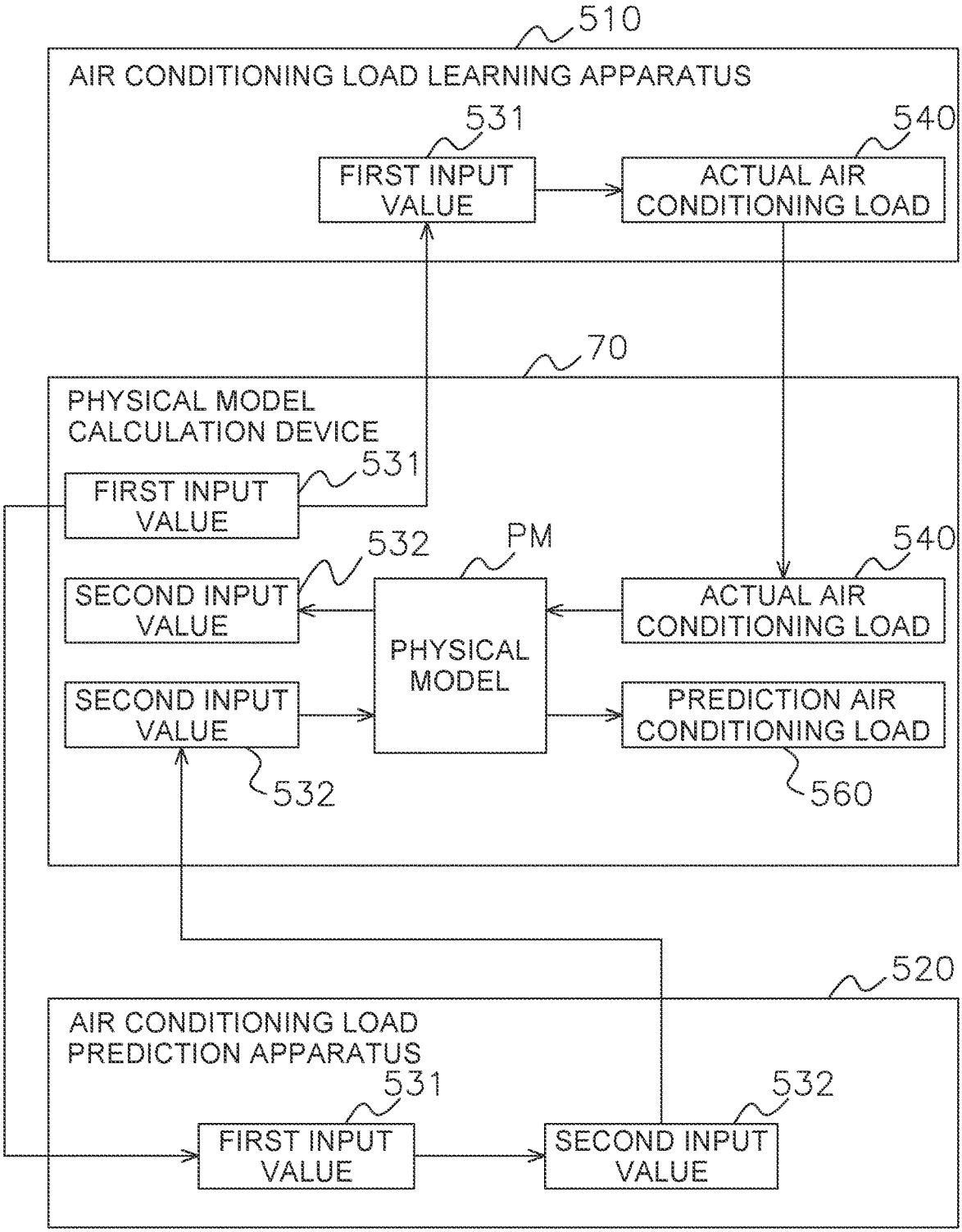
FIG. 32 is a configuration diagram of a physical model calculation process according to the fifth embodiment.

FIG. 32 is a configuration diagram of the physical model calculation process. As illustrated in FIG. 32, the physical model calculation device 70 transmits a first input value 531, which is an input value to the physical model PM, to the air conditioning load learning apparatus 510 and thus acquires an actual air conditioning load 540 corresponding to the first input value 531. The physical model calculation device 70 uses the actual air conditioning load 540 to calculate a second input value 532 by inverse calculation of the physical model PM. Furthermore, the physical model calculation device 70 transmits the first input value 531 to the air conditioning load prediction apparatus 520 and thus inputs the second input value 532 received from the air conditioning load prediction apparatus 520 to the physical model PM to calculate a prediction air conditioning load 560. The first input value 531 and the second input value 532 include at least the thermal property of the target building 10. The prediction air conditioning load 560 is a predicted air conditioning load in the target space 11.

(2-3) Air Conditioning Load Learning Apparatus

Figure 33:
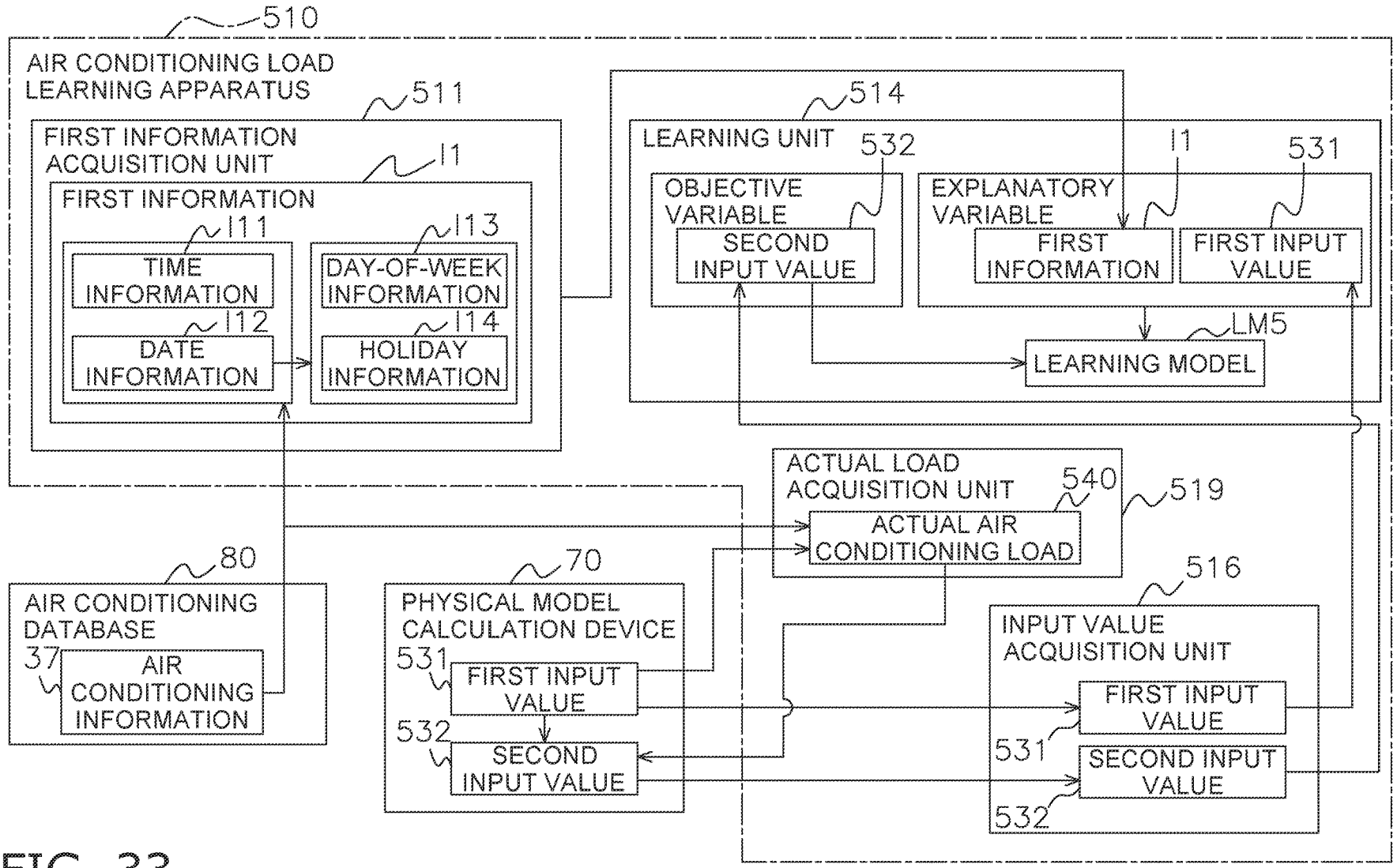
FIG. 33 is a configuration diagram of an air conditioning load learning process according to the fifth embodiment.

FIG. 33 is a configuration diagram of an air conditioning load learning process. As illustrated in FIGS. 31 and 33, the air conditioning load learning apparatus 510 primarily includes an actual load acquisition unit 519, an input value acquisition unit 516, a first information acquisition unit 511, and a learning unit 514.

The air conditioning load learning apparatus 310 includes a control arithmetic device and a storage device. A processor such as a CPU or a GPU may be used as the control arithmetic device. The control arithmetic device reads a program stored in the storage device and performs predetermined image processing and arithmetic processing in accordance with the program. Further, the control arithmetic device can write an arithmetic result in the storage device and read information stored in the storage device in accordance with the program. The actual load acquisition unit 519, the input value acquisition unit 516, the first information acquisition unit 511, and the learning unit 514 are various functional blocks implemented by the control arithmetic device and the storage device.

(2-3-1) Actual Load Acquisition Unit

As illustrated in FIG. 33, the actual load acquisition unit 519 acquires, from the air conditioning information 37 in the air conditioning database 80, the actual air conditioning load 540, which is an actual air conditioning load in the target space 11 inside the target building 10, corresponding to the first input value 531 acquired from the physical model calculation device 70.

(2-3-2) Input Value Acquisition Unit

As illustrated in FIG. 33, the input value acquisition unit 516 acquires the first input value 531 and the second input value 532 from the physical model calculation device 70.

(2-3-3) First Information Acquisition Unit

As illustrated in FIG. 33, the first information acquisition unit 511 acquires the first information I1. The first information I1 is information about the operation of the target building 10.

(2-3-4) Learning Unit

As illustrated in FIG. 33, the learning unit 514 generates a learning model LM5 using the first information I1 and the first input value 531 as explanatory variables and using the second input value 532 as an objective variable.

(2-4) Air Conditioning Load Prediction Apparatus

Figure 34:
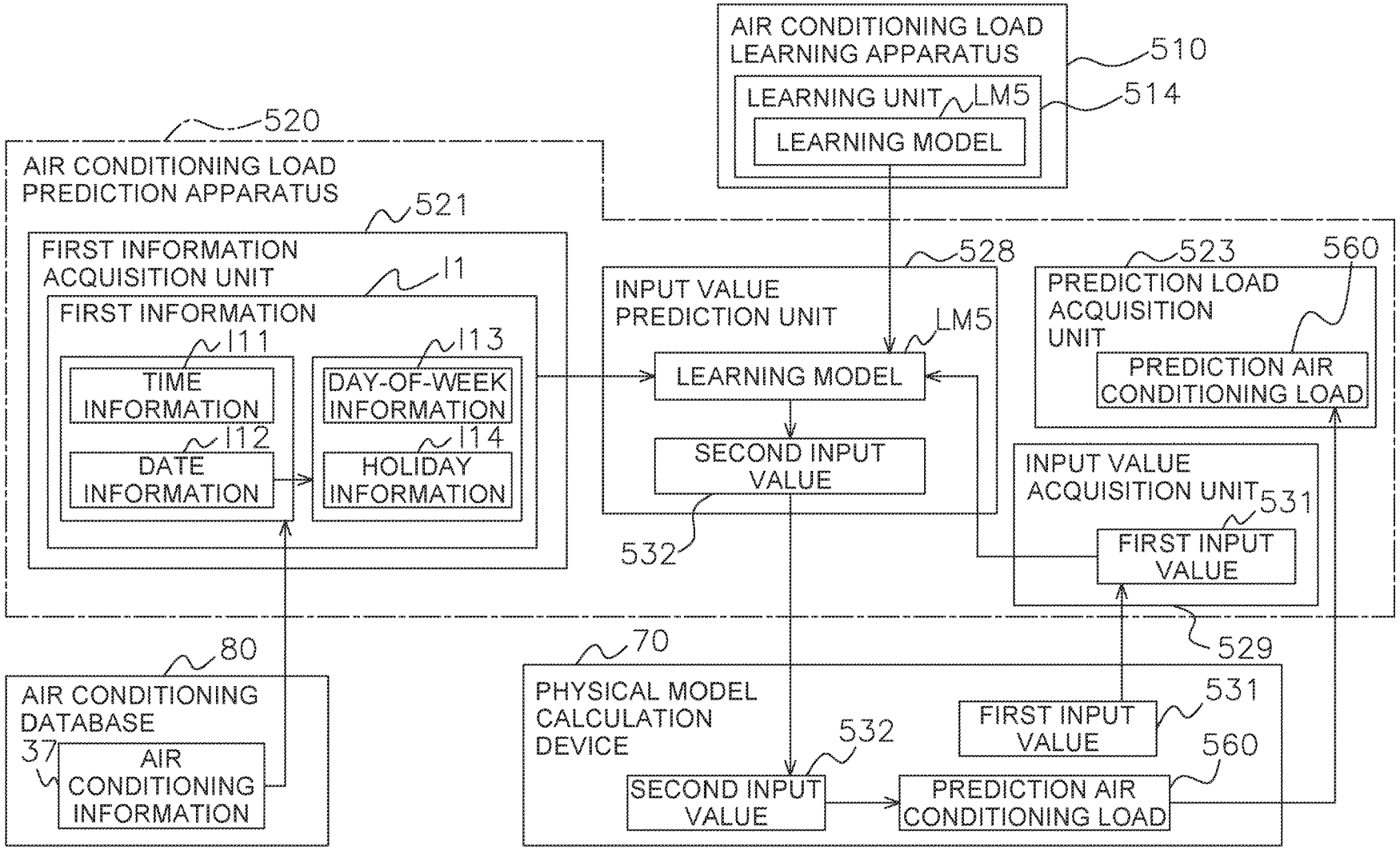
FIG. 34 is a configuration diagram of an air conditioning load prediction process according to the fifth embodiment.

FIG. 34 is a configuration diagram of an air conditioning load prediction process. As illustrated in FIGS. 31 and 34, the air conditioning load prediction apparatus 520 primarily includes a first information acquisition unit 521, an input value prediction unit 528, a prediction load acquisition unit 523, and an input value acquisition unit 529.

The air conditioning load prediction apparatus 520 includes a control arithmetic device and a storage device. A processor such as a CPU or a GPU may be used as the control arithmetic device. The control arithmetic device reads a program stored in the storage device and performs predetermined image processing and arithmetic processing in accordance with the program. Further, the control arithmetic device can write an arithmetic result in the storage device and read information stored in the storage device in accordance with the program. The first information acquisition unit 521, the input value prediction unit 528, the prediction load acquisition unit 523, and the input value acquisition unit 529 are various functional blocks implemented by the control arithmetic device and the storage device.

(2-4-1) First Information Acquisition Unit

As illustrated in FIG. 34, the first information acquisition unit 521 acquires the first information I1 in the same manner as the first information acquisition unit 511 in the air conditioning load learning apparatus 510.

(2-4-2) Input Value Acquisition Unit

As illustrated in FIG. 34, the input value acquisition unit 529 acquires the first input value 531 in the same manner as the input value acquisition unit 516 in the air conditioning load learning apparatus 510.

(2-4-3) Input Value Prediction Unit

As illustrated in FIG. 34, the input value prediction unit 528 uses the learning model LM5 generated by the learning unit 514 to predict the second input value 532 from the first information I1 and the first input value 531.

(2-4-4) Prediction Load Acquisition Unit

As illustrated in FIG. 34, the prediction load acquisition unit 523 acquires the prediction air conditioning load 560 that is an air conditioning load in the target space 11 predicted by the physical model PM using the predicted second input value 532 as an input.

(3) Process (3-1) Air Conditioning Load Learning Process

Figure 35:
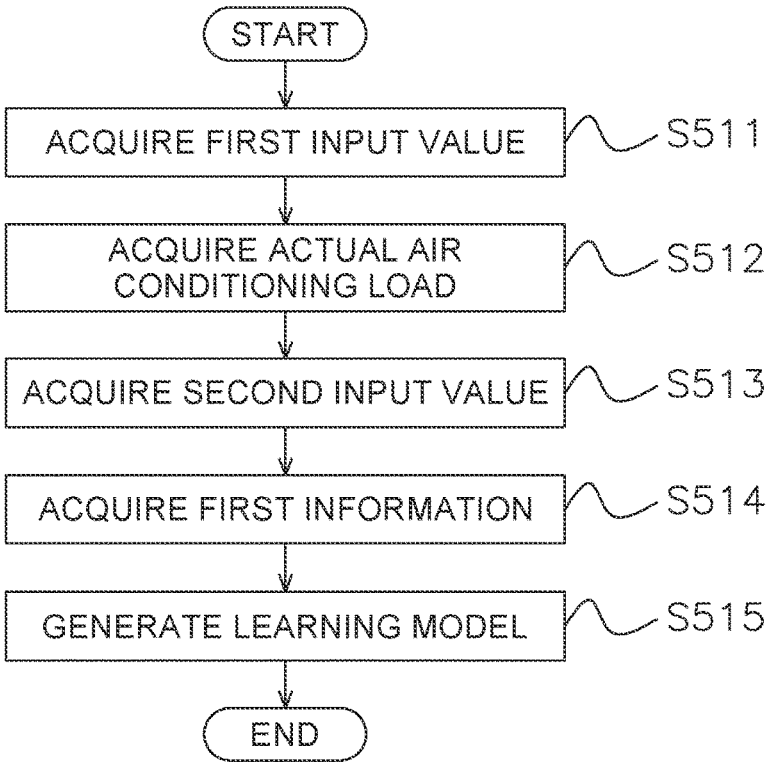
FIG. 35 is a flowchart of the air conditioning load learning process according to the fifth embodiment.

The air conditioning load learning process will be described using the flowchart of FIG. 35.

As described in Step S511, the air conditioning load learning apparatus 510 acquires the first input value 531 from the physical model calculation device 70.

After acquiring the first input value 531, the air conditioning load learning apparatus 510 acquires the actual air conditioning load 540 corresponding to the first input value 531 from the air conditioning information 37 in the air conditioning database 80 as described in Step S512.

After acquiring the actual air conditioning load 540, the air conditioning load learning apparatus 510 transmits the actual air conditioning load 540 to the physical model calculation device 70 and acquires the second input value 532 as described in Step S513.

After acquiring the second input value 532, the air conditioning load learning apparatus 510 acquires the first information I1 from the air conditioning information 37 in the air conditioning database 80 as described in Step S514.

After calculating the difference input value 350 and acquiring the first information I1, the air conditioning load learning apparatus 510 generates the learning model LM5 using the first information I1 and the first input value 531 as explanatory variables and using the second input value 532 as an objective variable as described in Step S515.

(3-2) Air Conditioning Load Prediction Process

Figure 36:
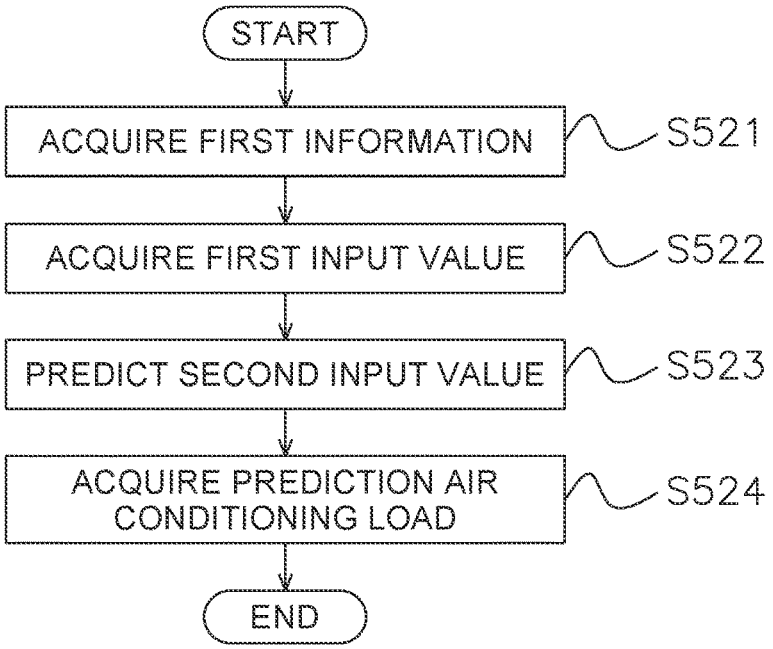
FIG. 36 is a flowchart of the air conditioning load prediction process according to the fifth embodiment.

The air conditioning load prediction process will be described using the flowchart of FIG. 36.

The air conditioning load prediction apparatus 520 acquires the first information I1 from the air conditioning information 37 in the air conditioning database 80 as described in Step S521.

After acquiring the first information I1, the air conditioning load prediction apparatus 520 acquires the first input value 531 from the physical model calculation device 70 as described in Step S522.

After acquiring the first input value 531, the air conditioning load prediction apparatus 520 uses the learning model LM5 to predict the second input value 532 from the first information I1 and the first input value 531 as described in Step S523.

After predicting the second input value 532, the air conditioning load prediction apparatus 520 acquires the prediction air conditioning load 560 that is an air conditioning load in the target space 11 predicted by the physical model PM using the second input value 532 as an input as described in Step S524.

(4) Feature (4-1)

In the air conditioning load learning apparatus 510 according to the present embodiment, the actual load acquisition unit 519 acquires the actual air conditioning load 540 that is an actual air conditioning load in the target space 11 inside the target building 10. The first information acquisition unit 511 acquires the first information I1. The first information I1 is information about the operation of the target building 10. The input value acquisition unit 516 acquires the first input value 531 and the second input value 532 from the physical model calculation device 70. The first input value 531 is an input value including at least the thermal property of the target building 10 to the physical model PM that outputs the prediction air conditioning load 560 that is a predicted air conditioning load in the target space 11. The second input value 532 is an input value calculated by inverse calculation of the physical model PM using the actual air conditioning load 540. The learning unit 514 generates the learning model LM5 using the first information I1 and the first input value 531 as explanatory variables and using the second input value 532 as an objective variable.

Therefore, the air conditioning load learning apparatus 510 associates the first information I1 with the second input value 532 (the value regarding the actual air conditioning load 540) so as to learn the effect of the operation of the building on internal heat generation, etc. As a result, the air conditioning load learning apparatus 510 can finally grasp the effect of the operation of the building on the air conditioning load.

(4-2)

In the air conditioning load prediction apparatus 520 according to the present embodiment, the input value prediction unit 528 uses the learning model LM5 to predict the second input value 532 from the first information I1 and the first input value 531. The prediction load acquisition unit 523 acquires the prediction air conditioning load 560 that is an air conditioning load in the target space 11 predicted by the physical model PM using the second input value 532 as an input.

As a result, the air conditioning load prediction apparatus 520 can use the learning model LM5 having learned the effect of the operation of the building on internal heat generation, and the like, to predict the air conditioning load in consideration of the effect of the operation of the building.

(5) Modification

Although the embodiment of the present disclosure has been described above, it is understood that various modifications may be made to forms and details without departing from the spirit and scope of the present disclosure described in claims.

What is claimed is:

1. An air conditioning load learning apparatus comprising:

at least one processor including an actual load acquisition unit configured to acquire an actual air conditioning load in a target space inside a target building;

a first information acquisition unit configured to acquire first information about an operation of the target building;

a learning unit configured to generate a learning model using at least the first information as an explanatory variable and a value regarding the actual air conditioning load as an objective variable; and a prediction load acquisition unit configured to acquire a prediction air conditioning load in the target space predicted by a physical model from at least a thermal property of the target building, the learning unit being configured to generate the learning model using the first information as an explanatory variable and a difference load between the actual air conditioning load and the prediction air conditioning load as an objective variable, the learning model being trained by creating a first training set based on at least the first information, creating a second training set based on the value regarding the actual air conditioning load, and training the learning model using the first training set and the second training set.

2. The air conditioning load learning apparatus according to claim 1, wherein the actual air conditioning load is an air conditioning load per unit time.

3. The air conditioning load learning apparatus according to claim 2, wherein the at least one processor further includes a second information acquisition unit configured to acquire second information that is at least one of an indoor humidity, an indoor temperature, an air conditioning operating time, a post air conditioning operation start elapsed time, an outside air temperature, an outside air humidity, and solar radiation, the learning unit being configured to generate the learning model further using the second information as an explanatory variable.

4. The air conditioning load learning apparatus according to claim 2, wherein the learning unit is configured to generate the learning model further using the prediction air conditioning load as an explanatory variable.

5. An air conditioning load prediction apparatus including the air conditioning load learning apparatus of claim 2, the air conditioning load prediction apparatus further comprising:

the at least one processor, the at least one processor further including a difference load prediction unit configured to use the learning model of the air conditioning load learning apparatus to predict the difference load from the first information; and a load prediction unit configured to predict an air conditioning load in the target space based on the predicted difference load and the prediction air conditioning load.

6. The air conditioning load prediction apparatus according to claim 5, wherein the learning model is generated based on the first information, the actual air conditioning load, and the prediction air conditioning load in a first period, the difference load prediction unit is configured to predict, from the first information in a second period longer than the first period, the difference load in the second period, and the load prediction unit is configured to predict an air conditioning load in the second period in the target space based on the predicted difference load in the second period and the prediction air conditioning load in the second period.

7. An air conditioning load prediction apparatus including the air conditioning load learning apparatus of claim 2, the air conditioning load prediction apparatus further comprising:

the at least one processor, the at least one processor further including a difference load prediction unit configured to use the learning model of the air conditioning load learning apparatus to predict the difference load from the first information and the second information or the prediction air conditioning load; and a load prediction unit configured to predict an air conditioning load in the target space based on the predicted difference load and the prediction air conditioning load.

8. The air conditioning load prediction apparatus according to claim 7, wherein the learning model is generated based on the first information, the second information, the actual air conditioning load, and the prediction air conditioning load in a first period, the difference load prediction unit is configured to predict, from the first information and the second information or the prediction air conditioning load in a second period longer than the first period, the difference load in the second period, and the load prediction unit is configured to predict an air conditioning load in the second period in the target space based on the predicted difference load in the second period and the prediction air conditioning load in the second period.

9. An air conditioning load learning apparatus comprising:

at least one processor including an actual load acquisition unit configured to acquire an actual air conditioning load in a target space inside a target building;

a first information acquisition unit configured to acquire first information about an operation of the target building;

a learning unit configured to generate a learning model using at least the first information as an explanatory variable a value regarding the actual air conditioning load as an objective variable; and a prediction load acquisition unit configured to acquire a prediction air conditioning load in the target space predicted by a physical model from at least a thermal property of the target building, the learning unit being configured to generate the learning model using the prediction air conditioning load and the first information as explanatory variables and the actual air conditioning load as an objective variable, the learning model being trained by creating a first training set based on at least the first information, creating a second training set based on the value regarding the actual air conditioning load, and training the learning model using the first training set and the second training set.

10. The air conditioning load learning apparatus according to claim 9, wherein the actual air conditioning load is an air conditioning load per unit time.

11. The air conditioning load learning apparatus according to claim 9, wherein the at least one processor further includes a second information acquisition unit configured to acquire second information that is at least one of an indoor humidity, an indoor temperature, an air conditioning operating time, a post air conditioning operation start elapsed time, an outside air temperature, an outside air humidity, and solar radiation, the learning unit being configured to generate the learning model further using the second information as an explanatory variable.

12. An air conditioning load prediction apparatus including the air conditioning load learning apparatus of claim 9, the air conditioning load prediction apparatus further comprising:

the at least one processor, the at least one processor further including a load prediction unit configured to use the learning model generated by the learning unit in the air conditioning load learning apparatus to predict an air conditioning load in the target space from the prediction air conditioning load and the first information.

13. The air conditioning load prediction apparatus according to claim 12, wherein the learning model is generated based on the prediction air conditioning load, the first information, and the actual air conditioning load in a first period, and based on the prediction air conditioning load and the first information in a second period longer than the first period, the load prediction unit predicts an air conditioning load in the second period in the target space.

14. An air conditioning load prediction apparatus including the air conditioning load learning apparatus of claim 11, the air conditioning load prediction apparatus further comprising:

the at least one processor, the at least one processor further including a load prediction unit configured to use the learning model generated by the learning unit in the air conditioning load learning apparatus to predict an air conditioning load in the target space from the prediction air conditioning load, the first information, and the second information.

15. The air conditioning load prediction apparatus according to claim 14, wherein the learning model is generated based on the prediction air conditioning load, the first information, the second information, and the actual air conditioning load in a first period, and based on the prediction air conditioning load, the first information, and the second information in a second period longer than the first period, the load prediction unit predicts an air conditioning load in the second period in the target space.

16. An air conditioning load learning apparatus comprising:

at least one processor including an actual load acquisition unit configured to acquire an actual air conditioning load in a target space inside a target building;

a first information acquisition unit configured to acquire first information about an operation of the target building;

a learning unit configured to generate a learning model using at least the first information as an explanatory variable a value regarding the actual air conditioning load as an objective variable; and an input value acquisition unit configured to acquire a first input value including at least a thermal property of the target building to a physical model, which outputs a prediction air conditioning load in the target space, and a second input value calculated by inverse calculation of the physical model using the actual air conditioning load, the learning unit being configured to generate the learning model using the first information as an explanatory variable and a difference input value between the first input value and the second input value as an objective variable, the learning model being trained by creating a first training set based on at least the first information, creating a second training set based on the value regarding the actual air conditioning load, and training the learning model using the first training set and the second training set.

17. The air conditioning load learning apparatus according to claim 16, wherein the learning unit is configured to generate the learning model further using the first input value as an explanatory variable.

18. An air conditioning load prediction apparatus including the air conditioning load learning apparatus of claim 16, the air conditioning load prediction apparatus further comprising:

the at least one processor, the at least one processor further including a difference input value prediction unit configured to use the learning model of the air conditioning load learning apparatus to predict the difference input value from at least the first information; and a prediction load acquisition unit configured to acquire a prediction air conditioning load in the target space predicted by the physical model using, as an input, a third input value obtained by correcting the first input value using the predicted difference input value.

19. An air conditioning load learning apparatus comprising:

at least one processor including an actual load acquisition unit configured to acquire an actual air conditioning load in a target space inside a target building;

a first information acquisition unit configured to acquire first information about an operation of the target building;

a learning unit configured to generate a learning model using at least the first information as an explanatory variable a value regarding the actual air conditioning load as an objective variable;

a prediction load acquisition unit configured to acquire a prediction air conditioning load in the target space predicted by a physical model from at least a thermal property of the target building; and a difference input value acquisition unit configured to acquire a difference input value calculated by inverse calculation of the physical model using a difference load between the actual air conditioning load and the prediction air conditioning load, the learning unit being configured to generate the learning model using the first information as an explanatory variable and the difference input value as an objective variable, the learning model being trained by creating a first training set based on at least the first information, creating a second training set based on a value regarding the actual air conditioning load, and training the learning model using the first training set and the second training set.

20. The air conditioning load learning apparatus according to claim 19, wherein the learning unit is configured to generate the learning model further using an input value to the physical model as an explanatory variable.

21. An air conditioning load prediction apparatus including the air conditioning load learning apparatus of claim 19, the air conditioning load prediction apparatus further comprising:

the at least one processor, the at least one processor further including a difference input value prediction unit configured to use the learning model of the air conditioning load learning apparatus to predict the difference input value from at least the first information;

a prediction difference load acquisition unit configured to acquire the difference load predicted by the physical model using the predicted difference input value as an input; and a load prediction unit configured to predict an air conditioning load in the target space based on the acquired difference load and the prediction air conditioning load.

22. An air conditioning load learning apparatus comprising:

at least one processor including an actual load acquisition unit configured to acquire an actual air conditioning load in a target space inside a target building;

a first information acquisition unit configured to acquire first information about an operation of the target building:

a learning unit configured to generate a learning model using at least the first information as an explanatory variable a value regarding the actual air conditioning load as an objective variable; and an input value acquisition unit configured to acquire a first input value including at least a thermal property of the target building to a physical model, which outputs a prediction air conditioning load in the target space, and a second input value calculated by inverse calculation of the physical model using the actual air conditioning load, the learning unit being configured to generate the learning model using the first information and the first input value as explanatory variables and the second input value as an objective variable, the learning model being trained by creating a first training set based on at least the first information, creating a second training set based on a value regarding the actual air conditioning load, and training the learning model using the first training set and the second training set.

23. An air conditioning load prediction apparatus including the air conditioning load learning apparatus of claim 22, the air conditioning load prediction apparatus further comprising:

the at least one processor further includes an input value prediction unit configured to use the learning model of the air conditioning load learning apparatus to predict the second input value from the first information and the first input value; and a prediction load acquisition unit configured to acquire a prediction air conditioning load in the target space predicted by the physical model using the predicted second input value as an input.

* * * * *